US006828533B2

(12) United States Patent
Hayami et al.

(10) Patent No.: US 6,828,533 B2
(45) Date of Patent: Dec. 7, 2004

(54) MICROWAVE HEATING DEVICE

(75) Inventors: Katsuaki Hayami, Otsu (JP); Kuniyasu Kubo, Kusatsu (JP); Yukihiro Kitada, Otsu (JP); Takashi Fukuda, Kyoto (JP); Yoshitsugu Kawamura, Otsu (JP); Eiji Fukunaga, Ohtsu (JP); Yoshihito Fukuda, Koga-Gun (JP); Yuichi Otsuki, Ohtsu (JP)

(73) Assignee: Sanyo Electric Co., Ltd., Moriguchi (JP)

( * ) Notice: Subject to any disclaimer, the term of this patent is extended or adjusted under 35 U.S.C. 154(b) by 20 days.

(21) Appl. No.: 10/331,128

(22) Filed: Dec. 27, 2002

(65) Prior Publication Data

US 2003/0121913 A1 Jul. 3, 2003

(30) Foreign Application Priority Data

Dec. 27, 2001 (JP) ..... 2001-397441
Jan. 28, 2002 (JP) ..... 2002-018973

(51) Int. Cl.[7] ..... H05B 6/70; H05B 6/80

(52) U.S. Cl. ..... 219/730; 732/763; 732/746; 732/748; 732/756; 99/DIG. 14

(58) Field of Search ..... 219/725, 730, 219/732, 734, 739, 759, 762, 763, 685, 745, 746, 748, 749, 756, 733; 99/DIG. 14

(56) References Cited

U.S. PATENT DOCUMENTS 2,612,596 A * 9/1952 Gross ..... 219/745
2,778,911 A * 1/1957 Valentine ..... 219/762
3,965,323 A * 6/1976 Forker, Jr. et al. ..... 219/730
4,342,896 A * 8/1982 Teich ..... 219/749
5,097,106 A * 3/1992 Arai et al. ..... 219/763

FOREIGN PATENT DOCUMENTS

JP 52-111046 9/1977

* cited by examiner

*Primary Examiner*—Philip H. Leung
(74) *Attorney, Agent, or Firm*—Darby & Darby

(57) ABSTRACT

The present invention relates to a microwave heating device, and in particular, a microwave heating device with a microwave heating element mounted on the surface of a heating dish on which food is placed inside a heating chamber.

The microwave heating device according to the present invention includes a heating chamber for placing an object to be heated; a magnetron for generating microwaves; a waveguide for supplying the microwaves generated by the magnetron through the bottom of the heating chamber; a heating dish on which the object to be heated is placed; a microwave heating element positioned on the bottom surface of the heating dish to generate heat by absorbing microwaves; and an access passage for allowing the microwaves supplied by the waveguide to reach above the heating dish from below the heating dish.

The object on the heating dish is heated by the heating dish, which is heated by the microwave heating element and by microwaves that reach above the heating dish. Therefore, the surface and the inside of the object can be heated in a simple and quick heating operation.

18 Claims, 51 Drawing Sheets

MICROWAVE HEATING DEVICE

FIELD OF THE INVENTION

The present invention relates to a microwave heating device, and in particular, a microwave heating device with a microwave heating element mounted on the surface of a heating dish on which food is placed inside a heating chamber.

BACKGROUND OF THE INVENTION

Unexamined Japanese Patent Application Publication (A) S52-111046 discloses a conventional microwave heating device with a microwave heating element mounted on a heating dish. The conventional microwave heating device has a microwave heating element mounted on the bottom face of a metallic dish. The microwave heating element is heated by microwaves generated at the bottom side of the heating chamber, and the microwaves heat an object placed on the metallic dish.

The conventional microwave heating device insufficiently heats the object on the metallic dish. The object absorbs the microwaves directly while the surface of the object that contacts the face of the dish is heated intensely and burns. Therefore, the conventional microwave heating device does not satisfy the basic objective of microwave heating, i.e., to heat the inside of the object.

The conventional microwave heating device also can heat the object directly with microwaves when the dish is removed from the heating chamber. However, this method of heating an object suggests that it is necessary to move the object being heated to another container while cooking to be able to heat the object directly by microwaves after having been heated on the dish provided with the microwave heating element. This method of heating an object requires a more complicated operation for the user and a longer cooking time.

The present invention provides a microwave heating device capable of heating both the surface and the inside of the object with a simple and quick operation.

SUMMARY OF THE INVENTION

The microwave heating device according to the present invention includes a heating chamber for placing an object to be heated; a magnetron for generating microwaves; a waveguide for supplying the microwaves generated by the magnetron through the bottom of the heating chamber; a heating dish on which the object to be heated is placed; a microwave heating element positioned on the bottom surface of the heating dish to generate heat by absorbing microwaves; and an access passage for allowing the microwaves supplied by the waveguide to reach above the heating dish from below the heating dish.

The object on the heating dish is heated by the heating dish, which is heated by the microwave heating element and by microwaves that reach above the heating dish. Therefore, the surface and the inside of the object can be heated in a simple and quick heating operation. The heating chamber can have recessed areas for providing gaps between the inner wall of the heating chamber and the heating dish, particularly in areas of the inner wall adjacent to the heating dish. Therefore, microwaves that are not absorbed by the microwave heating element can be sent upward to efficiently reach areas above the heating dish through the gaps between the heating dish and the recessed areas.

The heating dish can have the microwave heating element included on any surface of the heating dish except on the outer edge of the heating dish. Therefore, both the microwave heating element and the microwaves can more efficiently heat the object by sending the microwaves to the outer edge of the heating dish where it is less likely that object is present. The safety of the device also improves since the outer edge of the heating dish is heated less, and the outer edge is where users tend to hold the heating dish.

The microwave heating device of the present invention can also have a heater provided above the heating dish. Therefore, the surface of the object can be heated to a desirable temperature.

The dimension of the access passage in the direction perpendicular to the traveling direction of the microwaves can be greater than one quarter of the wavelength of the microwaves. Therefore, the microwaves can be sent more effectively above the heating dish.

The microwave heating device can have a first surface on the inner wall of the heating chamber and a second surface facing a different direction from the first surface. The first and second surfaces can have rails for supporting the heating dish, and these rails can have a plurality of members which are properly spaced from each other on a single plane. Therefore, more microwave energy can be efficiently sent through the gaps between the members of the rails.

The microwave heating device can have a groove on the outer edge of the surface of the heating dish that can carry the object to be heated. Therefore, the cooking process can be improved since any water or oil released from the food can be carried away by the groove and separated from the food.

The lowest part of the heating dish can be located below the microwave heating element. Therefore, if the heating dish is placed on a table or the like, the microwave heating element, which can reach a very high temperature, is prevented from touching the table.

The microwave heating device can also have a rotating antenna that rotates to spread the microwaves in the waveguide inside the heating chamber and a rotation control unit for controlling the rotation of the rotating antenna. The rotation control unit can be capable of stopping the rotating antenna at a position corresponding to the height at which the heating dish is stored when the magnetron generates microwaves. Therefore, various types of cooking can be achieved with the heating dish.

The area of a surface of the microwave heating element of the heating dish perpendicular to the traveling direction of the microwaves can be equal to the area of the rotating antenna when the distance between the heating dish and the bottom face of the heating chamber in the traveling direction of the microwaves is ⅛ of the wavelength of the microwaves. The area can increase in proportion to the distance in the traveling direction when it is greater than ⅛ of the wavelength of the microwaves and can decrease in proportion to the distance in the traveling direction when it is smaller than ⅛ of the wavelength of the microwaves. Therefore, various types of cooking can be achieved with the heating dish.

The heating dish can be stored in the heating chamber at a distance of ⅛ of the wavelength of the microwaves apart from the bottom face of the heating chamber. Therefore, the object can be cooked on the heating dish more efficiently using the microwave heating element.

The rotating antenna inside the heating chamber can rotate within a specified plane to spread the microwaves in the waveguide and can have metal plates on the circumference of the rotating antenna. An antenna enclosure can be located near the connection between the waveguide for enclosing the rotating antenna so that when a placement span, which is a distance between the circumference of the rotating antenna and the surface of the antenna enclosure along a direction perpendicular to the specified plane, is not uniform, the metal plates are positioned in areas where the placement span is the longest. Therefore, the circumference of the heating dish is prevented from being overheated to cause fluctuations in heat over the heating dish, because the microwaves that travel toward the side wall of the heating chamber relatively further away from the circumference of the rotating antenna will be guided by the metal plates toward the center of the heating chamber.

The tip of the metal plates can be located ahead of the rotating antenna relative to the traveling direction of the microwaves. Therefore, the metal plate can correct the traveling direction of the microwaves that are supplied to the heater chamber via the rotating antenna. The microwave heating device can have a heater on the circumference of the rotating antenna so that the metal plates are located between the heater and the rotating antenna. Therefore, the heater will not interfere with the rotating antenna's guidance of the microwaves in the desired direction.

The microwave heating device can have a door that controls access to the heating chamber and a first protruding part on the inner wall of the heating chamber, which protrudes into the heating chamber and abuts against the heating dish when the heating dish is placed in an undesirable position for the supply of microwaves to the heating chamber. The magnetron generates microwaves only when the door is closed, and abutting the heating dish against the first protruding part prevents the door of the heating chamber from closing. Therefore, the microwaves can be prevented from being supplied to the heating chamber while the heating dish is placed in an undesirable position for supplying microwaves to the heating chamber. For example, an undesirable position can be a place in which the heating dish tends to cause electric discharges between the heating dish and the rotating antenna.

The microwave heating device can also have a heater for heating foods in the heating chamber; a metallic dish in the heating chamber for carrying the object to be heated when it is heated by the heater; and a second protruding part that abuts against the metallic dish when the metallic dish is placed in an undesirable position in the heating chamber. The magnetron generates microwaves only when the door is closed so that when the metallic dish abuts against the second protruding part, the door of the heating chamber is prevented from closing. The heating dish is shaped so that it does not abut against the second protruding part even when the heating dish is located in every possible position in the heating chamber. Therefore, the metallic dish is prevented by the second protruding part from being placed in the heating chamber when microwaves are supplied to the heating chamber. However, the second protruding part does not prevent the heating dish from being installed in the heating chamber.

The microwave heating element can have a thickness that equalizes the amount of microwaves absorbed by the microwave heating element with the amount of microwaves that are passed through. Therefore, the microwave heating element mounted on the heating dish can efficiently exchange the heat generated by absorbing the microwaves.

KEY

Figure 1:
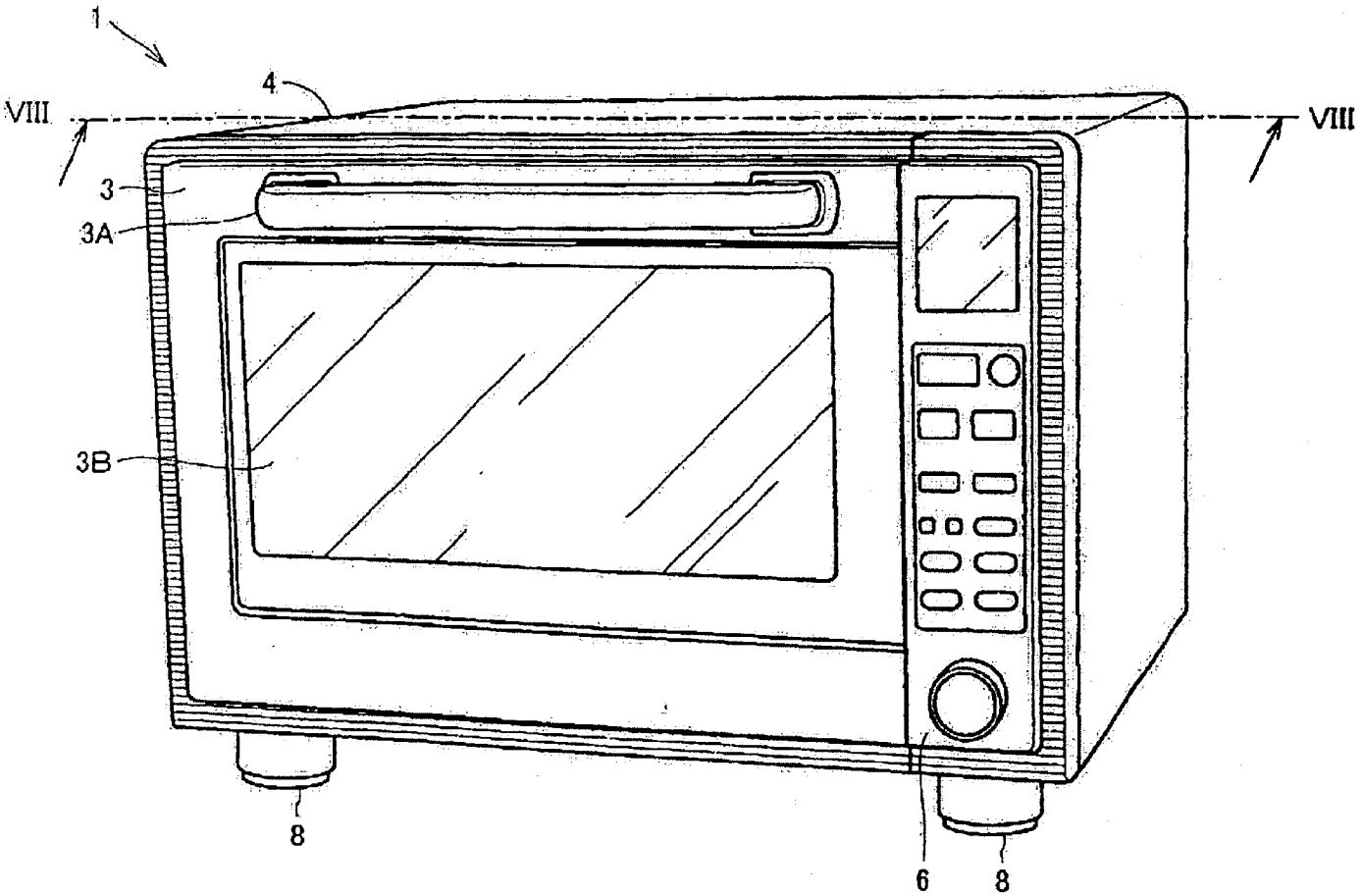
FIG. 1 is a perspective drawing of a microwave oven according to the present invention.

1 microwave oven
2 main body
5 main frame
6 operating panel
7 infrared sensor
9 bottom plate
10 heating chamber
12 magnetron
19 waveguide
40 detection passage member
59 oven thermistor
80 oven broiling dish
81 microwave heating element
101, 102 recessed area
103, 104, 106, 107, 111–118 rail

DETAILED DESCRIPTION OF THE PREFERRED EMBODIMENTS

1. Structure of a Microwave Oven

FIG. 1 is a perspective view of a microwave oven according to an embodiment of the present invention. A microwave oven 1 includes a main body 2 and a door 3. The main body 2 is covered by an outer shell 4, which is supported by a plurality of legs 8. The front of the main body has an operating panel 6 for inputting various kinds of information to the microwave oven 1.

Figure 2:
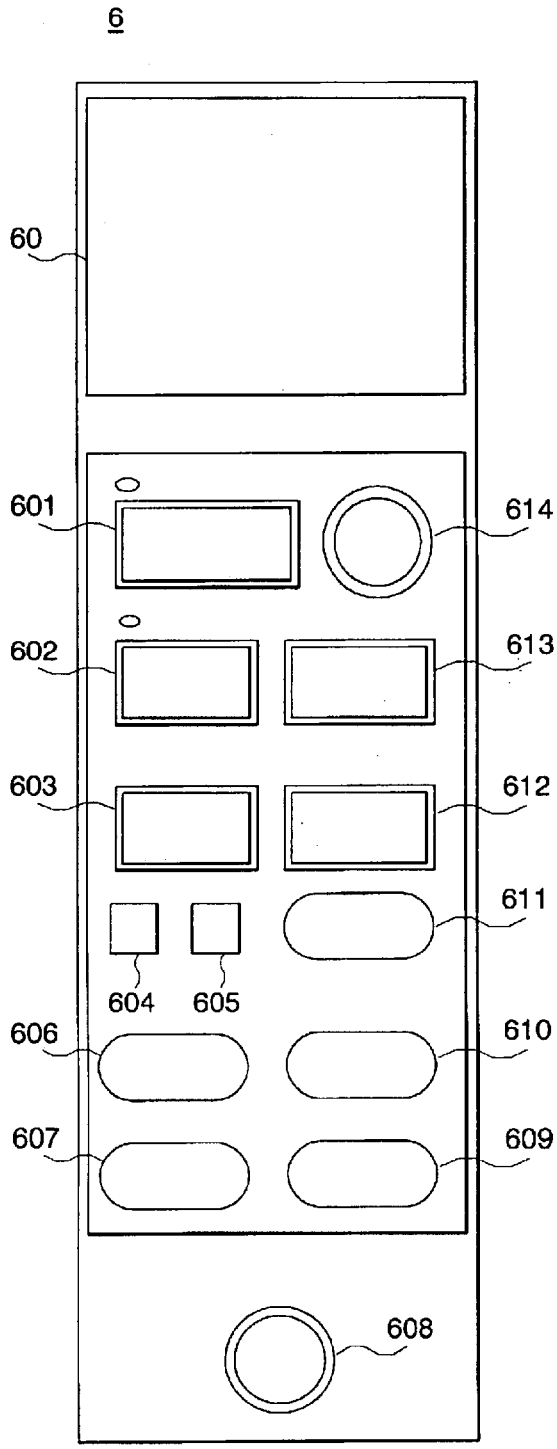
FIG. 2 is a front view of an operating panel according to the present invention.
Figure 3:
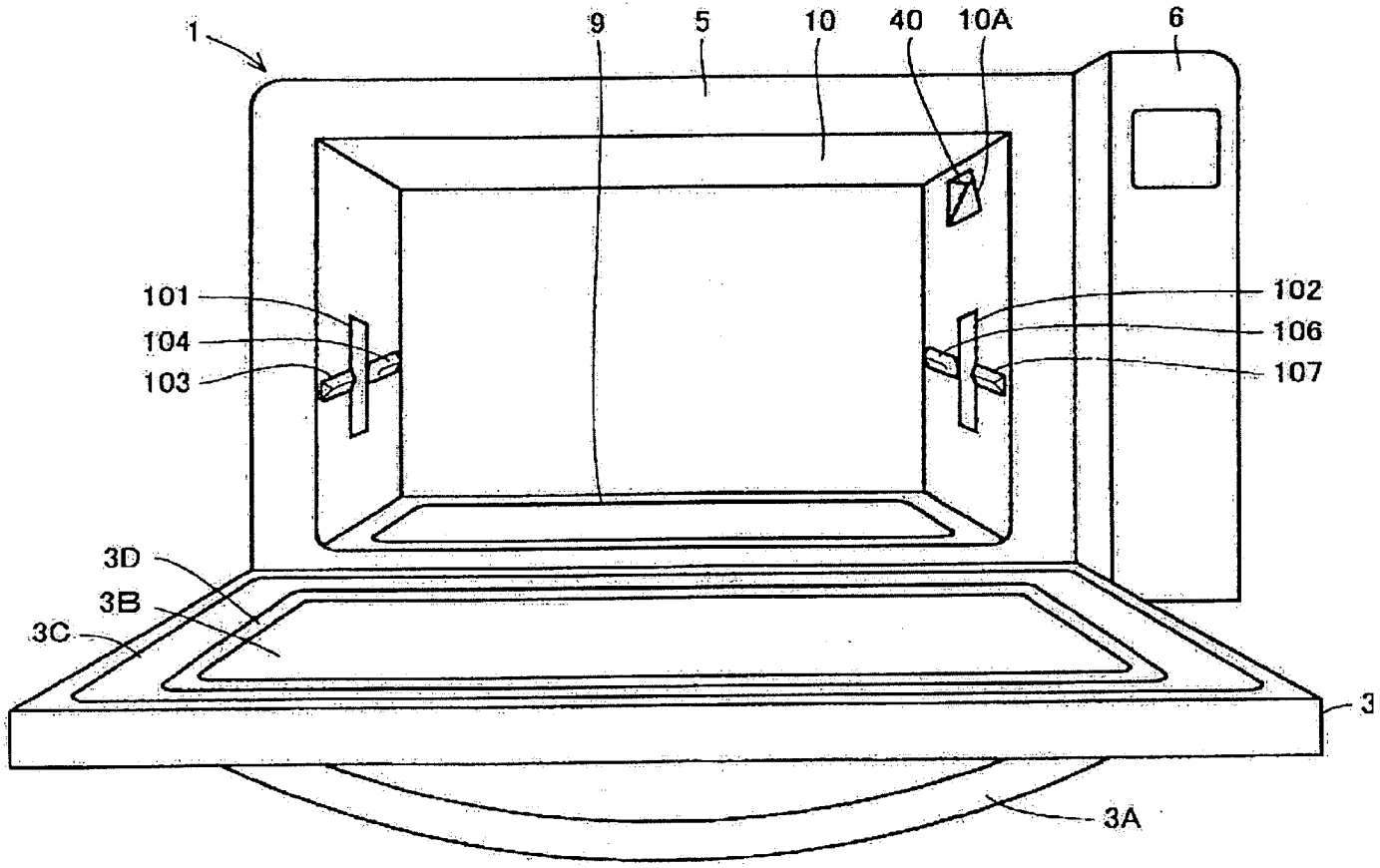
FIG. 3 is a front view of a microwave oven with its door opened according to the present invention.

The door 3 opens and closes by pivoting around its bottom edge. A grip 3A is positioned at the top of the door 3. FIG. 2 shows the front view of the operating panel 6, and FIG. 3 shows the front view of the microwave oven 1 when the door 3 is open.

A main body frame 5 is provided inside the main body 2. A heating chamber 10 is provided inside the main body frame 5. A hole 10A is formed on the top right side of the heating chamber 10. A detection passage member 40 is connected to the hole 10A from the outside of the heating chamber 10. A bottom plate 9 is provided at the bottom of the heating chamber 10.

A transparent heat-resistant glass plate 3B is affixed to the middle of the door 3 so that the inside of the heat chamber 10 can be viewed from the outside of the microwave oven 1 when the door 3 is closed. A plastic choke cover 3C is positioned inside the heat chamber 10 and is accessible through the door 3. The choke cover 3C fills a gap between the outer circumference of a contact surface 3D and the door 3. The contact surface 3D contacts the main frame 5. The microwaves that escape through the gap between the contact surface 3D and the main frame 5 are prevented from leaking out from the heating chamber 10 by a choke structure (not shown). The choke structure is covered by the choke cover 3C and formed in the door 3.

The operation panel 6 provides a display unit 60, an adjusting knob 608, and various keys. The display unit 60 has a liquid crystal display panel and the like for displaying various kinds of information. The adjusting knob 608 is used for inputting numerical values and other kinds of information.

A preheat start key 601 is used to prepare the food for various kinds of cooking. An oven broiling key 602 is used for heating foods using an oven broiling dish 80 as described later. A temperature selection key 603 is used for entering the desired temperature for cooking at a temperature selected by using the adjusting knob 608.

The microwave oven 1 can automatically cook using various selections included on a cooking menu, and the cooking intensity can be adjusted by keys 604, 605 so that by pressing key 604 weakens the intensity level and pressing key 605 strengthens the intensity level. A grilling key 606 is used to control the degree of browning of the food in the heating chamber 10 using a heater (not shown). A deodorizing key 607 is used for removing odors in the heating chamber 10.

The microwave oven 1 can be constructed having a plurality of trays (or oven broiling dishes 80) in the heating chamber 10. An oven step adjusting key 609 is used to enter whether one or two steps are to be used for oven cooking in the heating chamber 10. A fermentation key 610 is used for fermenting foods such as bread dough. An oven output key 611 is used for controlling the output of microwaves generated in the microwave oven 1. A defrosting key 613 is used for defrosting frozen foods; pressing the defrosting key 613 twice will defrost frozen sashimi (i.e., sliced raw fish fillets) in the microwave oven 1. A cancellation key 614 is used for canceling the key operation before the input has been completed.

Figure 4:
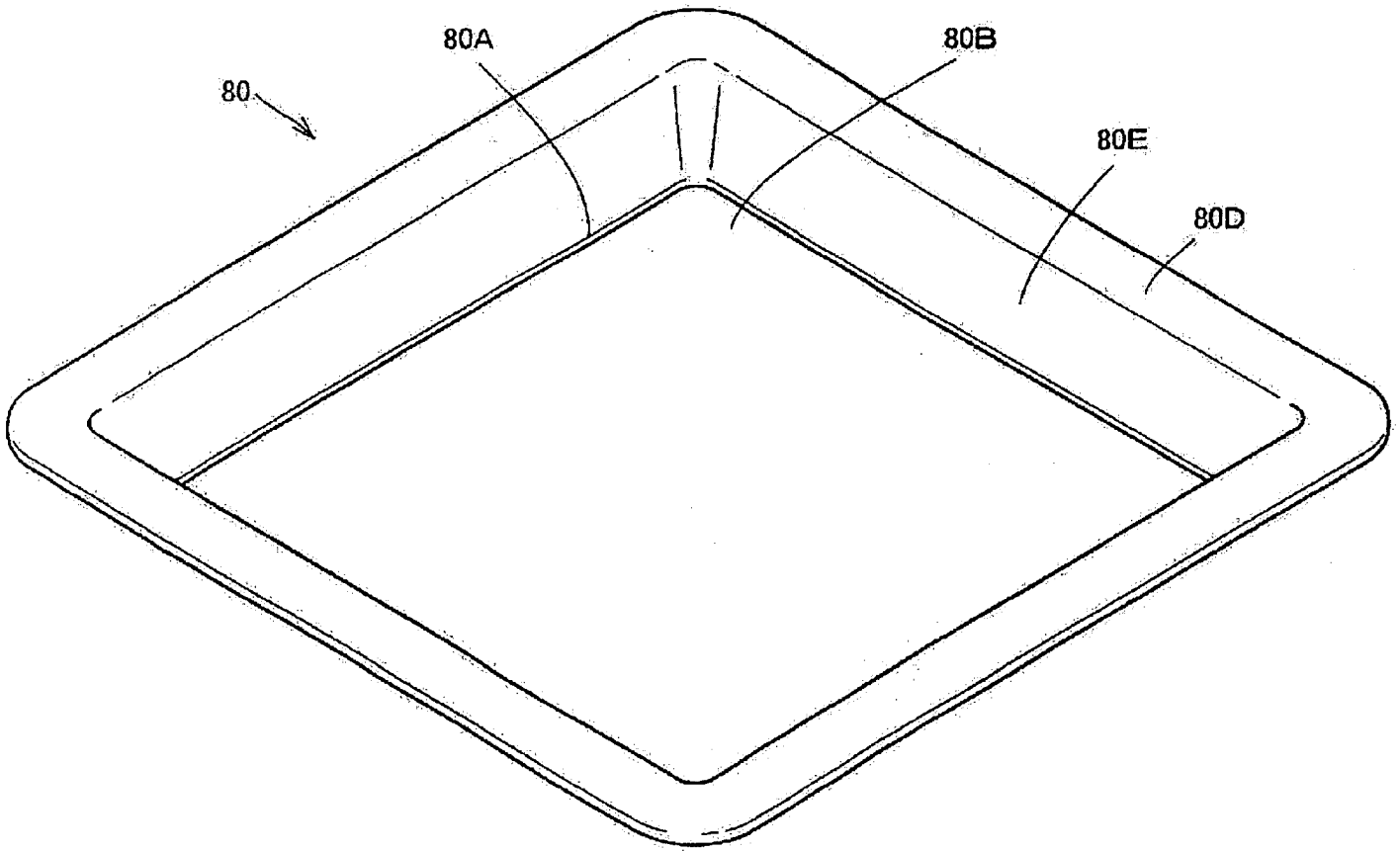
FIG. 4 is a perspective view of an oven broiling dish to be installed in the microwave oven according to the present invention.

An oven broiling dish 80, as shown in FIG. 4, can be placed in the heating chamber 10 of the microwave oven 1. Rails 103, 104, 106, 107 protrude into the heating chamber 10 to support the oven broiling dish 80. Rails 103, 104, 106, 107 are aligned in horizontal lines, respectively. Recessed areas 101, 102 are formed between rail 103 and rail 104 and between rail 106 and rail 107, respectively. Recessed areas 101, 102 protrude outward from the heating chamber 10. Rails 103, 104, 106, 107 and recessed areas 101, 102 can be made by press-forming the sheet metal that constitute the walls of the heat chamber 10.

Figure 5:
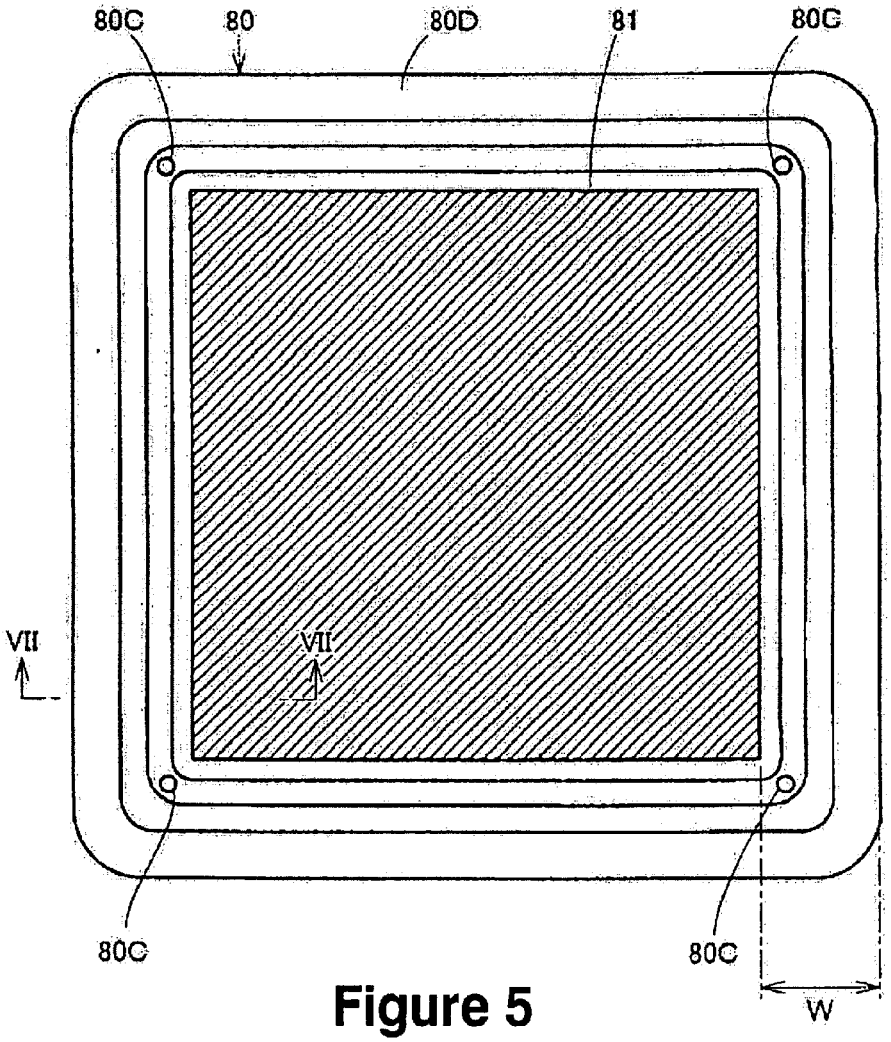
FIG. 5 is a bottom view of an oven broiling dish according to the present invention.
Figure 6:
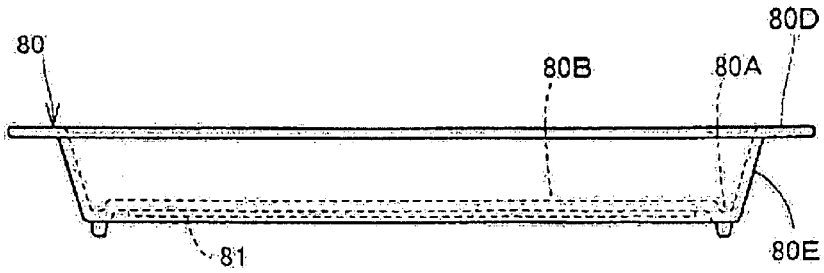
FIG. 6 is a front view of an oven broiling dish according to the present invention.
Figure 7:
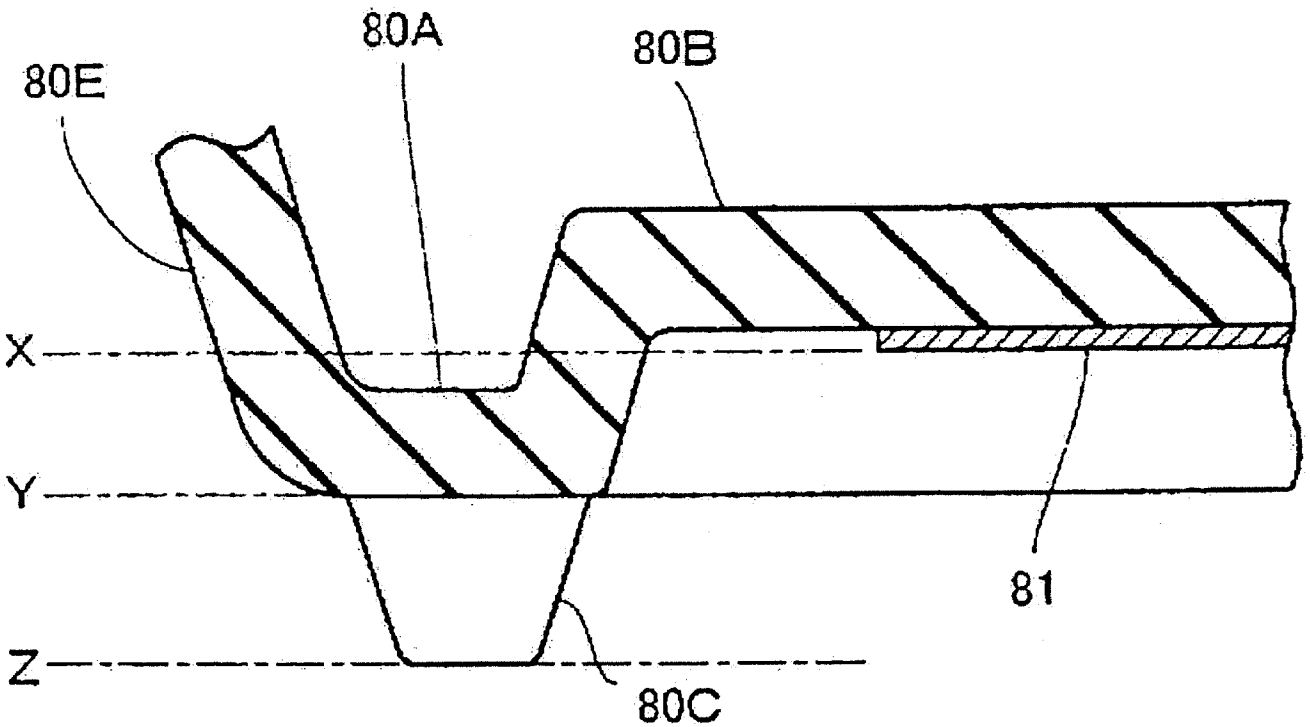
FIG. 7 is a cross-sectional view taken along the line VII—VII shown in FIG. 5.

FIG. 4 is a perspective view of the oven broiling dish 80. FIGS. 5 and 6 are a bottom view and a front view, respectively, of the oven broiling dish 80, and FIG. 7 is a cross-sectional view along line VII—VII of FIG. 5.

The oven broiling dish 80 has a bottom 80B and an outer periphery 80D that extends outward in the horizontal direction. The outer periphery 80D is connected to the bottom 80D via a wall 80E. A groove 80A is provided on the outer edge of the bottom 80B that connects to the wall 80E.

A microwave heating element 81 is formed by a vapor deposition process on the bottom surface of the bottom 80B of the oven broiling dish 80. The microwave heating element 81 is formed from a material that generates heat when it absorbs microwaves, such as an electrically conductive material or, more specifically, an electrically conductive material that includes molybdenum added with tin oxide. The thickness of the deposition film is preferably on the order of $8\times10^{-8}$ m, and the specific resistance is preferably 2–6 Ω/m. The hatched area in FIG. 5 shows the surface of the microwave heating element 81.

A leg 80C is formed on each corner of the oven broiling dish 80. In FIG. 7, Z indicates the height of the lowest part of the leg 80C; Y indicates the height of the lowest part of the bottom 80B correspond to the back of the groove 80A; and X indicates the height of the lowest part of the microwave heating element 81.

Since X is higher than Y and Z, if the oven broiling dish 80 is taken out of heating chamber 10 and placed on a carrying surface, such as a table, after the microwave heating element 81 has been heated to a high temperature, then the leg 80C or the bottom 80B of the oven broiling dish 80 contacts the carrying surface. Therefore, the microwave heating element 81 does not contact the carrying surface directly, and the high temperature heat of the microwave heating element 81 is prevented from being transmitted to the carrying surface.

Furthermore, if the microwave heating element 81 is heated to a high temperature and contacts the choke cover 3C, the choke cover 3C may melt. The gap between the contact surface 3D and the main frame 5 widens when the choke cover 3C melts and allows the microwaves to leak from the heating chamber 10. However, since the oven broiling dish 80 is constructed as shown in FIG. 7, the oven broiling dish 80 can be placed on the door 3 when it is opened as shown in FIG. 3 without allowing the microwave heating element 81 to contact the choke cover 3C.

The microwave heating element 81 is vapor-deposited at a distance W apart from the edge of the outer periphery 80D of the oven broiling dish 80 and on the inside of the groove 80A, as shown in FIG. 5. The distance W must be greater than one quarter of the wavelength λ of the microwaves supplied into the heating chamber 10, i.e., greater than λ/4, in order to send the microwaves efficiently above the heating dish 80. In order to generate the microwaves efficiently in microwave oven 1, the distance W must be greater than 3 cm. For example, if the distance W is 5 cm, approximately 75–80% of the microwaves generated by the magnetron 12 will be absorbed by the microwave heating element 81 and approximately 20–25% will be sent above and through the oven broiling dish 80.

Figure 8:
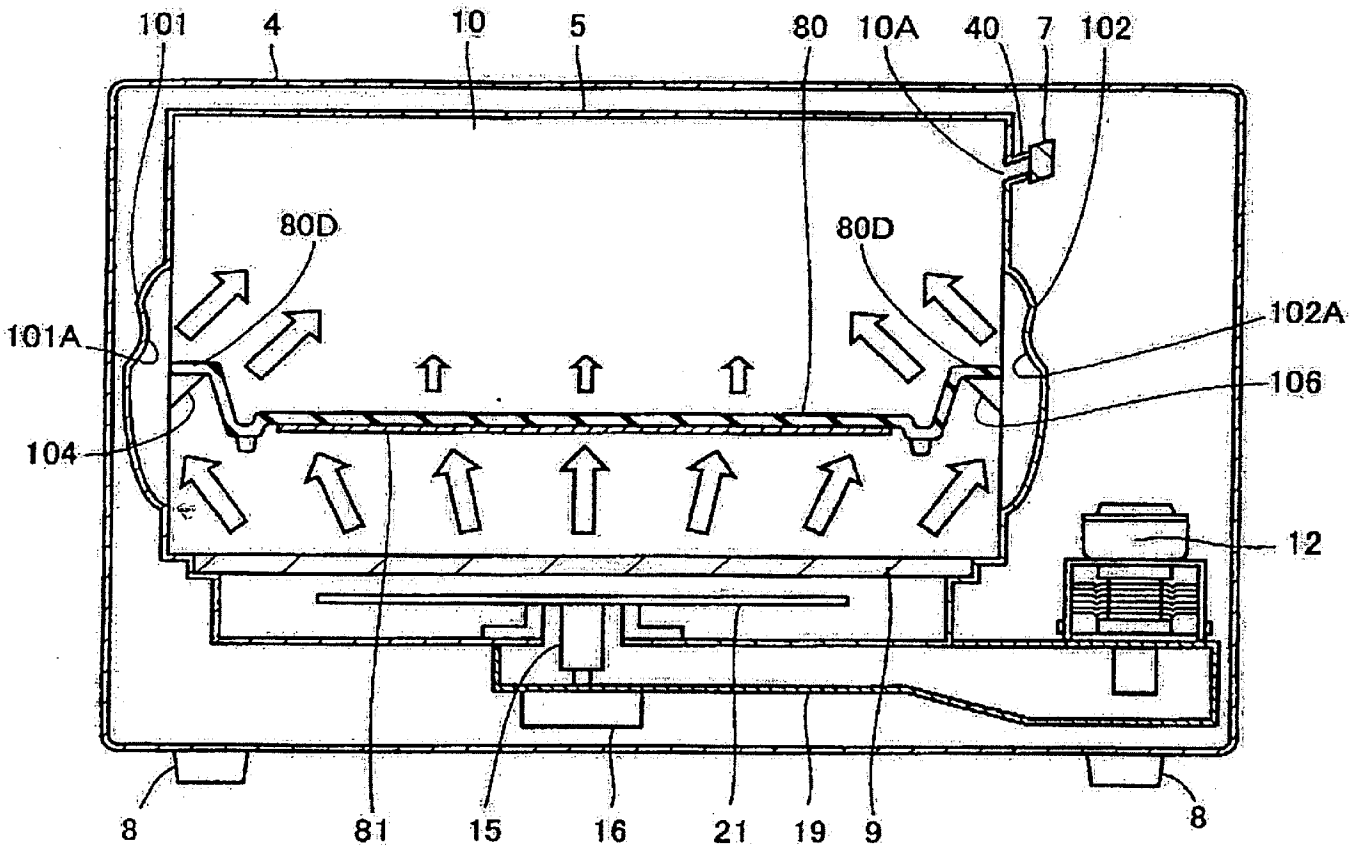
FIG. 8 is a cross-sectional view taken along the line VIII—VIII shown in FIG. 1.

FIG. 8 is a cross-sectional view of the inside of the microwave oven taken along line VIII—VIII shown in FIG. 1 with some components omitted from the drawing.

An infrared sensor 7 is mounted on one end of the detection passage member 40. The infrared sensor 7 senses infrared rays inside the heating chamber 10 via the hole 10A. A magnetron 12 is provided inside the outer shell 4 adjacent to the right bottom corner of the heating chamber 10. A waveguide 19 is provided at the bottom of the heating chamber 10 to connect the magnetron 12 to the bottom part of the main frame 5. A rotating antenna 21 is provided between the bottom part of the main frame 5 and the bottom plate 9. An antenna motor 16 is provided below the waveguide 19. The rotating antenna 21 is connected to the antenna motor 16 by a shaft 15. The antenna motor 16 drives the rotation of the rotating antenna 21.

The object to be heated, i.e., the food, is placed on the bottom plate 9, or on the oven broiling dish 80, in the heating chamber 10. The oven broiling dish 80 is positioned inside the heating chamber 10 with the periphery part 80D of the oven broiling dish 80 being supported by rails 103, 104, 106, 107.

The microwaves generated by the magnetron 12 are sent through the waveguide 19 and through the bottom of the heating chamber 10 while being agitated by the rotating antenna 21. Thus, the food in the heating chamber 10 is heated.

In FIG. 8, the flow of microwaves supplied to the heating chamber 10 is indicated by arrows. The size of the arrows graphically represents the intensity of the electric field of the microwaves. The microwaves supplied to the heating chamber 10 are absorbed by the microwave heating element 81 to heat the microwave heating element 81. The heat supplied from the microwave heating element 81 heats the food on the oven broiling dish 80. The flow of microwaves to the microwave heating element 81 is shown by large arrows below the microwave heating element 81 in FIG. 8.

The microwaves supplied to the heating chamber 10 reach areas above the oven broiling dish 80 by passing through the outer edge of the oven broiling dish 80 and through the gap between the oven broiling dish 80 and the walls of recessed areas 101, 102. Thus, the food on the oven broiling dish 80 is heated by directly supplying the microwaves to the food. The flow of microwaves directly supplied to the food is shown by large arrows above and below the outer edge of the oven broiling dish 80 in FIG. 8.

In the embodiment of the present invention described above, a passage is formed for sending the microwaves that are introduced into the heating chamber 10 from the waveguide 19 and into the area above the heating dish, i.e., the oven broiling dish 80. By sending the microwaves through the passage, the microwaves bypass the microwave heating element 81. The passage comprises a portion of the heating chamber below the oven broiling dish 80, the outer edge of the oven broiling dish 80 where the microwave heating element 81 is not present, (i.e., an area that includes the outer edge of bottom 80B, the outer periphery 80D, and the wall 80E), and the recessed areas 101, 102 of the heating chamber 10. Moreover, since the distance W shown in FIG. 5 is greater than $\lambda/4$, the dimension of the passage perpendicular to the traveling direction of the microwaves in the passage is greater than $\lambda/4$.

Furthermore, in FIG. 8, the portion of the microwaves that pass through the microwave heating element 81 without being converted into heat are marked by small arrows above the center of the oven broiling dish 80. Moreover, a grilling heater 51 (not shown in FIG. 8) is positioned above the heating chamber 10, and a lower heater 52 (not shown in FIG. 8) is positioned below the heating chamber 10.

Rails 103, 104 and rails 106, 107 are provided on the right and left surfaces of heating chamber 10, respectively, to support the oven broiling dish 80 from underneath. Rails 103, 104, 106, 107 are a plurality of members spaced apart from each other so that rails 103, 104 or rails 106, 107 provide space between the inner wall of the heating chamber 10 and the edge of the oven broiling dish 80. Therefore, it is easier to send microwaves to areas above the oven broiling dish 80 compared to a microwave oven 1 having continuous line rails extending from the proximate side to the distal side of the heating chamber 10.

Microwave diffusing protrusions 101A, 102A are provided in recessed areas 101, 102, respectively. Protrusions 101A, 102A diffuse the microwaves that pass through recessed areas 101, 102 to areas above the oven broiling dish 80.

2. Electrical Circuitry of the Microwave Oven

Figure 9:
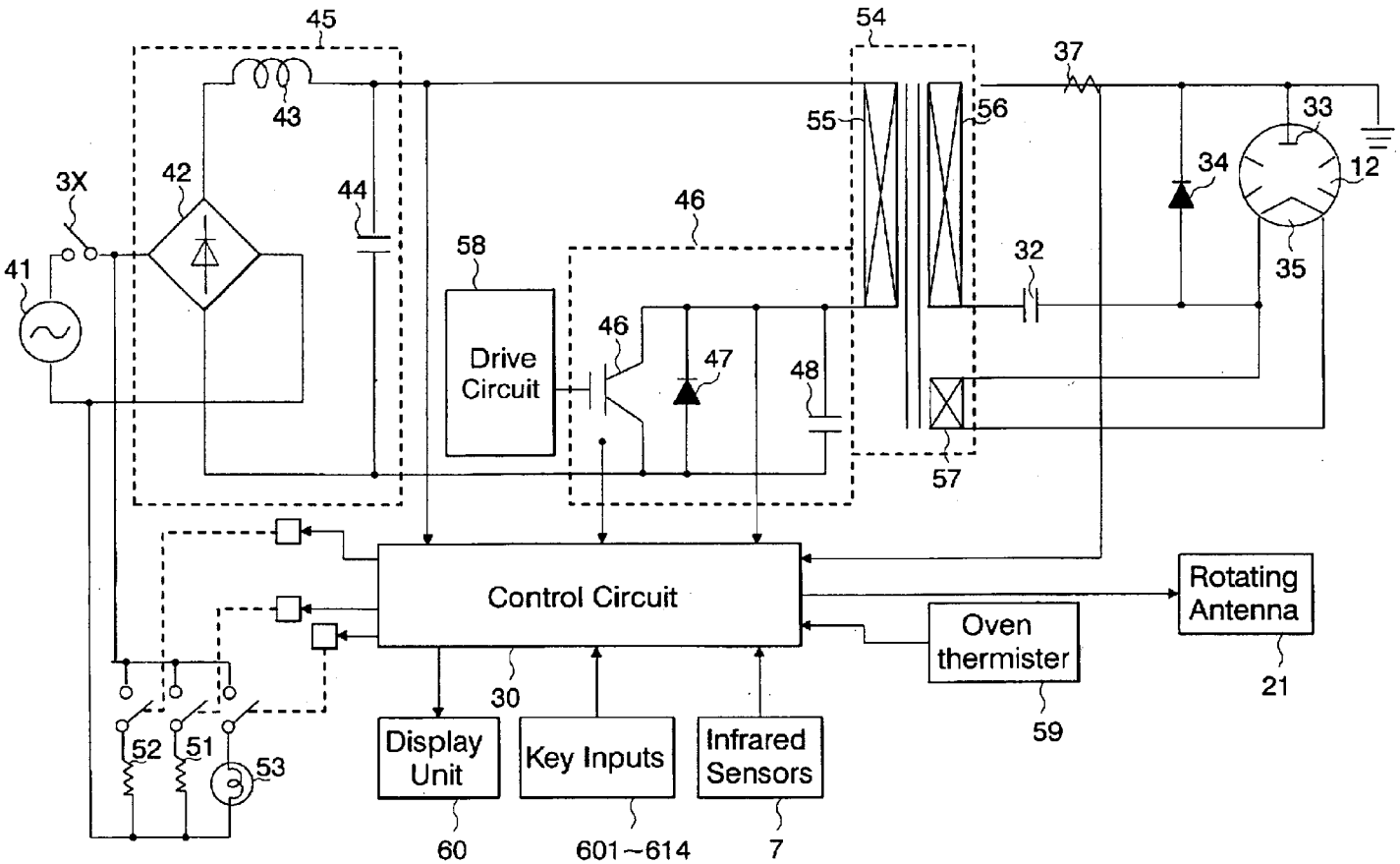
FIG. 9 is a schematic diagram of the electrical circuitry of a microwave oven according to the present invention.

FIG. 9 is a schematic drawing of the electrical circuitry of the microwave oven 1. The microwave oven 1 has a control circuit 30 that generally controls the operation of the microwave oven 1. The control circuit 30 includes a microcomputer.

In the microwave oven 1, the AC voltage from an external commercial power source 41 is rectified by a rectifying bridge 42 and converted into a DC voltage by a choke coil 43 and a smoothing capacitor 44. The rectifying bridge 42, the choke coil 43, and the smoothing capacitor 44 comprise a rectifying device 45 that rectifies the AC voltage of the commercial power source 41.

A switching device 46 having an IGBT (insulator gate bipolar transistor) is connected in parallel to a free wheel diode 47 and a resonance capacitor 48 between the collector and emitter of the switching device 46 to comprise a resonance type switching circuit. A microwave transformer 54 has a primary winding 55, a secondary winding 56, and a heater winding 57. An input DC voltage is supplied to the collector of the switching device 46 via the primary winding 55 of the microwave transformer 54. The switching device 46 is turned on and off by a drive signal from a drive circuit 58 to create cycles in which the input DC voltage is converted into microwaves. The switching device 46, the free wheel diode 47, and the resonance capacitor 48 comprise a frequency converter 49. The control circuit 30 controls the drive timing of the switching device 46 using the drive circuit 58.

The secondary winding 56 of the microwave transformer 54 is connected to a voltage doubler rectifying circuit comprising a voltage doubler capacitor 32 and a voltage doubler rectifying diode 34. A microwave voltage generated on the secondary winding 56 of the microwave transformer 54 is rectified by the voltage doubler rectifying circuit to produce a DC high voltage. The voltage doubler rectifying circuit has a drive power source which supplies anode power between an anode 33 of a magnetron 12 and a cathode 35. The cathode 35 is also a heater for heating the magnetron 12. The current supplied to the magnetron 12 is detected by a current transformer 37 which sends a detection signal to the control circuit 30. The side of the magnetron 12 near the anode 33 is grounded, and the heater voltage from the heater winding 57 is supplied to the cathode 35 of the magnetron 12.

A door switch 3X is located on the microwave oven 1. The door switch 3X opens the circuit shown in FIG. 9 when the door 3 is open and closes the circuit shown in FIG. 9 when the door 3 is closed. Thus, the power supply from the commercial power source 41 to the magnetron 12 stops when the door 3 is open. The ability of the door switch 3X to open and close the circuit shown in FIG. 9 prevents the magnetron 12 from generating microwaves while the door 3 is open. Furthermore, the microwave oven 1 has a chamber light 53, which illuminates the inside of the heating chamber 10 and an oven thermistor 59 for detecting the temperature inside the heating chamber 10. The control circuit 30 receives operation commands from several key inputs 601–614, which are the adjusting knob 608 and other keys on the operation panel 6, and from detection outputs of the infrared sensor 7 and the oven thermistor 59. With the operation commands, the control circuit 30 controls the rotating motion of the rotating antenna 21 and the display contents of the display unit 60. The control circuit 30 also controls the operation of the grilling heater 51, the lower heater 52, and the chamber light 53 by driving relays appropriately.

3. Variations of the Heating Chamber of the Microwave Oven

Figure 10:
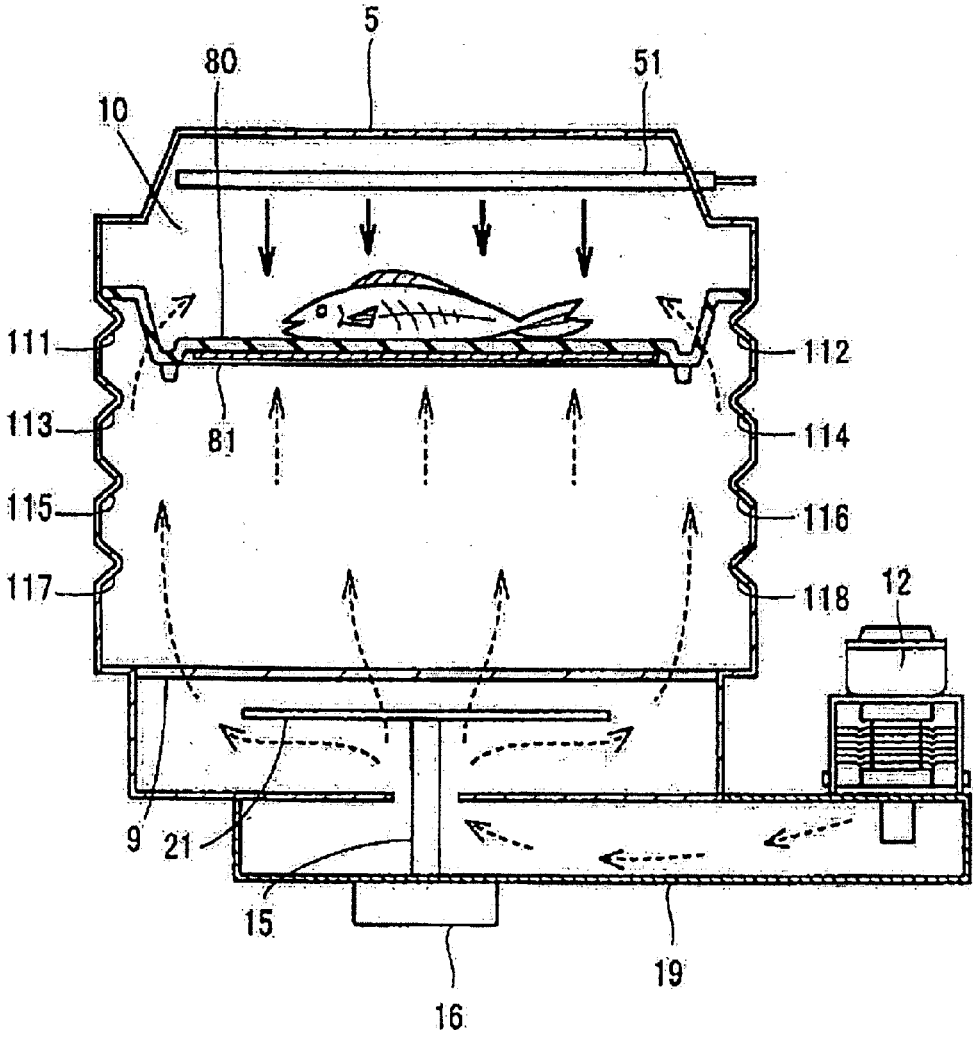
FIG. 10 is a cross-sectional view taken along the line VIII—VIII shown in FIG. 1 of the heating chamber of the microwave oven according to an embodiment of the present invention.

FIG. 10 shows the heating chamber 10 of the microwave oven 1 according to an embodiment of the present invention. In particular, FIG. 10 shows an embodiment of the main frame 5 and its adjacent parts shown in FIG. 8. However, the main difference between this embodiment and the embodiment shown in FIG. 8 is that the embodiment in FIG. 20 has four steps of rails in the heating chamber 10 for the oven broiling dish 80. Each step of rails comprise a pair of rails, i.e., rails 111, 112, rails 113, 114, rails 115, 116, and rails 117, 118, in order from top to bottom.

FIG. 10 shows four steps of rails in the heating chamber 10. The outer periphery 80D of the oven broiling dish 80 abuts the top-level rails 111, 112, located at the highest attainable position in the heating chamber 10.

FIG. 10 also shows the grilling heater 51 positioned at the top of the heating chamber 10. The heat emitted by the grilling heater 51 is shown as solid-lined arrows, and microwaves generated by the magnetron 12 are shown in broken-lined arrows. Similar to the embodiment of the present invention shown in FIG. 8, the microwaves supplied from the bottom of the heating chamber 10 are absorbed by the microwave heating element 81, while a portion of the microwaves are guided to areas above the oven broiling dish 80 through the outer edge of the oven broiling dish 80.

In the embodiment shown in FIG. 10, the surface of the food placed on the oven broiling dish 80 is heated by the microwave heating element 81 while the inside of the food is heated as it absorbs the microwaves directly and further browned by being heated by the grilling heater 51.

Figure 11:
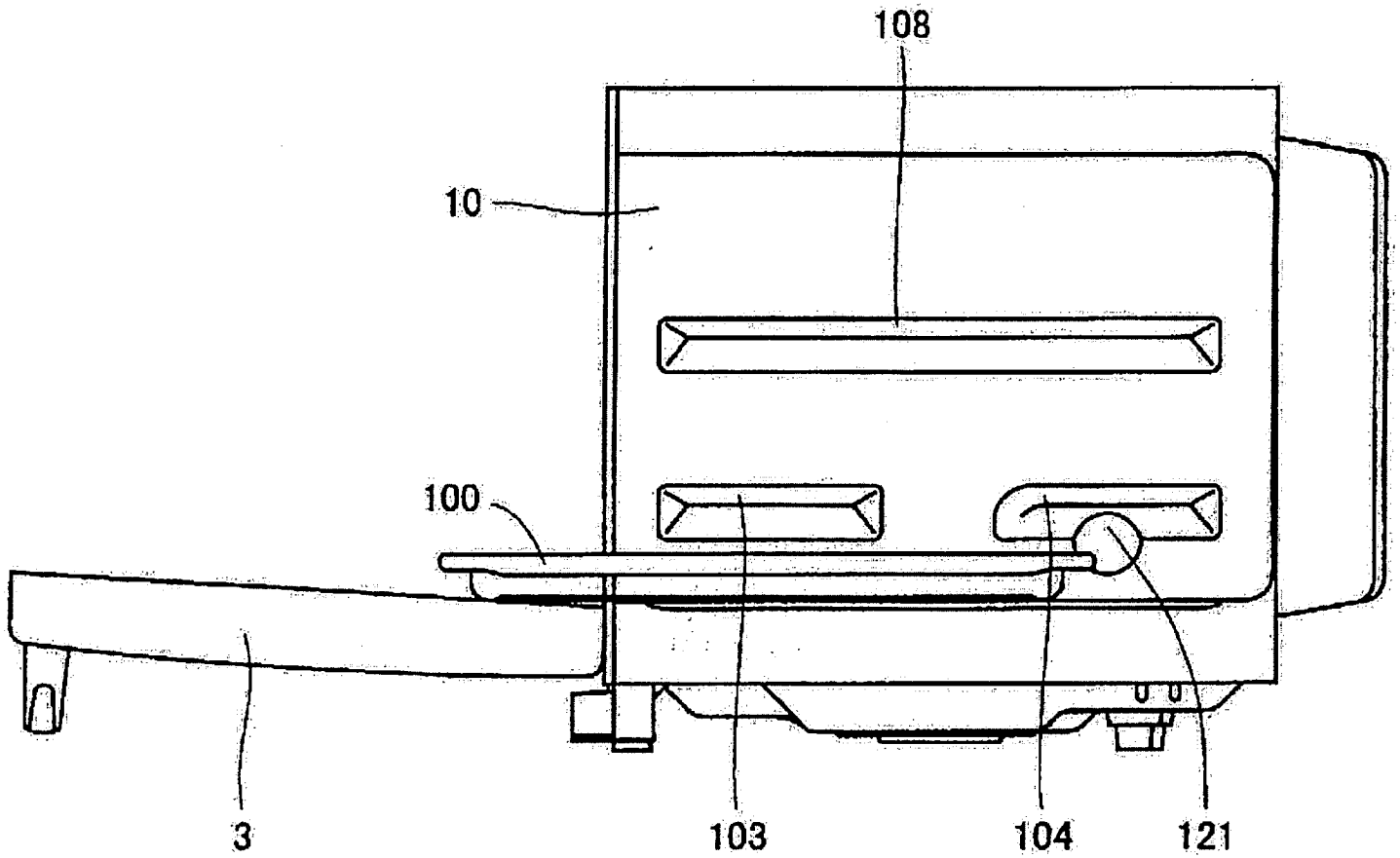
FIG. 11 is a right side view of the heating chamber of the microwave oven according to an embodiment of the present invention.

FIG. 11 shows an embodiment of the heating chamber 10 of the microwave oven 1 according to the present invention. FIG. 11 is a right side view of the microwave oven 1 that shows the relation between position of the inside of the heating chamber 10 and the position of the door 3. The right side of the main body 2 is not shown in FIG. 11.

Figure 25:
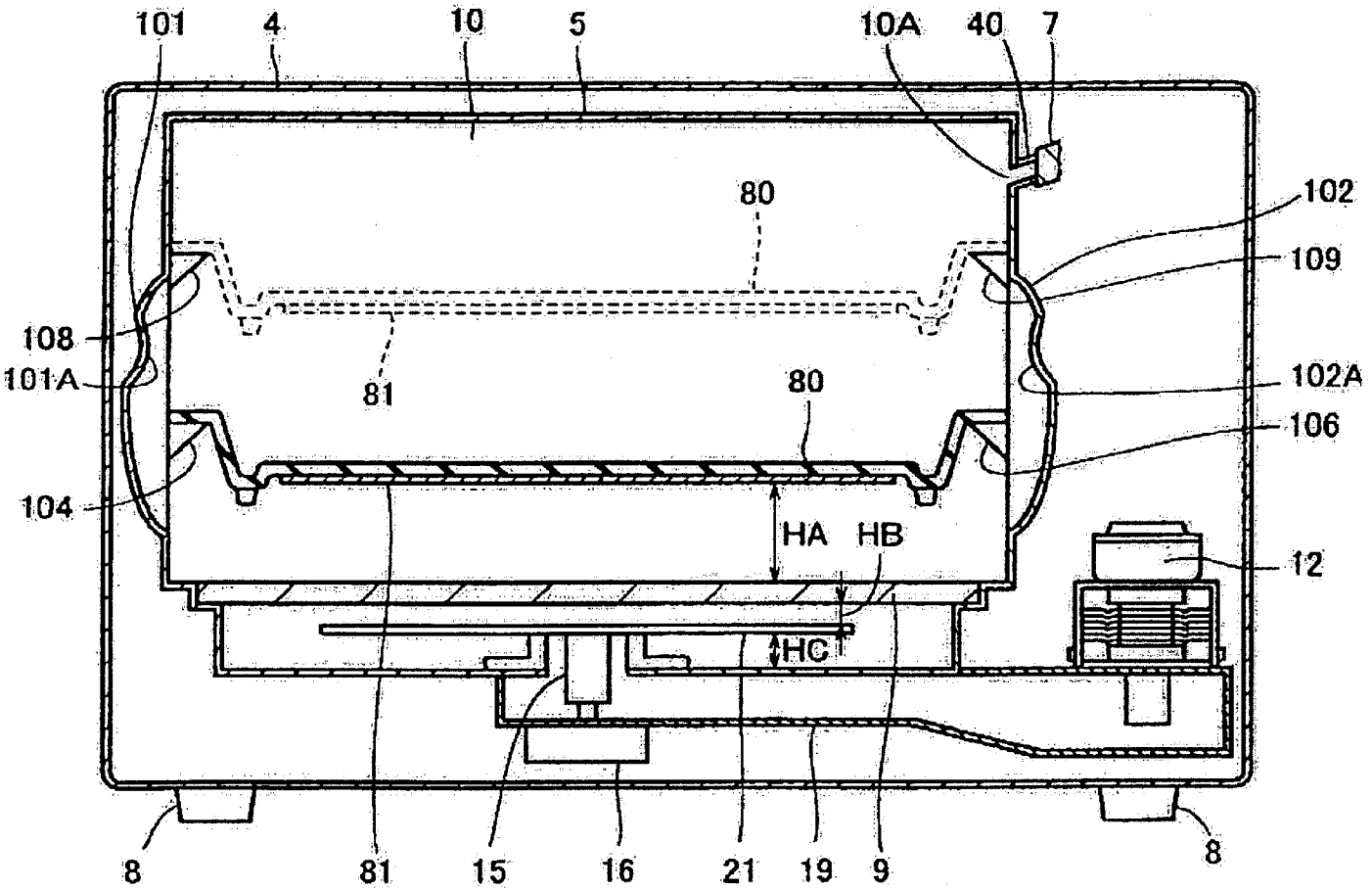
FIG. 25 is a cross-sectional view taken along the line VIII—VIII shown in FIG. 1 of the heating chamber of the microwave oven according to an embodiment of the present invention.

Rail 108 is positioned above rails 103, 104 on the wall of the heating chamber 10 as shown in FIG. 11. Although it is not shown in FIG. 11, a rail 109, which is similar to rail 109 of FIG. 25, is formed on the wall of the heating chamber 10 and positioned opposite to rail 108. The oven broiling dish 80 can be supported by rail 108 and rail 109 in the heating chamber 10. Also, in the embodiment shown in FIG. 11, a protruding part 121 is positioned below and near the center of rail 104 in the heating chamber 10. A protruding part 122, as shown in FIGS. 12 and 13, is formed on the wall of the heating chamber 10 positioned opposite to the protruding part 121 although it is not shown in FIG. 11.

Sometimes a metallic dish, such as an enameled metal dish 100, is used in the heating chamber. Protruding parts 121, 122 stop the magnetron 12 from generating microwaves when a metallic dish is placed at locations in the heating chamber 10 where the oven broiling dish 80 can be placed but where a metallic dish cannot be placed when the magnetron 12 is generating microwaves. In the embodiment shown in FIG. 12, one of such locations is above the bottom plate 9 and close, i.e., within 1 cm, to the bottom plate 9. When microwaves are supplied to the heating chamber 10 via a rotating antenna 21 in the heating chamber 10 while the enameled metal dish 100 is placed close to the bottom plate 9, electric discharges may occur between the rotating antenna 21 and the enameled metal dish 100, which is dangerous.

The enameled metal dish 100 is a dish that holds food for the purpose of oven cooking only with the heaters, i.e., the grilling heater 51 and the lower heater 52. The enameled metal dish 100 is made of an enameled sheet metal.

Figure 12:
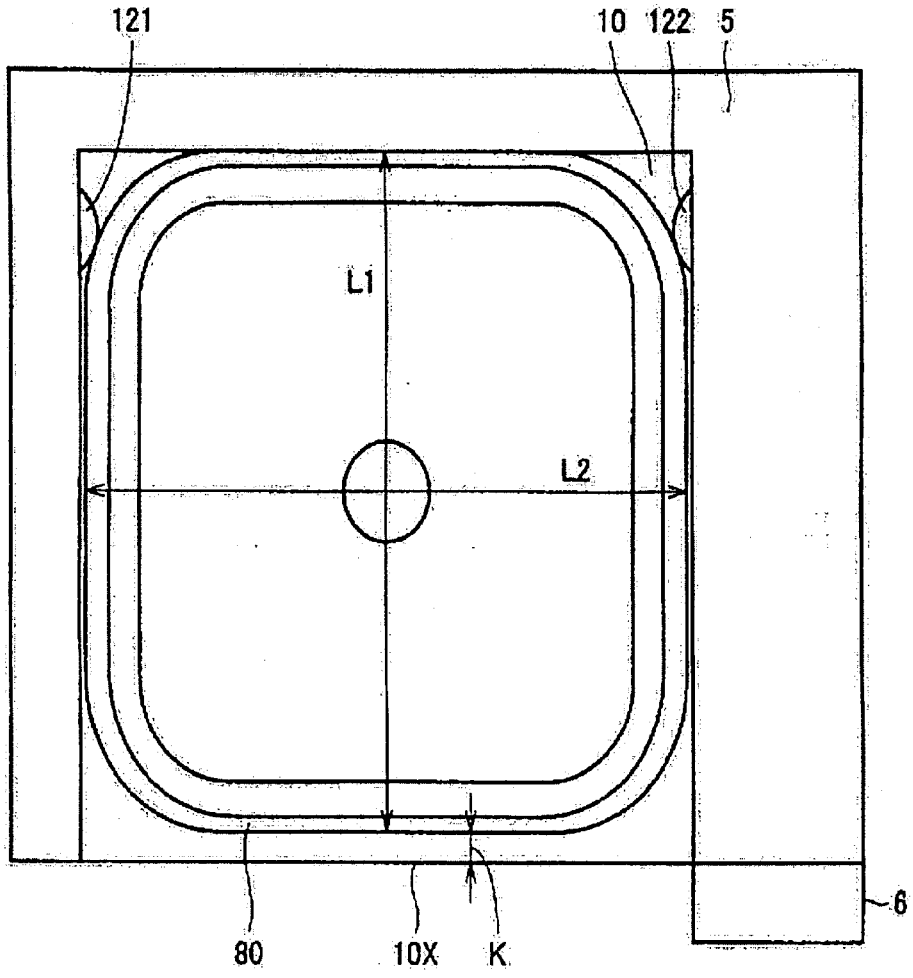
FIG. 12 is a cross-sectional view of the main body of the microwave oven according to the embodiment shown in FIG. 11 taken at a height where protruding parts exist.
Figure 13:
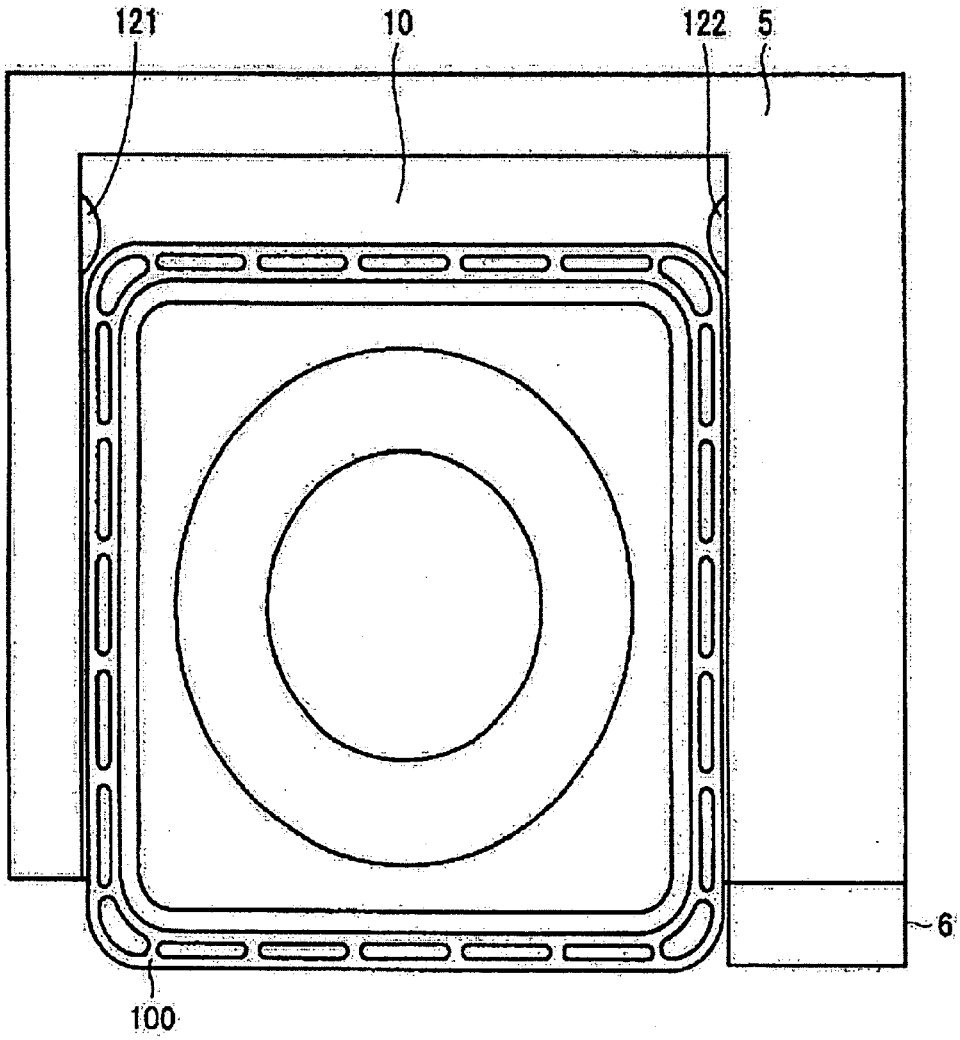
FIG. 13 is a cross-sectional view of the main body of the microwave oven according to the embodiment shown in FIG. 11 taken at a height where protruding parts exist.

FIGS. 12 and 13 are cross-sectional drawings of the microwave oven 1 shown in FIG. 1 taken at the height of protruding parts 121, 122.

In FIG. 12, the oven broiling dish 80 is placed on the bottom plate 9 in the heating chamber 10, and protruding parts 121, 122 are located between the respective corners of the oven broiling dish 80 and the walls of the heating chamber 10. In other words, the oven broiling dish 80 can be placed in the heating chamber 10 at the same height as the height of protruding parts 121, 122.

In contrast, if the enameled metal dish 100 is placed on the bottom plate 9 as shown in FIG. 13, the enameled metal dish 100 cannot advance any further into the heating chamber 10 since the corners of the enameled metal dish 100 abut protruding parts 121, 122. In other words, the enameled metal dish 80 cannot be placed in the heating chamber 10 at the height of protruding parts 121, 122. If the enameled metal dish 80 is placed at the height of protruding parts 121, 122, the door 3 cannot be closed because the enameled metal dish 100 sticks out as shown in FIG. 11. When the door 3 is not closed, the door switch 3X opens the circuit shown in FIG. 9, thereby preventing the magnetron 12 from generating microwaves.

In the embodiment shown in FIGS. 11-13, the protruding parts 121, 122 and the shapes of the corners of the oven broiling dish 80 and the enameled metal dish 100 prevent the enameled metal dish 100 from being placed in the heating chamber 10 at the same height as protruding parts 121, 122. However, the oven broiling dish 80 can be placed in the heating chamber at the same height as protruding parts 121, 122. Moreover, the oven broiling dish 80 can be placed at any height in the heating chamber 10 without being prevented by protruding parts 121, 122 from being fully stored as for the enameled metal dish 100 shown in FIG. 11.

Furthermore, the oven broiling dish 80 stored in the heating chamber 10 has a dimension L1 in the depth direction and a dimension L2 (>L1) in the width direction as shown in FIG. 12. The oven broiling dish 80 also leaves a gap of a distance K to the front part 10X of the heating chamber 10. Therefore, when the door 3 is closed while the oven broiling dish 80 is stored in the heating chamber 10, there is a gap between the oven broiling dish 80 and the door 3 which is greater than the distance K. Therefore, air and microwaves beneath the oven broiling dish 80 can be sent to areas above the oven broiling dish 80 when the door 3 is closed.

In the embodiment shown in FIGS. 11-13, the formation of protruding parts 121, 122 create a position in the heating chamber 10 where the oven broiling dish 80 can be placed but the enameled metal dish 100 cannot be placed when microwaves are generated by the magnetron 12. Additionally, the heating chamber 10 can prevent the magnetron 12 from generating microwaves when the oven broiling dish 80 is placed at an undesirable position, and this embodiment of the present invention is shown in FIGS. 14-16.

Figure 14:
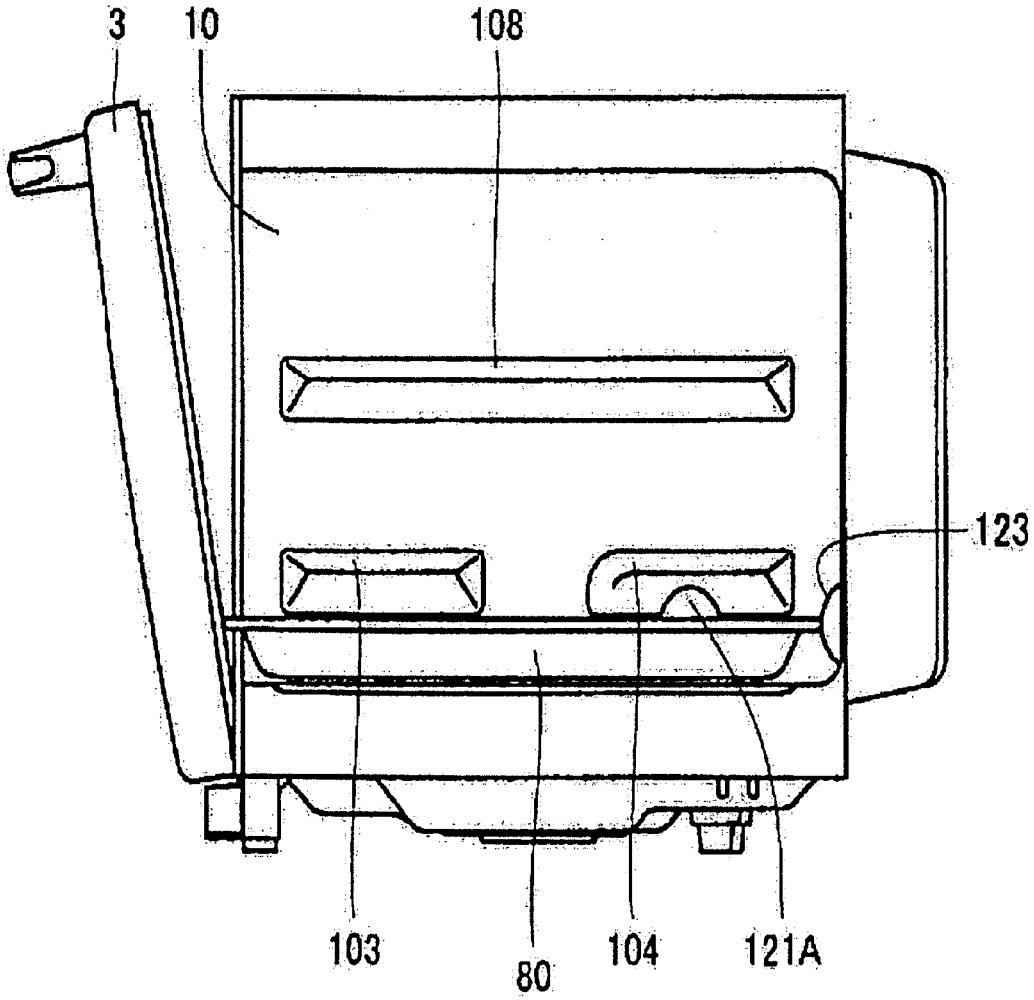
FIG. 14 is a right side view of the inside of the heating chamber of the microwave oven shown according to an embodiment of the present invention.

FIG. 14 is a right side view of the microwave oven 1 in which some components are not shown. Protruding parts 121, 122 of the embodiment shown in FIG. 12 are moved forward in the heating chamber 10 to become protruding parts 121A, 122A as shown in FIG. 15. FIGS. 15 and 16 are cross-sectional drawings of the main body 2 of the microwave oven 1 shown in FIG. 14 taken at a height of protruding parts 121A, 122A.

Figure 15:
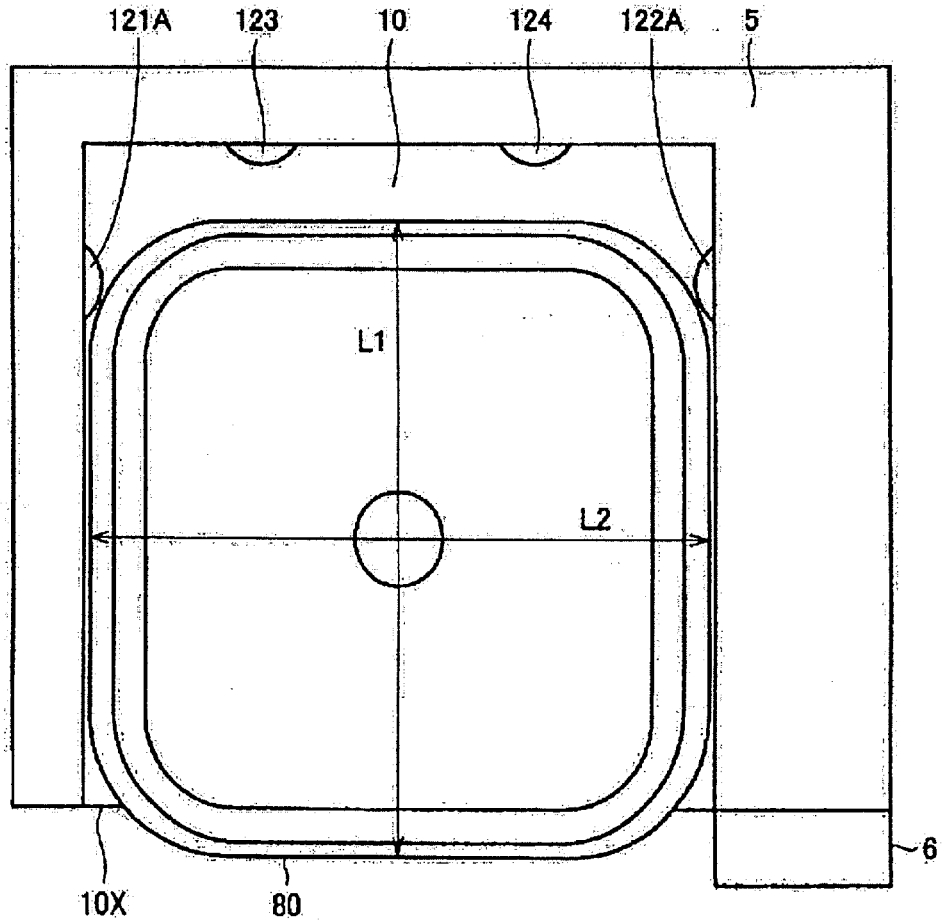
FIG. 15 is a cross-sectional view of the main body of the microwave oven according to the embodiment shown in FIG. 14 taken at a height where protruding parts exist.
Figure 16:
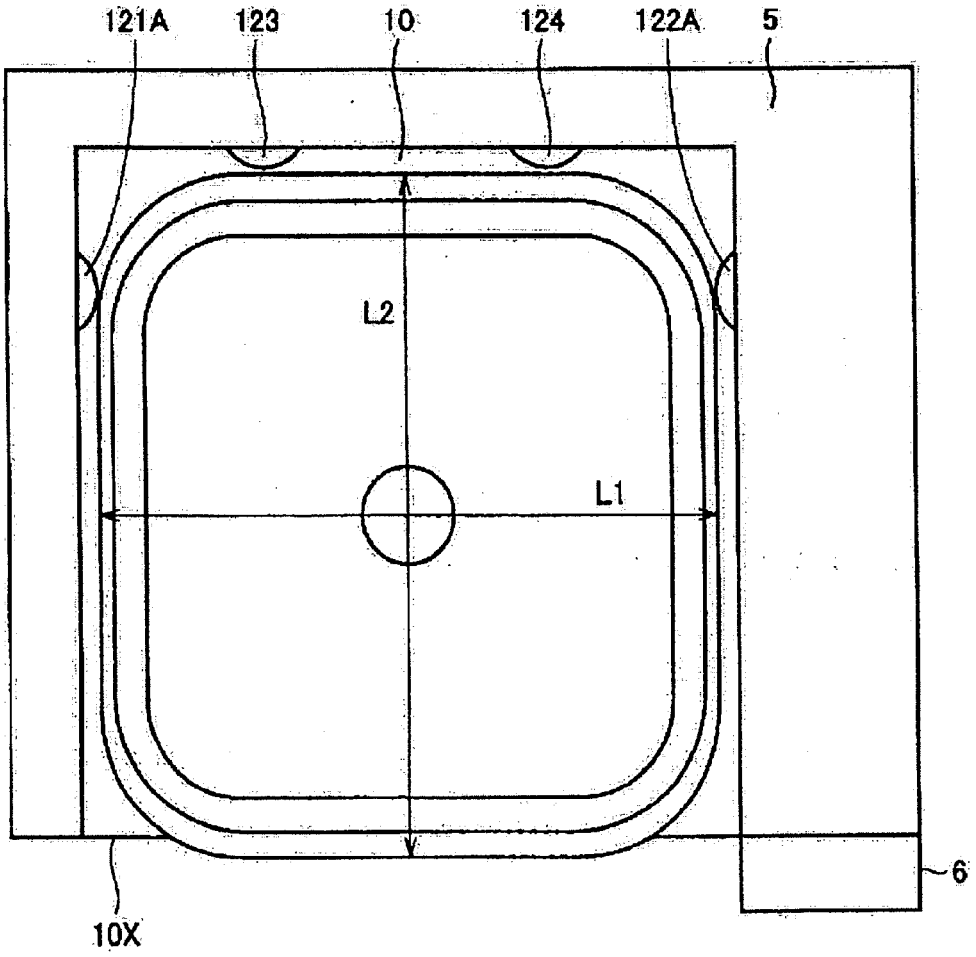
FIG. 16 is a cross-sectional view of the main body of the microwave oven according to the embodiment shown in FIG. 14 taken at a height where protruding parts exist.

In FIG. 15, as protruding parts 121A, 122A are located toward the front from protruding parts 121, 122 (as shown in FIG. 12) in the heating chamber 10. Thus, the oven broiling dish 80 cannot be pushed back into the full depth of the heating chamber 10 since the movement of the oven broiling dish 80 is blocked by the protruding parts 121A, 122A. The oven broiling dish 80 is blocked and the door 3 is prevented from closing, when the oven broiling dish 80 is attempted to be installed at the height of protruding parts 121A, 122A. In the embodiment shown in FIGS. 14-16, the enameled metal dish 100 also cannot be installed in the heating chamber 10 since it is blocked by protruding parts 121A, 122A which prevents the door 3 from closing, when it is attempted to be installed at the same height as protruding parts 121A, 122A As shown in FIG. 16, the oven broiling dish 80 can be installed in the heating chamber 10 without abutting against protruding parts 121A, 122A by rotating the oven broiling dish 80 90° from the position shown in FIG. 15 since L1<L2. Therefore, protruding parts 123, 124 are positioned on the back surface of the heating chamber 10 for such a case. Therefore, the door 3 can be prevented from closing, thereby preventing the microwaves from being supplied to the heating chamber 10, when the oven broiling dish 80 is attempted to be installed at an undesirable height.

The depth dimension of the heating chamber 10 is "L1 +K" as shown in FIG. 12. Therefore, protruding parts 123, 124 must protrude from the back surface of the heating chamber 10 by an amount greater than "L1 +K−L2" in order to prevent the door 3 from closing when the oven broiling dish 80 is placed in the heating chamber 10 as shown in FIG. 16.

Figure 17:
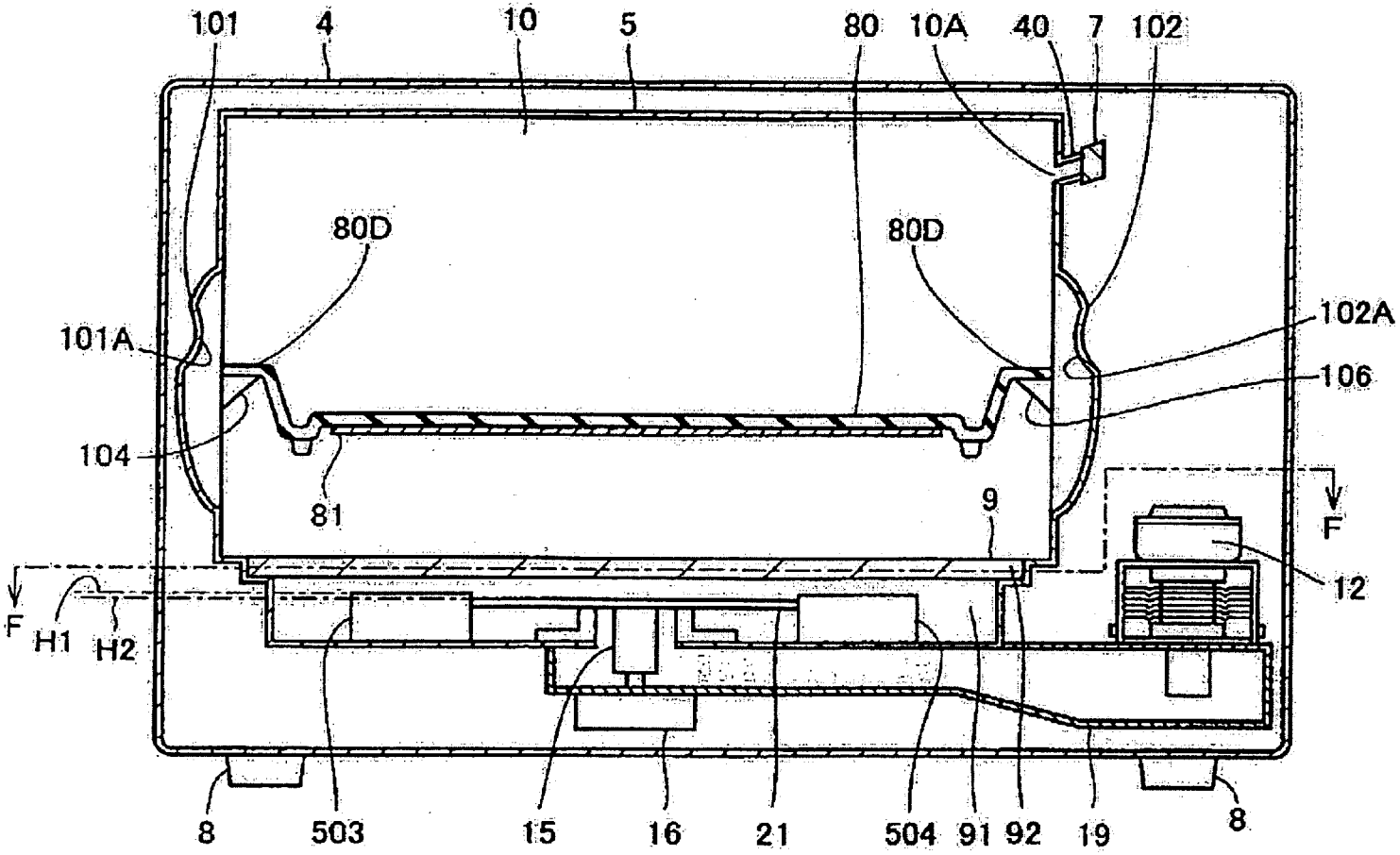
FIG. 17 is a cross-sectional view taken along the line VIII—VIII shown in FIG. 1 of the heating chamber of the microwave oven according to an embodiment of the present invention.

Reflection plates 501–504 (see FIG. 19 for reflection plates 501, 502) are provided on the outer periphery of the rotating antenna 21 as shown in FIG. 17 in an embodiment of the present invention. FIG. 17 is a cross-sectional drawing comparable to the cross-sectional drawings of FIGS. 18A and 18B.

In the embodiment shown in FIG. 17, as described later in more detail, reflection plates 501–504 on the outer periphery of the rotating antenna 21 suppress the microwaves supplied to the heating chamber 10 via the rotating antenna 21 from flowing near the walls of the heating chamber 10. Thus, the microwaves are absorbed more efficiently by the microwave heating element 81, thereby reducing the fluctuation of heat over the oven broiling dish 80 as shown in FIGS. 18A and 18B.

Figure 18A:
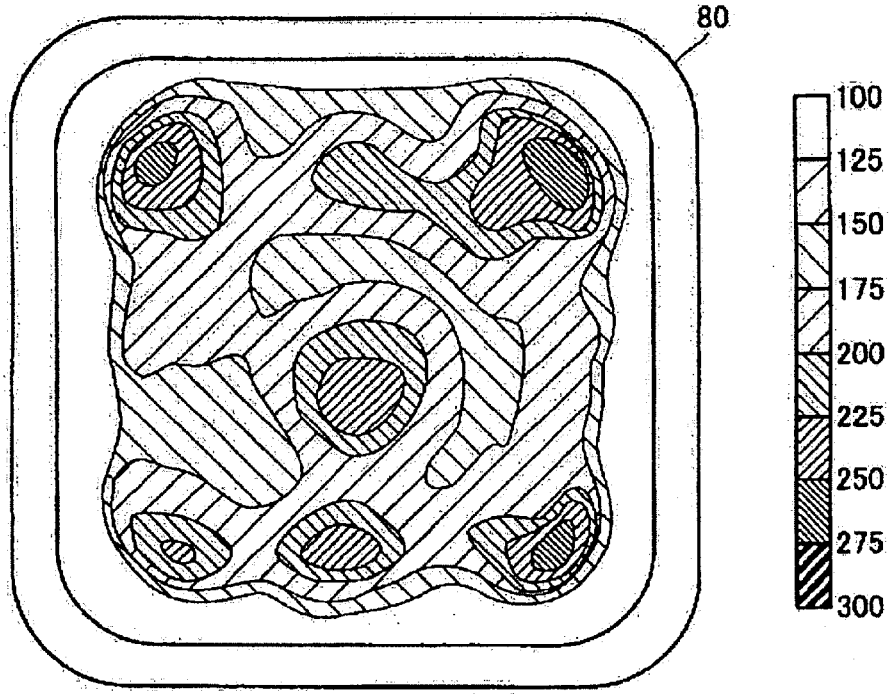
FIGS. 18A and 18B are temperature distribution diagrams of the oven broiling dish according to the embodiment shown in FIG. 17.
Figure 18B:
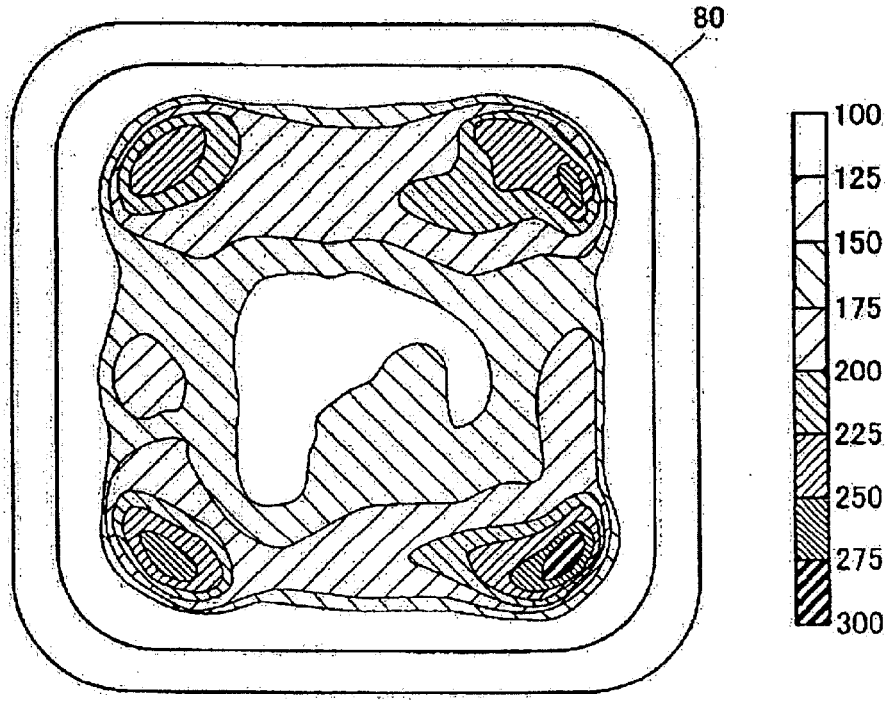

FIGS. 18A and 18B are temperature distribution diagrams of the oven broiling dish 80 after the magnetron 12 has generated microwaves for three minutes. FIG. 18A shows an oven broiling dish 80 when reflection plates 501–504 are included on the outer periphery of the rotating antenna 21, and FIG. 18B shows an oven broiling plate 80 when reflection plates 501–504 are not included.

In FIG. 18B, the reflection plates 501–504 are not included on the outer periphery of the rotating antenna 21. Although there are areas at the four corners of the oven broiling dish 80 where the temperatures are as high as 300° C., the areas near the center of the oven broiling dish 80 barely reach 100° C. However, in FIG. 18A, although there are high temperature spots at the center and at the four corners of the oven broiling dish 80, almost all of the oven broiling dish 80 is heated above 150° C., with many areas reaching above 175° C. Thus, the fluctuation of heat of the oven broiling dish 80 can be eliminated by providing reflection plates 501–504.

Figure 19:
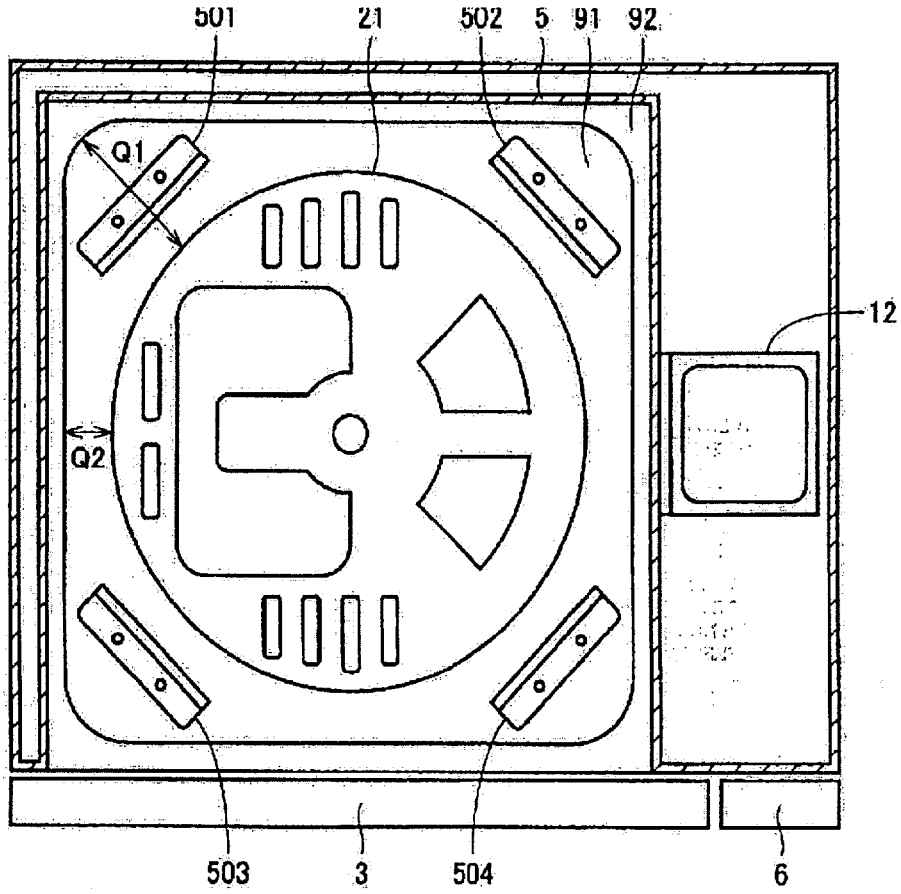
FIG. 19 is a cross-sectional view taken along the line F—F of FIG. 17.
Figure 20:
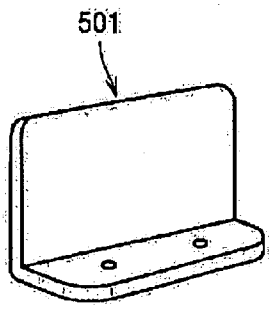
FIG. 20 is a perspective drawing of a reflection plate according to the embodiment shown in FIG. 17.

Next, the structure of reflection plates 501–504 is shown in FIGS. 19 and 20. FIG. 19 is a cross-sectional drawing taken along the line F—F on FIG. 17, and FIG. 20 is a perspective view of reflection plate 501.

A bottom plate holding area 92 for holding the bottom plate 9 is positioned at the bottom of the heating chamber 10, and an antenna enclosure 91 housing the rotating antenna 21 is positioned below the bottom plate holding area 92. The shape of walls surfaces of the antenna enclosure 91, which intersects the traveling direction of the microwaves, has a rectangular shape with rounded corners as shown in FIG. 19.

Reflection plate 501, as shown in FIG. 20, has a L-shaped cross section, and reflection plates 502–504 have the same structure as reflection plate 501. Reflection plates 501–504 are made of a material that reflects microwaves. Reflection plates 501–504 can also be made by coating a material that reflects microwaves.

Reflection plates 501–504 are placed between the rounded corner areas of the rectangular shape of the antenna enclosure 91 and the rotating antenna 21. Reflection plates 501–504 can be placed where the distance between the outer edge of the rotating antenna 21 and the walls of the antenna enclosure 91 is the longest. One of the longest distances between the outer edge of the rotating antenna 21 and the walls of the antenna enclosure 91 is Q1 shown in FIG. 19; and one of the shortest distances is Q2 shown in FIG. 19. Placing reflection plates 501–504 as described above makes it possible to prevent the microwaves supplied to the heating chamber 10 via the rotating antenna 21 from diffusing into areas near the walls of the heating chamber 10, thereby suppressing the fluctuation of heat over the oven broiling dish 80 by suppressing the supply of more microwaves to the areas near the walls of the heating chamber 10.

Reflection plates 501–504 extend further than the rotating antenna 21 in the traveling direction of the microwaves. More specifically, in FIG. 17, the traveling direction of the microwaves is upward, the height of reflection plates 501–504 is H1, and the height of the rotating antenna 21 is H2 (<H1). Thus, reflection plates 501–504 extend higher than the rotating antenna 21. Thus, reflecting plate 501 can prevent the microwaves, which are guided into heating chamber 21 via the rotating antenna 21, from diverting laterally and can guide the microwaves upward.

Figure 21:
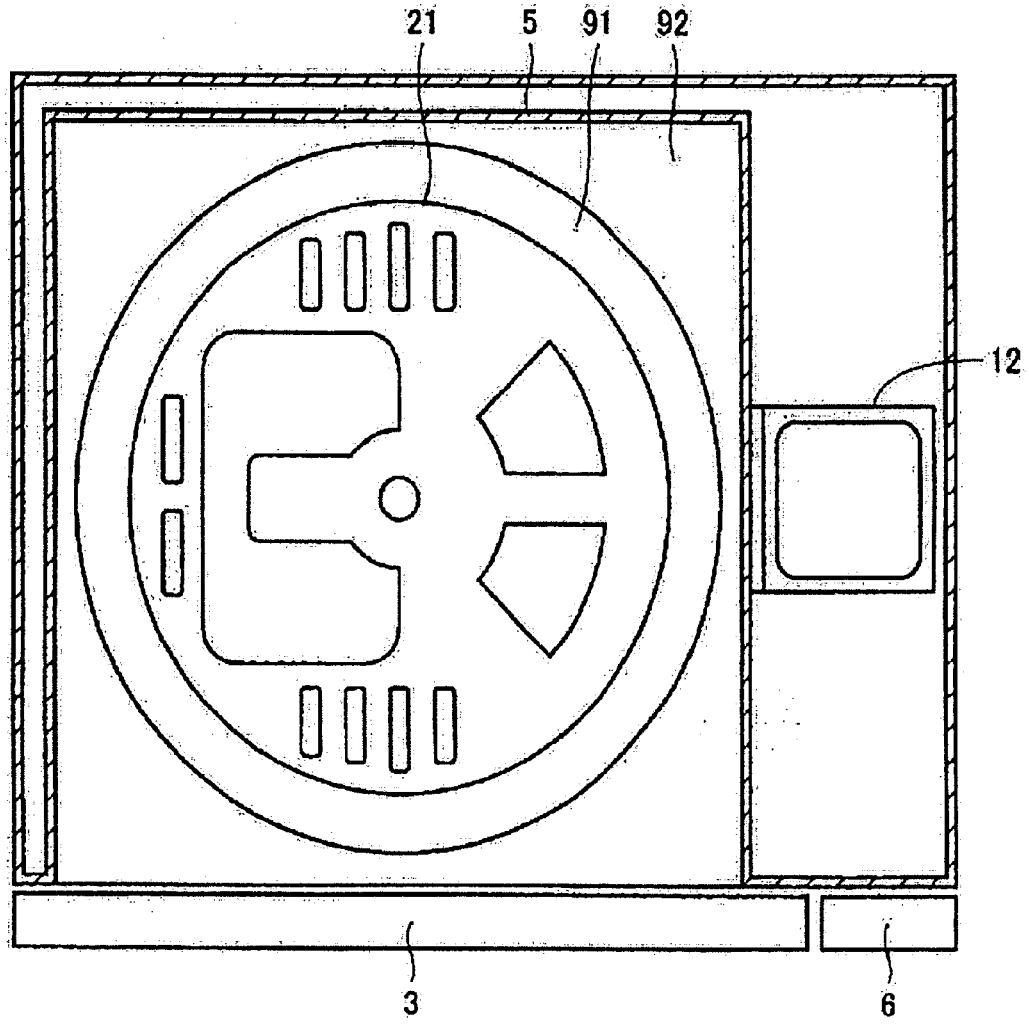
FIG. 21 is a cross-sectional view taken along the line F—F of FIG. 17 according to an embodiment of the present invention.
Figure 22:
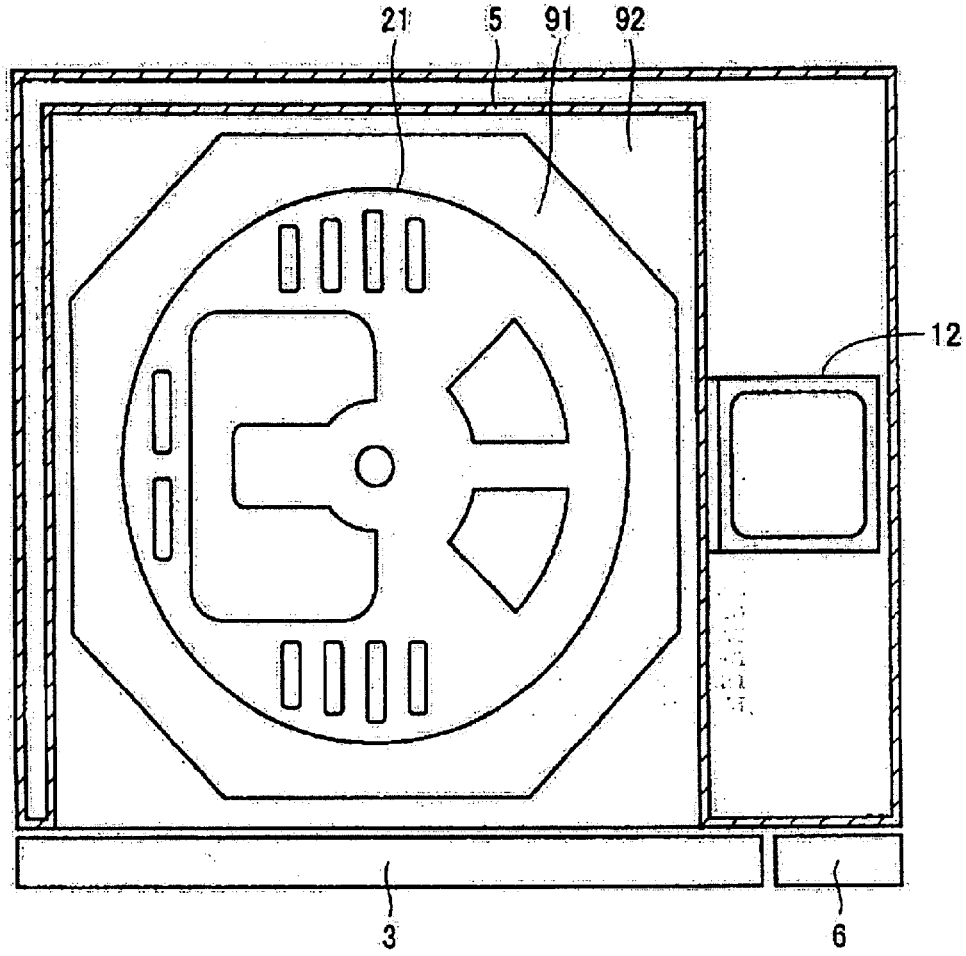
FIG. 22 is a cross-sectional view taken along the line F—F of FIG. 17 according to an embodiment of the present invention.

Alternatively, the walls of the antenna enclosure 91 can be structured as shown in FIGS. 21 and 22 rather than including reflection plates 501–504.

In FIG. 21, the cross section of the antenna enclosure 91 is circular. In FIG. 22, the cross section of the antenna enclosure 91 is polygonal, i.e., octagonal. Since the cross section of the antenna enclosure 91 is circular or polygonal, the distance between the edge of the rotating antenna 21 and the walls of the antenna enclosure 91 can be minimized and more of the microwaves supplied by the rotating antenna 21 can be prevented from moving toward the walls of the heating chamber 10.

Figure 23:
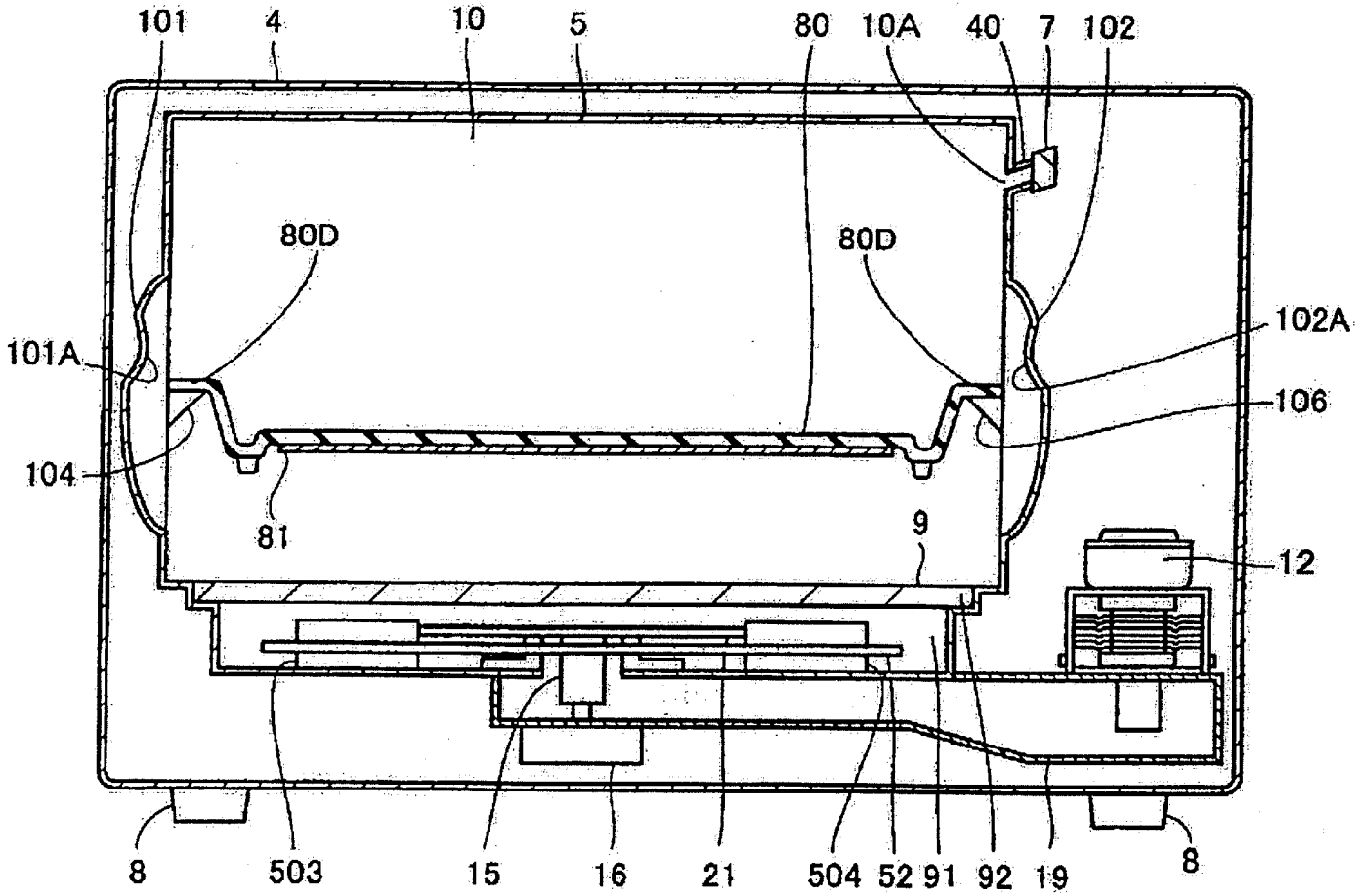
FIG. 23 is a cross-sectional view taken along the line F—F of FIG. 17 according to an embodiment of the present invention.
Figure 24:
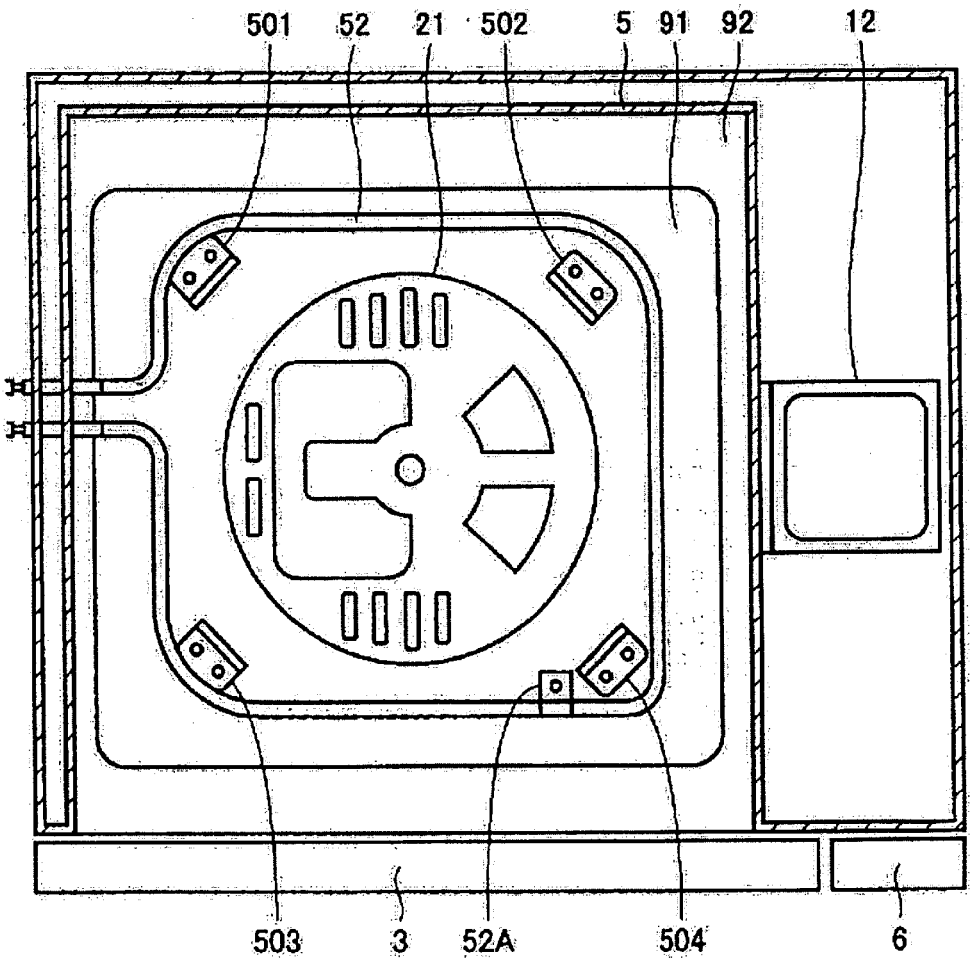
FIG. 24 is a cross-sectional view taken along the line F—F of FIG. 17 according to an embodiment of the present invention.

FIGS. 23 and 24 show an embodiment of the present invention in which, in addition to reflection plates 501–504, the lower heater 52 surrounds the rotating antenna 21 as shown in FIGS. 23 and 24. The lower heater 52 is affixed by an affixing member 52A in the antenna enclosure 91.

As shown in FIGS. 23 and 24, reflection plates 501–504 are located outside of the rotating antenna 21 and inside the lower heater 52. Thus, the microwaves supplied to the heating chamber 10 via the rotating antenna 21 in areas where reflection plates 501–504 are provided are sent upward by reflection plates 501–504 before being diffused by the lower heater 52. Therefore, the microwaves can be sent accurately to the desired direction.

The heating mode can be made dependent on the height of the oven broiling dish 80 in heating chamber 10 when the height of the oven broiling dish 80 is adjustable.

FIG. 25 shows an embodiment of the present invention in which the oven broiling dish 80 can be installed at two different heights in the heating chamber 10 of the microwave oven 1.

Rails 108, 109 are provided above rails 103, 104, 106, 107 in order to support the oven broiling dish 80 in the heating chamber 10. Rail 109 is symmetric to rail 108, which is the same as rail 108 shown in FIG. 11. The oven broiling dish 80 is supported by rails 103, 104, 106, 107 as indicated by solid lines in FIG. 25 when installed on the lower level, or the oven broiling dish 80 is supported by rails 108, 109 as indicated by dotted lines in FIG. 25 when installed on the upper level of the heating chamber 10. Dimension HC in FIG. 25 is 15 mm and is the distance from the bottom surface of the antenna enclosure 91 to the bottom surface of the rotating antenna 21. Dimension HB is 10 mm and is the distance from the upper surface of the rotating antenna 21 to the bottom surface of the bottom plate 9. Dimension HA is ⅛ of the wavelength of the microwaves and is the distance from the top surface of the bottom plate 9 to the bottom surface of the oven broiling dish 80 installed on the lower level.

When heating by microwaves, the heating mode for the oven broiling dish 80 depends on the distance from the bottom plate 9, i.e., the lowest surface on which the object to be heated can be placed in the heating chamber 10.

The oven broiling dish 80 carrying food can be placed at least ⅛ of the wavelength of the microwaves from the bottom plate 9 to suppress the fluctuation of heat over the oven broiling dish 80.

Figure 26:
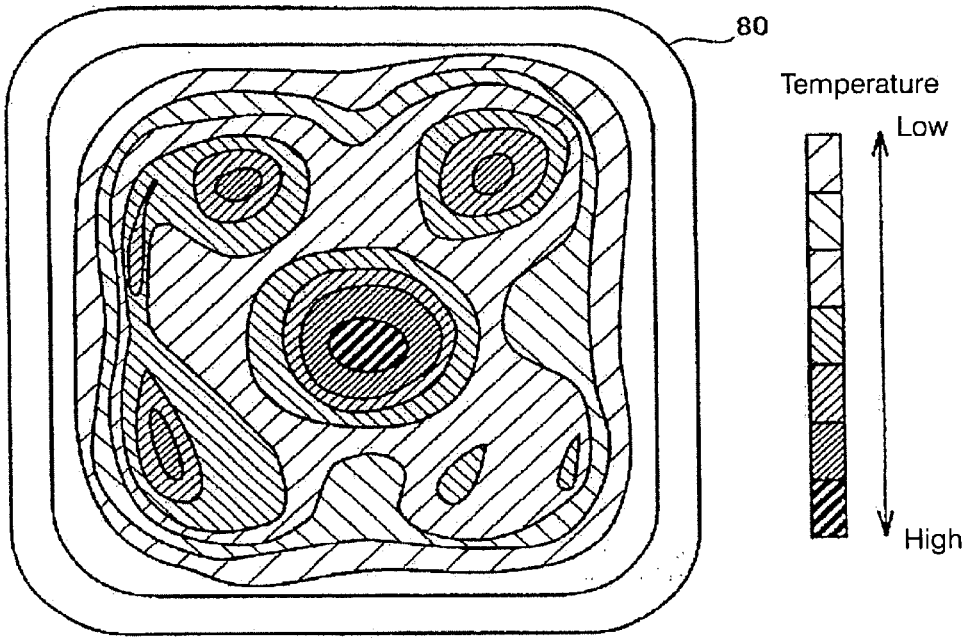
FIG. 26 is a temperature distribution diagram of the oven broiling dish according to the embodiment shown in FIG. 25.
Figure 27:
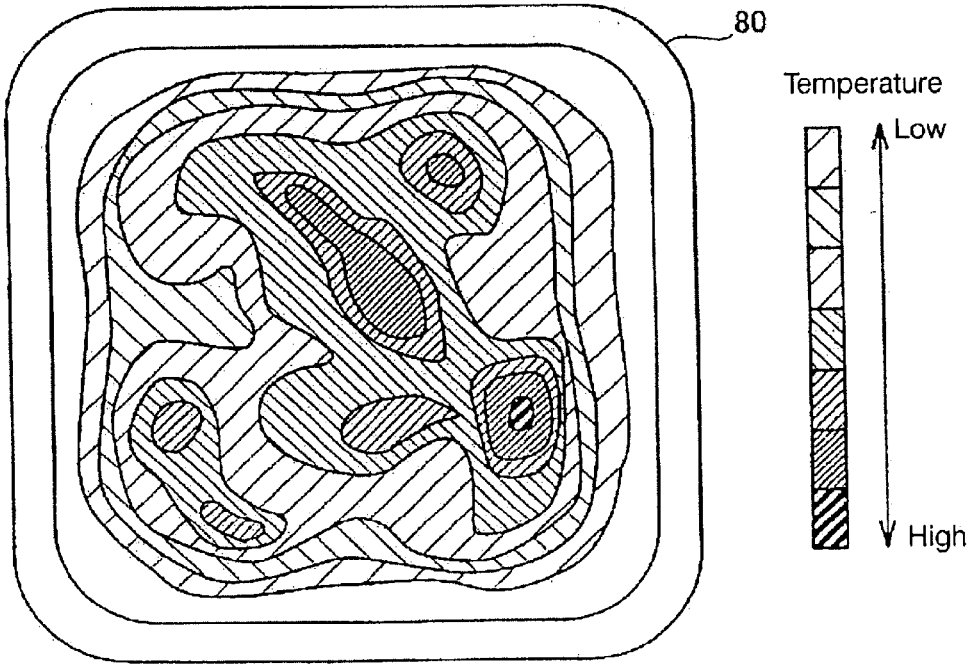
FIG. 27 is a temperature distribution diagram of the oven broiling dish according to the embodiment shown in FIG. 25.

FIG. 26 shows the temperature distribution over the oven broiling dish 80 when it is installed on the upper level and when microwaves are supplied to the heating chamber 10 for a specified time while the rotating antenna 21 rotates. FIG. 27 shows the temperature distribution over the oven broiling dish 80 when it is installed on the lower level. Everything is the same including the supply of microwaves in the cases of FIG. 26 and FIG. 27 except for the installation position of the oven broiling dish 80. Different temperature bands are indicated by different styles of hatching in FIGS. 26 and 27.

While the center portion of the oven broiling dish 80 is heated, there is a noticeable temperature difference between the center and the periphery, and although the temperature at the center is slightly higher, the fluctuation of temperature in FIG. 27 is substantially lower compared to FIG. 26.

When the oven broiling dish 80 is installed on the upper level, the fluctuation of heat shown in FIG. 26 is suppressed by stopping the rotation of the rotating antenna 21 at a predetermined position when supplying microwaves into the heating chamber 10. By stopping the rotation of the rotating antenna 21 at a position corresponding to the position where the oven broiling dish 80 is installed, the mode of supplying microwaves minimizes the fluctuation of heat over the oven broiling dish 80.

Figure 28:
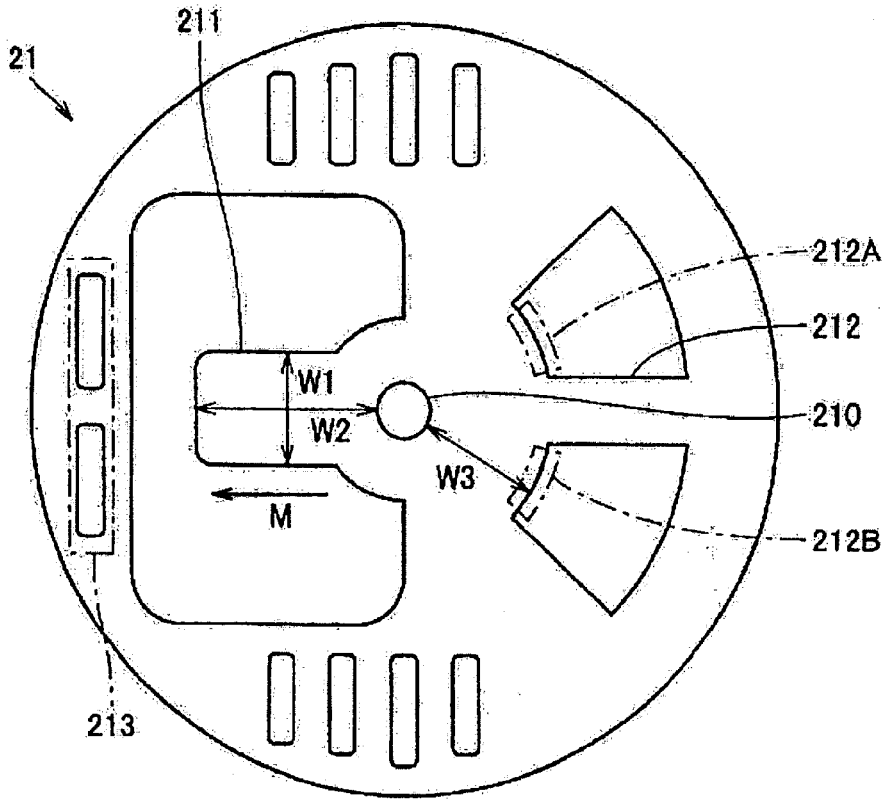
FIG. 28 is a plan view of the rotating antenna of the microwave oven according to the embodiment shown in FIG. 25.

The mode of supplying microwave into the heating chamber 10 changes depending on the stopping position of the rotating antenna 21 which is dependent on the structure of the rotating antenna 21. FIG. 28 shows a plan view of the rotating antenna 21.

The rotating antenna 21 is a circular disk made of metal having multiple areas punched out of the disk. A hole 210 in the center of the rotating antenna 21 is fitted on the shaft 15 which is the center of rotation. The rotating antenna 21 has a first portion 211 having a rectangular shape which extends from the hole 210. Since the width W1 of the first portion 211 is 35 mm, the leakage of microwaves traveling in the direction of arrow M on the first portion 211 is minimized. The length W2 of the first portion 211 is 65 mm. Consequently, microwaves are emitted with relatively strong intensities from the tip of the first portion 211 in the M direction and from an area 213 on the rotating antenna 21.

The rotating antenna 21 has fan-shaped cutouts positioned opposite to the first portion 211 relative to the hole 210. Since the distance W3 from the hole 210 to the cutouts is 45 mm, microwaves are emitted from areas 212A, 212B on the rotating antenna 21. A second portion 212 is positioned between the fan-shaped cutouts as a bridge connecting the center portion of the rotating antenna 21 and the peripheral areas of the rotating antenna 21, thereby prompting the emission of microwaves through the periphery of the rotating antenna 21.

The rotating antenna 21 constructed as described above allows the mode of supplying microwaves in the heating chamber 10 to change according to the stopping position of the rotating antenna 21 and allows the mode of heating the oven broiling dish 80 to change.

Figure 29:
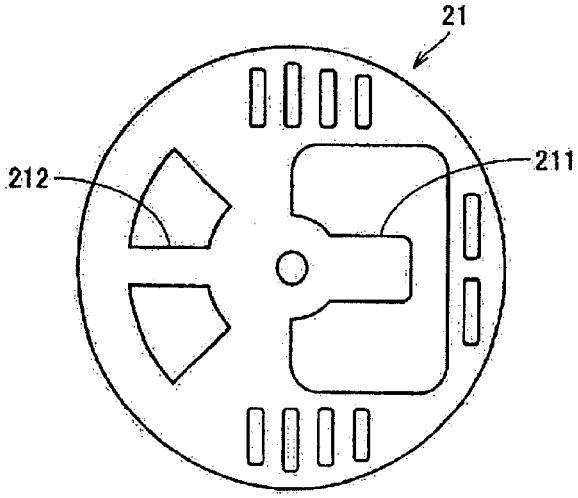
FIG. 29 is an example stopping direction of the rotating antenna of the microwave oven according to the embodiment shown in FIG. 25.
Figure 30:
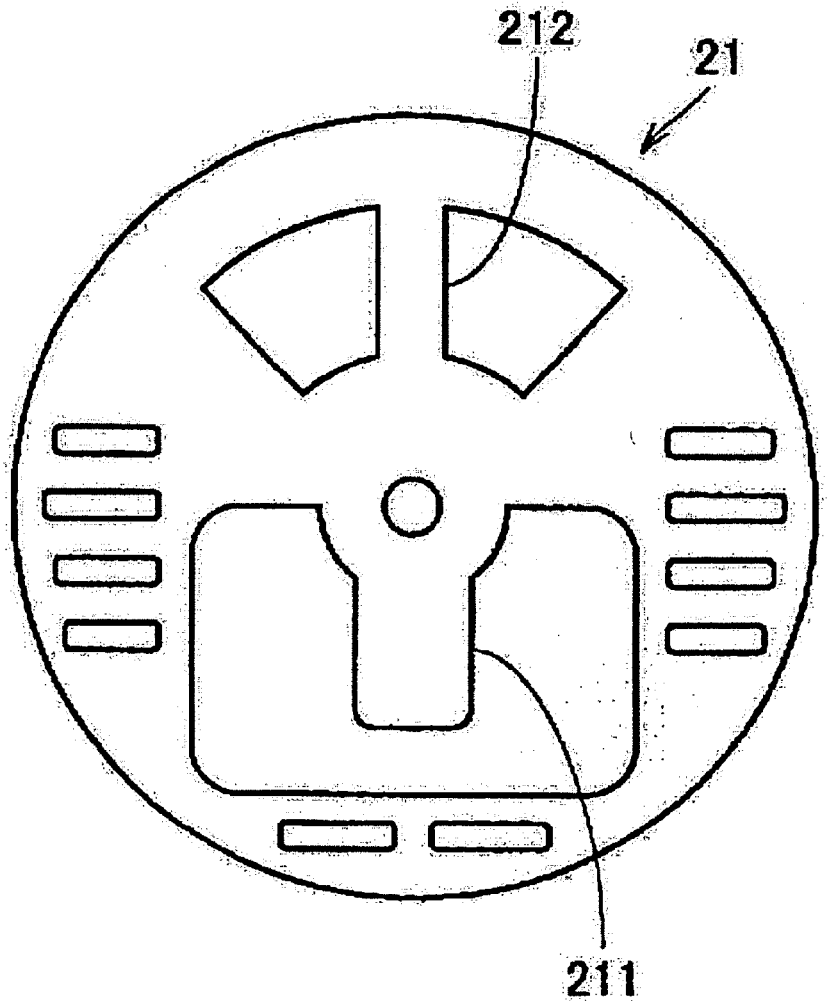
FIG. 30 is an example stopping direction of the rotating antenna of the microwave oven according to the embodiment shown in FIG. 25.

The oven broiling dish 80 can be installed on the lower level of the heating chamber 10. However, depending on the cooking menu, the oven broiling dish 80 can be installed on the upper level to cook by combining heating by the grilling heater 51 at the top of the heating chamber 10 and by heating with microwaves. Therefore, the installation position of the oven broiling dish 80 is indicated to the user by a display on the display unit 60 which depends on the cooking menu. The rotating antenna 21 stops at the stopping position which depends on the installation position of the oven broiling dish 80. For example, for a cooking menu which requires that the oven broiling dish 80 be placed on the upper level, the rotating antenna 21 stops at a stopping position shown in FIG. 29 to supply microwaves to the heating chamber 10. However, for a cooking menu which requires that the oven broiling dish 80 to be placed on the lower level, the rotating antenna 21 stops at a stopping position shown in FIG. 30 at a position rotated 90° clockwise from the position of FIG. 29 to supply microwaves to the heating chamber 10.

4. Variations of the Oven Broiling Dish

As described in the embodiment of the present invention shown in FIGS. 25-30, the height of the oven broiling dish 80 in the heating chamber 10 in the microwave oven 1 can be changed. Also, as shown in FIGS. 26 and 27, the temperature distribution of the oven broiling dish 80 changes as the height of the oven broiling dish 80 is changed. The temperature distribution of the oven broiling dish 80 can be changed by altering the area of the microwave heating element 81 which is vapor-deposited ("the vapor deposition area") according to the installation height of the oven broiling dish 80. Specifically, the vapor-deposition area of the microwave heating element 81 on the oven broiling dish 80 is preferably equal to the area of the rotating antenna 21 in the horizontal direction, if the installation height (i.e., the distance from the bottom plate 9) of the oven broiling dish 80 is equal to ⅛ of the wavelength of the microwaves supplied to the heating chamber 10.

Figure 31:
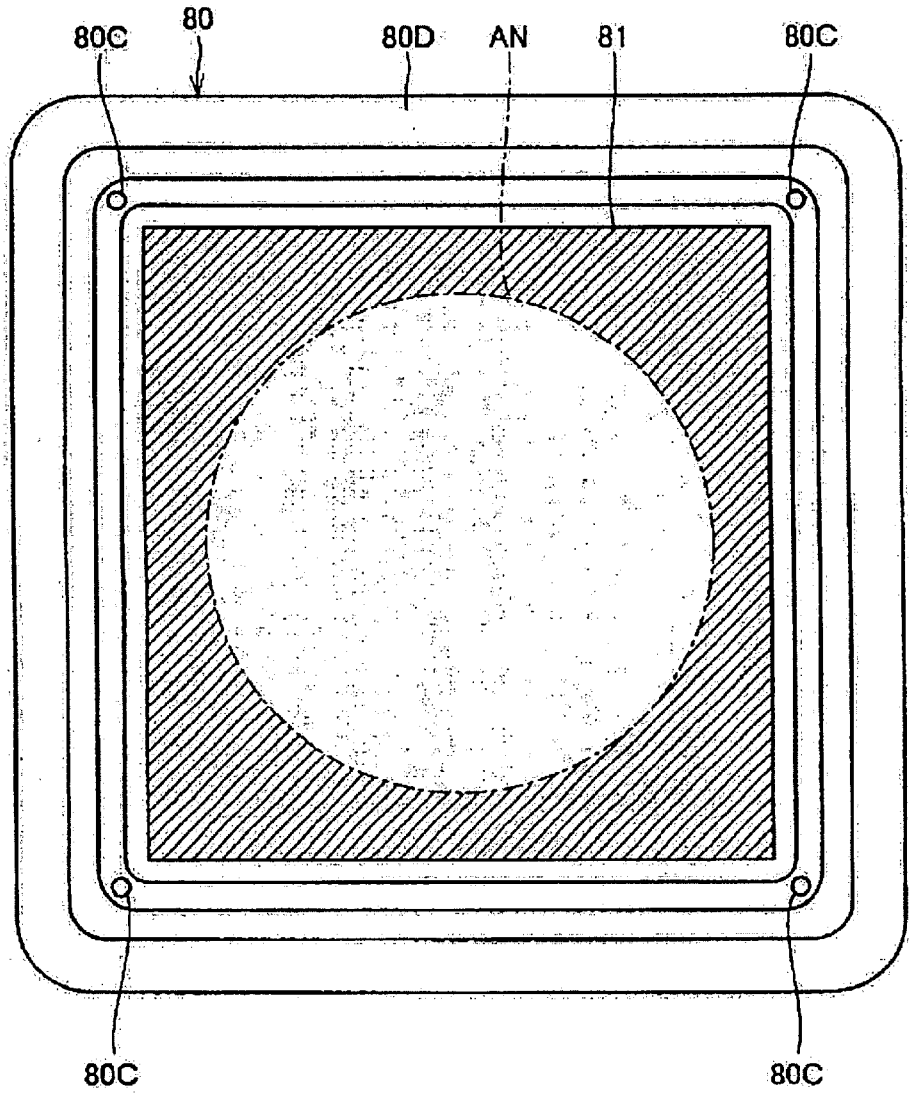
FIG. 31 is a back view of the oven broiling dish of the microwave oven according to an embodiment of the present invention.

As the installation height of the oven broiling dish 80 is increased greater than ⅛ of the wavelength of the microwaves, the vapor deposition area becomes increasingly larger in the horizontal direction than the area of the rotating antenna 21, as shown in FIG. 31. Additionally, as the installation height decreases below ⅛ of the wavelength, the vapor deposition area decreases in area in the horizontal direction to be smaller than the area of the rotating antenna 21, as shown in FIG. 32.

Figure 32:
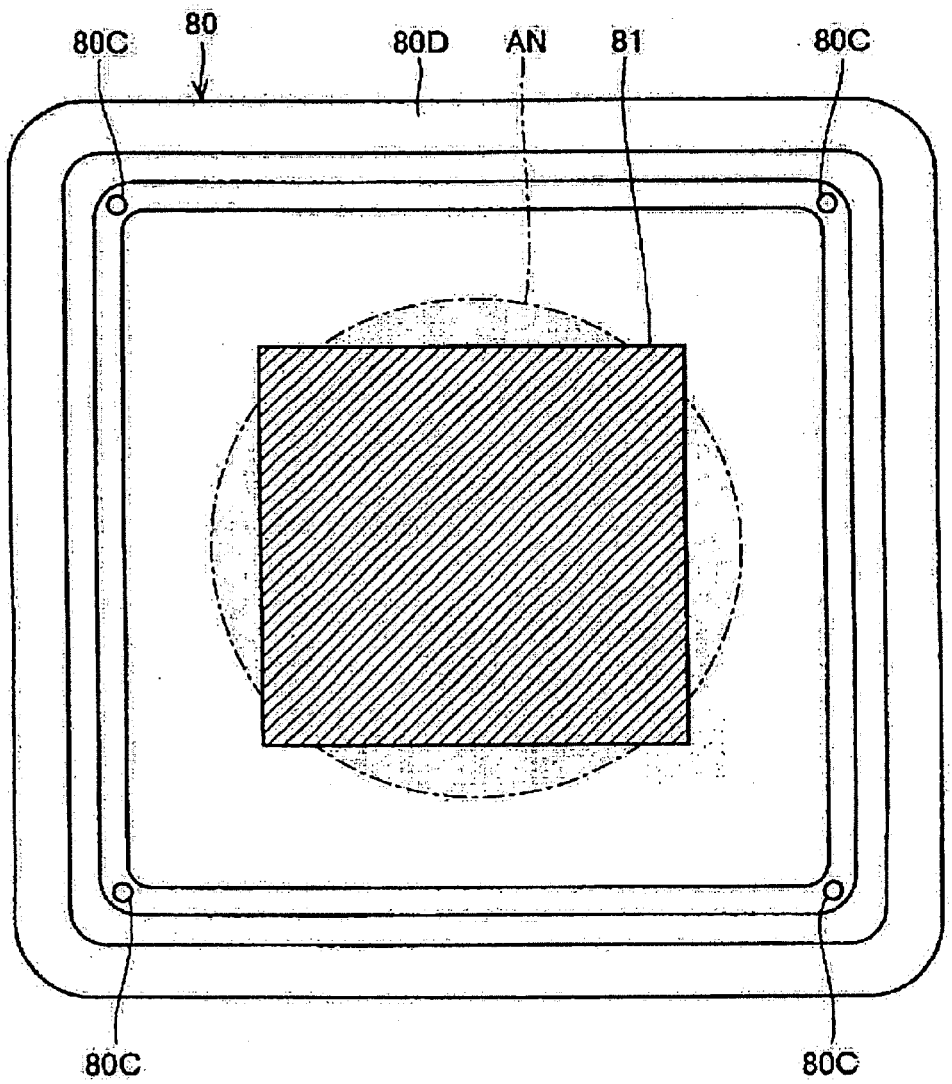
FIG. 32 is a back view of the oven broiling dish of the microwave oven according to an embodiment of the present invention.

FIGS. 31 and 32 are bottom views of the oven broiling dish 80 in this embodiment of the present invention. In FIG. 31, the rotating antenna 21 overlaps with the microwave heating element 81. The rotating antenna 21 is indicated by dashed line AN and is whited out in FIG. 31. Also, in FIG. 31, the vapor deposition area of the microwave heating element is greater than the area of the rotating antenna 21. In contrast, in FIG. 32, the position of the rotating antenna 21 is indicated by dashed line AN, and the microwave heating element 81, which overlaps the rotating antenna 21, is indicated by a hatched. In FIG. 32, the area of the microwave heating element 81 is smaller than the area of the rotating antenna 21.

Figure 33:
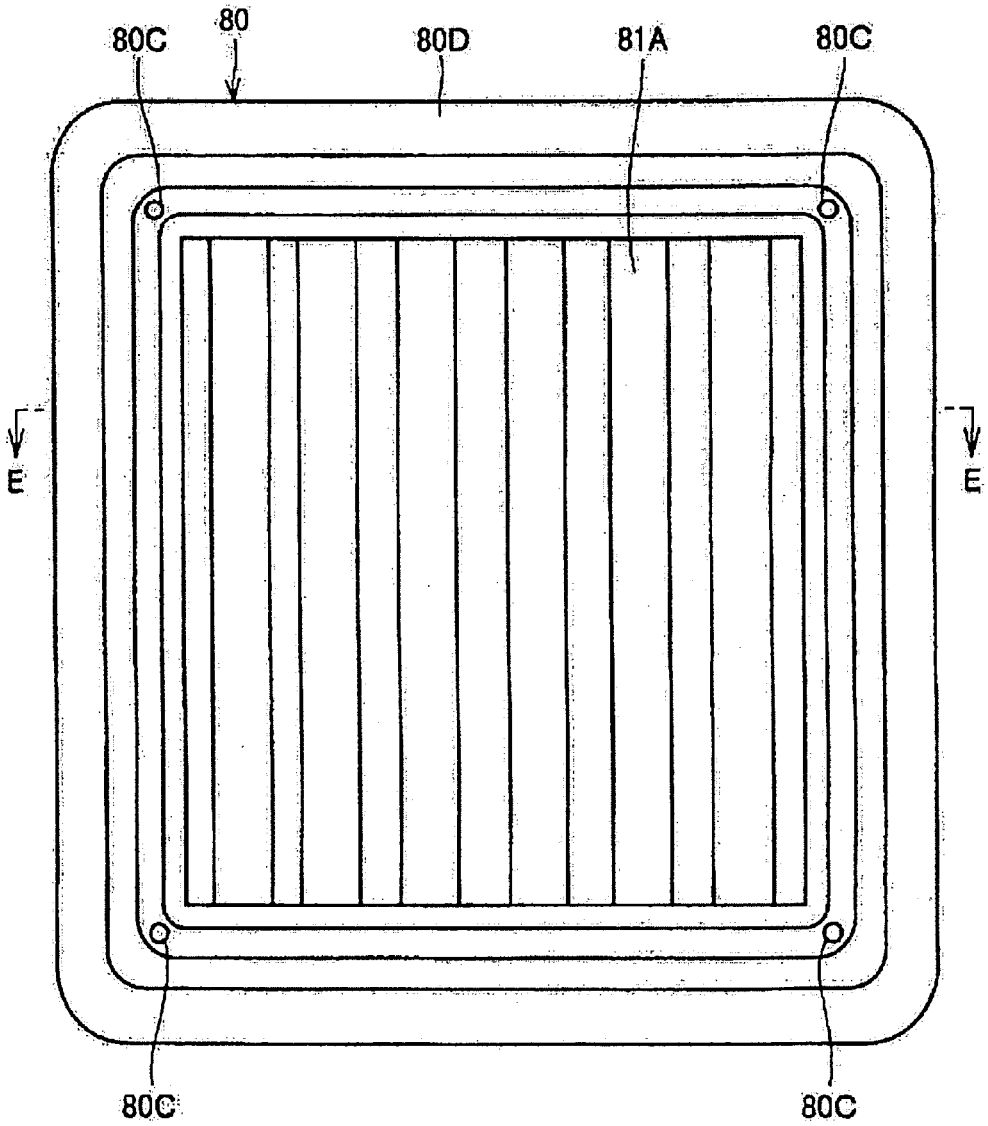
FIG. 33 is a back view of the oven broiling dish of the microwave oven according to an embodiment of the present invention.
Figure 34:
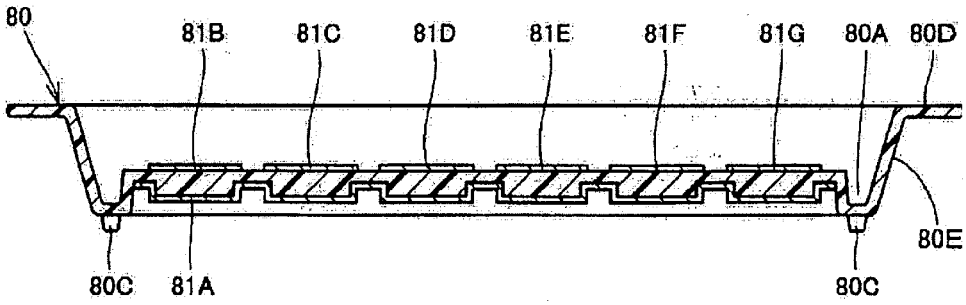
FIG. 34 is a cross-sectional view taken along the line E—E of FIG. 33.

FIGS. 33 and 34 show another embodiment of the present invention. FIG. 33 shows the bottom view of the oven broiling dish 80. FIG. 34 is a cross-section drawing taken along the line E—E of FIG. 33. The oven broiling dish 80 according to this embodiment has grooves with a depth of approximately 5 mm, and the microwave heating element 81A is vapor-deposited along the grooved surface. On the top side of the oven broiling dish 80, microwave heating element coatings 81B-81G are vapor-deposited only on the areas which align with the hills on the bottom side of the oven broiling dish 80. By placing food to be cooked directly on the top side of the oven broiling dish 80, one can cook foods that are normally cooked on steel plates such as pancakes. Although, the surface where microwave heating elements 81B-81G are vapor-deposited looks like a grooved surface as shown in FIG. 34, the thickness of microwave heating element coatings 81A–81G is only approximately $8\times10^{-8}$ m such as for the microwave heating element 81. Thus, the grooves formed by microwave heating element 81A and coatings 81B-81G are almost indiscernible in practical use.

Figure 35:
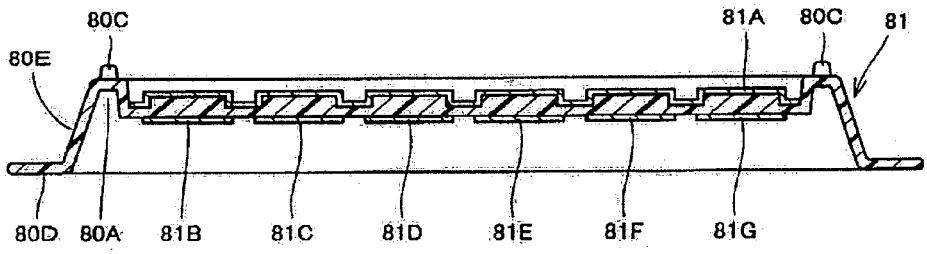
FIG. 35 is a cross-sectional view where the front and back sides of the oven broiling dish of FIG. 34 are reversed.

FIG. 35 shows an embodiment of the present invention in which the top and bottom sides of the oven broiling dish 80 in FIG. 34 are reversed. In FIG. 35, food is placed on the grooved surface where the microwave heating element 81A is deposited to provide an ideal cooking surface for foods such as steaks that produce liquids during cooking such as melted fat. The liquids are collected in the grooves to be separated from the food.

Microwave heating element coatings 81B–81G are vapor-deposited only on the areas of the bottom of the oven broiling dish 80 which align with the hills of the top side of the oven broiling dish 80 in order to have high temperatures only on the hills that contact the food. This configuration not only prevents microwave heating element coatings 81B–81G from being deposited on areas that do not need to be coated, but also prevents overheating the areas that do not need to be heated to high temperatures.

By depositing the microwave heating element 81A and microwave heating element coatings 81B–81G in different configurations on the top and bottom sides of the oven broiling dish 80 as shown in FIGS. 34 and 35, different modes of cooking can be performed on the oven broiling dish 80.

Figure 36:
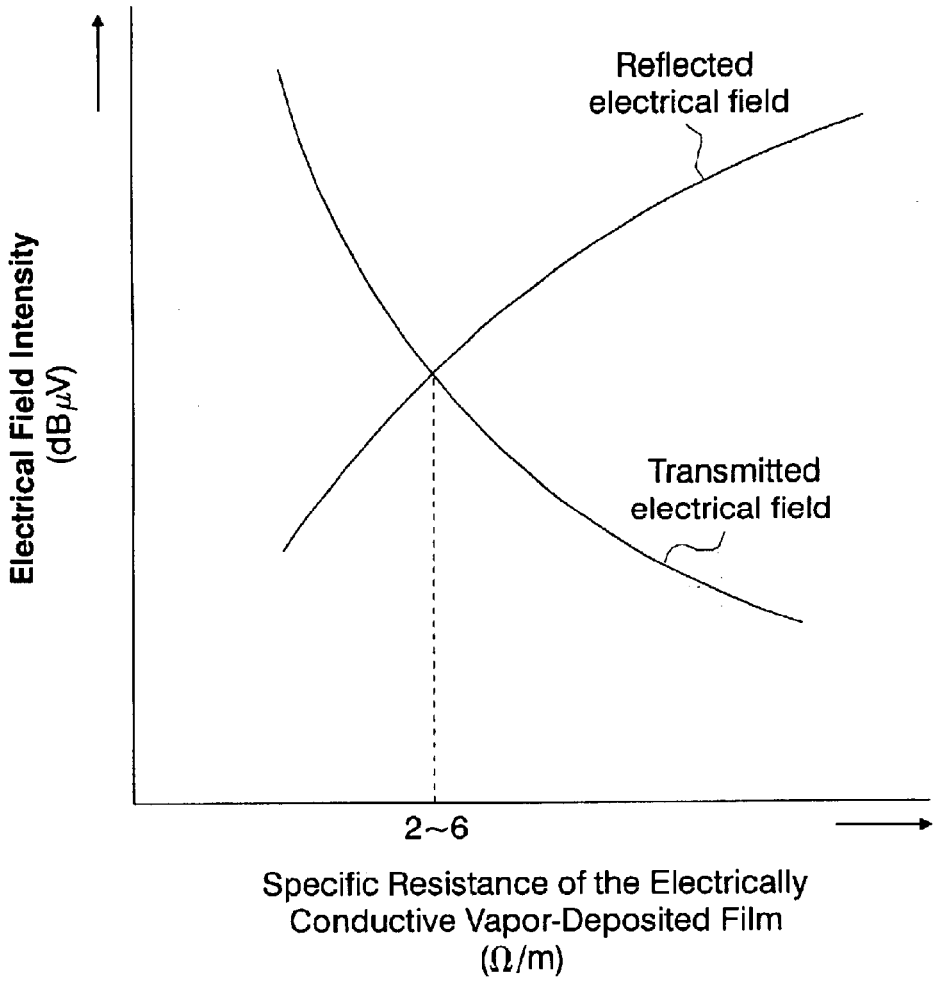
FIG. 36 is a graph showing the relation between the specific resistance of a microwave heater and the electrical field intensity due to the reflection of an oven broiling dish and due to the transmission of microwaves supplied to the heating chamber according to the present invention.

In the embodiment shown in FIG. 35, the specific resistance of the microwave heating element 81, 81A and coatings 81B–81G is preferably in the range of 200–600 Ω/m by adjusting the thickness of the coating. FIG. 36 relates the electric field intensity caused by microwaves reflected from the oven broiling dish 80 to the electric field intensity caused by microwaves passed through the oven broiling dish 80. The microwaves are supplied to the heating chamber 10 using an electrically conductive material comprising tin oxide added with molybdenum in the microwave heating element 81, 81A and coatings 81B–81G on the oven broiling dish 80.

FIG. 36 shows that the electric field intensity caused by microwaves reflected from the oven broiling dish 80 balances with the electric field intensity caused by microwaves passed through the oven broiling dish 80 when the specific resistance of the microwave heating element 81, 81A and coatings 81B–81G is in the range of 200–600 Ω/m. Under these conditions, thermal cooking using the oven broiling dish 80 becomes more efficient.

5. An Example of Thermal Cooking Process Using a Microwave Oven

Figure 37:
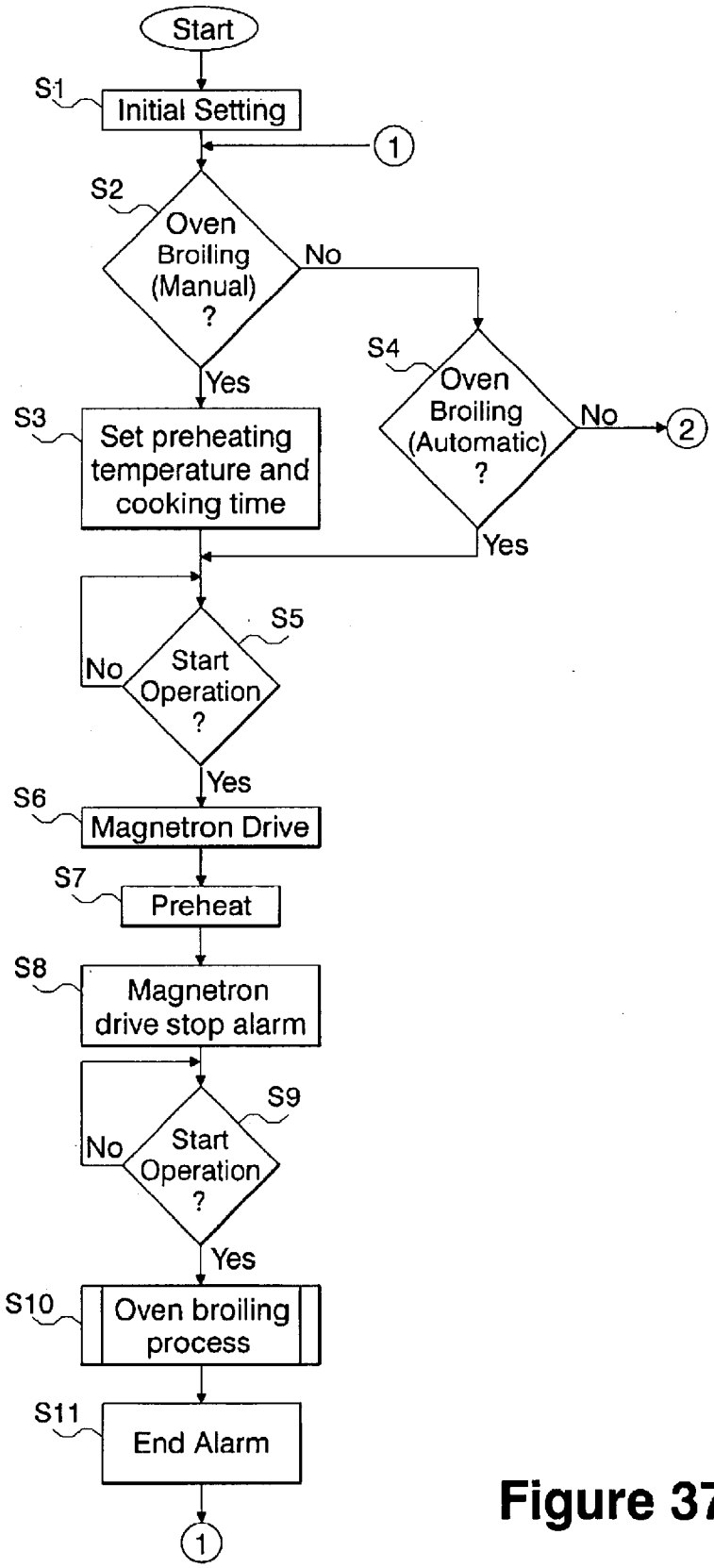
FIG. 37 is a flowchart of the thermal cooking process in a microwave oven according to the present invention.
Figure 38:
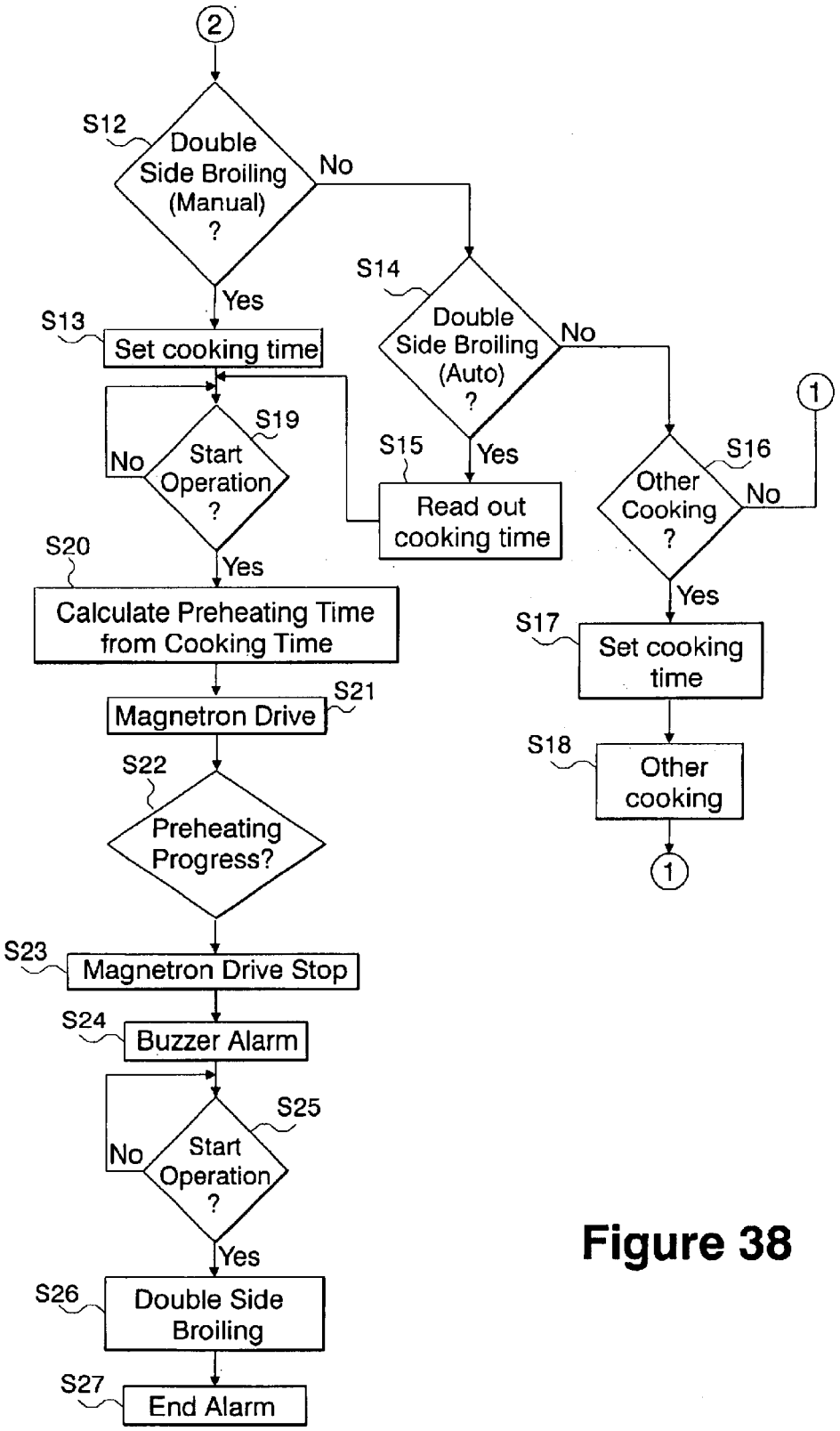
FIG. 38 is a flowchart of the thermal cooking process in a microwave oven according to the present invention.

An example of the thermal cooking process using a microwave oven 1 according to the present invention is shown in FIGS. 37-53. FIGS. 37 and 38 show a flowchart of the cooking process.

Initial settings are received by the microwave oven 1 in step S1. Then, a control circuit 30 decides at step S2 whether the cooking process is a thermal cooking process using the oven broiling dish 80 according to a manual oven broiling method in which a preheat temperature and a cooking time are entered manually by the user. The control circuit 30 makes this decision by deciding whether the oven broiling key 602 has been pressed twice within a specified time period. When the control circuit 30 decides that manual oven broiling has been selected, the control circuit 30 sets the preheat temperature and cooking time, which was preset by the user using the adjusting knob 608 at step S3, and then, the control circuit 30 advances to step S5.

The oven broiling process has two stages when using the magnetron 12: the first stage and the second stage. In step S3, the cooking times for the first and second stages are set by processing the preset cooking time in a predetermined manner. When advancing from the first stage to the second stage, an alarm is sounded to prompt the user to turn over the food on the oven broiling dish 80, as described later.

However, at step S2, if it is judged that manual oven broiling is not selected, another decision is made at step S4 to decide whether the automatic oven broiling process has been selected. Automatic oven broiling is a cooking process in which the food on the oven broiling dish 80 is heated at an automatically-determined preheat temperature during an automatically-determined cooking time. The control circuit 30 decides that automatic oven broiling has been selected if the oven broiling key 602 is pressed only once within a specified time period. If the control circuit 30 decides that automatic oven broiling has been selected, the control circuit 30 advances to step S5. If the control circuit 30 determines that automatic oven broiling has not been selected at step S4, the control circuit 30 advances to step S12.

Step S5, in which the preheat temperature and the cooking time are set, is omitted when automatic oven broiling is selected, because the preheat temperature and the cooking time for automatic oven broiling are predetermined.

In step S5, the control circuit 30 waits for the heating start operation (i.e., when the user presses the preheat key 601), and then, the control circuit 30 advances to step S6.

In step S6, the control circuit 30 waits for the magnetron 12 to start and then performs the preheat process in step S7. The preheat process heats the microwave heating element 81, 81A and coatings 81B–81G, if applicable, to preheat the oven broiling dish 80.

When the preheat process in step S7 is complete, the control circuit 30 stops driving the magnetron 12 in step S8 and notifies the user of the completion of the preheat process, for example, by sounding an alarm. In step S9, the control circuit 30 waits for the heating start operation, and after the heating start operation, the control circuit 30 advances to step S10. When the preheat process is completed in step S8, the user is warned that the oven broiling dish 80 is very hot so that the user fully understands the danger because the oven broiling dish 80 can reach very high temperatures relatively quickly.

In step S10, the control circuit 30 executes the oven broiling process, and after the completion of the oven broiling process, the control circuit 30 notifies the user of the completion in step S11. Then, the control circuit 30 returns to step S2.

At step S4, if it is decided that automatic oven broiling is not selected, the control circuit 30 advances to step S12. In step S12, the control circuit 30 decides whether manual double side broiling has been selected. Manual double side broiling is a cooking process by heating the food by both the grilling heater 51 and the oven broiling dish 80, and the cooking time is manually entered by the user. This decision is made by determining whether the grilling key 606 is pressed twice within a specified time. If the control circuit 30 decides that manual double side broiling has been selected, the control circuit 30 sets the cooking time, which was preset by the user using adjusting knob 608 in step S13. After step S13, the control circuit 30 advances to step S19. For manual double side broiling and double side broiling to be described later, there are two stages: the first stage of microwave heating using the magnetron 12 and the second stage of heating using the grilling heater 51.

However, in step S12, if the control circuit 30 decides that manual oven broiling has not been selected, another decision is made whether automatic double side broiling has been selected by the user in step S14. Automatic double side broiling is a cooking process in which the cooking time is automatically determined and food is heated using the grilling heater 51 and the oven broiling dish 80. This decision is made by deciding whether the grilling key 606 is pressed only once within a specified time. If the control circuit 30 decides that automatic double side broiling has been selected, the control circuit 30 reads out and sets the cooking times of the first stage and second stage in step S15. Then, the control circuit 30 advances to step S19. The first stage and second stage comprise a cooking course which is a course corresponding to a cooking course number that the user has selected using the adjusting knob 608 on the operating panel 6 after automatic double side broiling has been selected.

In step S19, the control circuit 30 waits for the user to perform the heating start operation by pressing the preheat key 601, and then, the control circuit 30 advances to step S20.

In step S20, the control circuit 30 calculates the preheat time from the cooking time set up in steps S13 and S15 and then advances to step S21. The preheat time is calculated depending on the cooking time according to a predetermined method so that the preheat time is longer if the cooking time is longer. For example, the preheat time can be 3 minutes if the cooking time is less than 5 minutes, or the preheat time can be 5 minutes if the cooking time is over 5 minutes but less than 10 minutes. After calculating the preheat time, the control circuit 30 advances to step S21.

In step S21, the control circuit 30 starts driving the magnetron 12. When it determines that the preheat time is expired in step S22, it stops driving the magnetron 12 in step S23 and notifies the user that the preheat process is complete in step S24. In step S25, the control circuit 30 waits for the user to perform the heating start operation and then advances to step S26.

In step S26, the control circuit 30 executes the double broiling process, notifies the user when the process is complete in step S27, and returns to step S2.

If the control circuit 30 decides in step S14 that automatic double side broiling has not been selected in step S14, the control circuit 30 decides whether another cooking process is selected in step S16. Another cooking process can include the defrosting process which is activated when the defrosting key 613 is pressed. When another cooking process is selected, the cooking time which is preset by the user is set up in step S17, the cooking process is executed for the specified cooking time in step S18, and then, the control circuit 30 returns to step S2. If the control circuit 30 decides that another cooking step is not selected in step S16, the control circuit 30 advances directly to step S2.

The preheat process is shown in FIGS. 39-50, and FIG. 39 is a subroutine flowchart of the preheat process of step S7. In the preheat process, the control circuit 30 starts the timer for counting a count value t in step S701.

Figure 40:
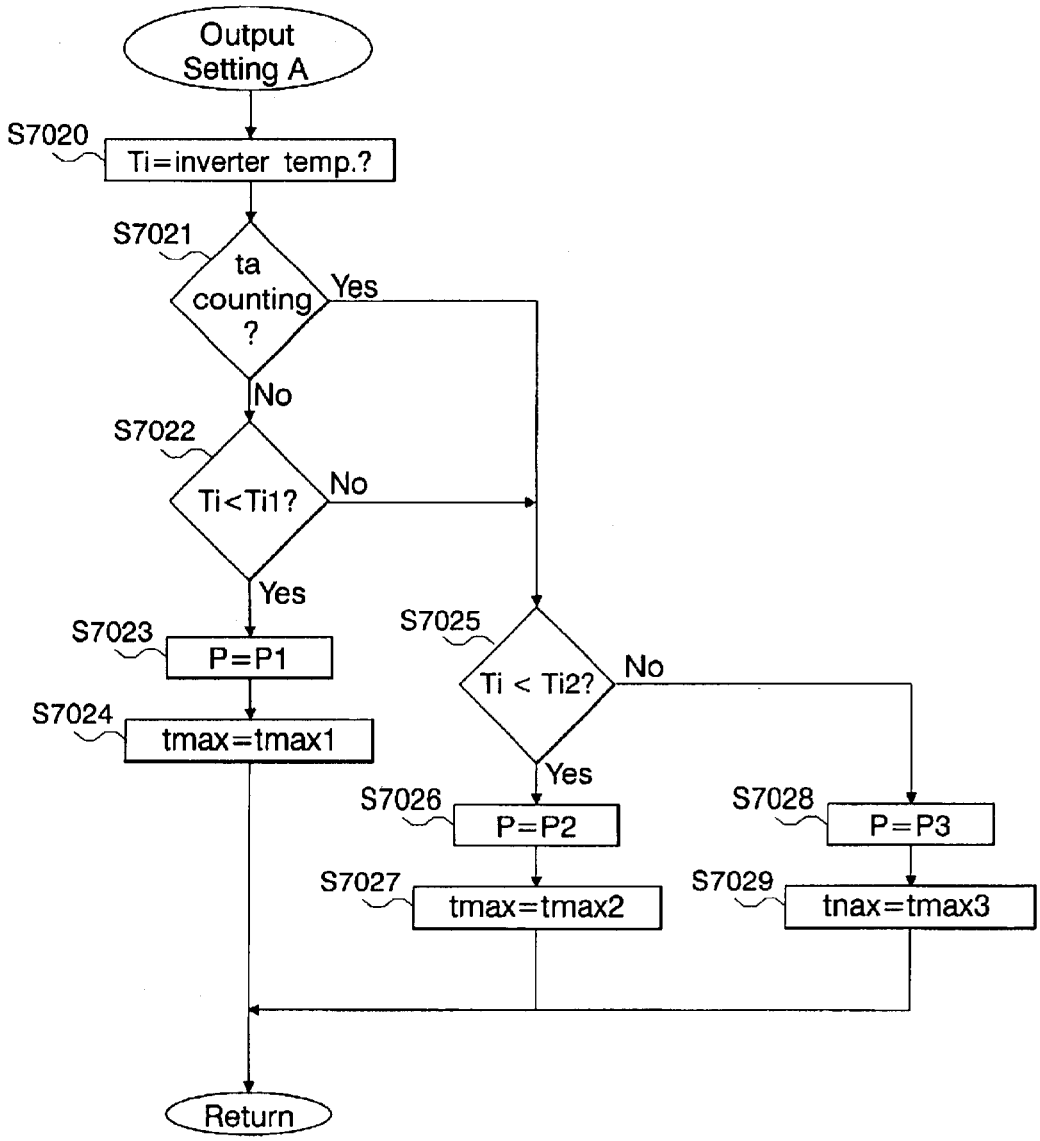
FIG. 40 is a flowchart of the output setting A process subroutine of FIG. 39.

Next, the control circuit 30 executes the output setting A process in step S702. The output setting A process is shown in FIG. 40. In the output setting A process, the control circuit 30 first detects the temperature Ti of the inverter, i.e., a frequency conversion circuit 49, in step S7020.

Next, in step S7021, the control circuit 30 decides whether the timer is counting count value ta. The count value ta is a measurement of the time required for Tcave to change from Tcave1 to Tcave2. Tcave is the average temperature measured within a scanning range by an infrared detection element, i.e., the preheat control object. Tcave 1 is a specified temperature, and Tcave 2 is a specified temperature higher than Tcave 1. If the timer is counting the count value ta, the control circuit 30 advances to step S7025; if not, the control circuit 30 advances to step S7022.

In step S7022, the control circuit 30 decides whether Ti measured in step S7020 is smaller than a specified value Ti1. If Ti is smaller than Ti1, the control circuit 30 advances to step S7023; if not, the control circuit 30 advances to step S7025.

In step S7025, the control circuit 30 decides whether Ti detected in step S7020 is smaller than the specified value Ti2 (>Ti1). If Ti is smaller than Ti2, the control circuit 30 advances to step S7026; if not, the control circuit 30 advances to step S7028.

When the output setting A process reaches step S7023, the control circuit 30 sets an output P of the magnetron 12 to P1, the maximum preheat time tmax to tmax1, and then returns to the preheat process in step S7024. The maximum preheat time is the time at which the preheat process ends regardless of the temperature detected by the infrared sensor 7 and measured from when the preheat process began.

When the output setting A process reaches step S7026, the control circuit 30 sets the output P of the magnetron 12 to P2, the maximum preheat time tmax to tmax2, and then returns to the preheat process in step S7027.

When the output setting A process reaches step S7028, the control circuit 30 sets the output P of the magnetron 12 to P3, the maximum preheat time tmax to tmax3, and then returns to the preheat process in step S7029.

The relation of the outputs P1, P2, P3 of the magnetron 12 is P1>P2>P3. Therefore, as the temperature of the inverter increases, the output of the magnetron 12 decreases. The inverter has a temperature rise which is highest when the magnetron 12 is being driven.

If the timer is not counting the count value ta, the output P of the magnetron 12 is set to P1 when "Ti<Ti1", and the output P of the magnetron 12 is set to P2 when "Ti1≦Ti<Ti2" However, if the timer is counting the count value ta, the output P of the magnetron 12 is set to P2 regardless of the value of Ti. Therefore, the output P of the magnetron 12 is less likely to be changed by loosening the change condition of the output P of the magnetron 12 if the timer is counting the count value ta, compared to when the timer is not counting the count value ta.

The maximum preheat times tmax1-tmax3 can be selected to be different from each other. Therefore, the maximum preheat time can be determined according to the output of the magnetron 12.

Figure 39:
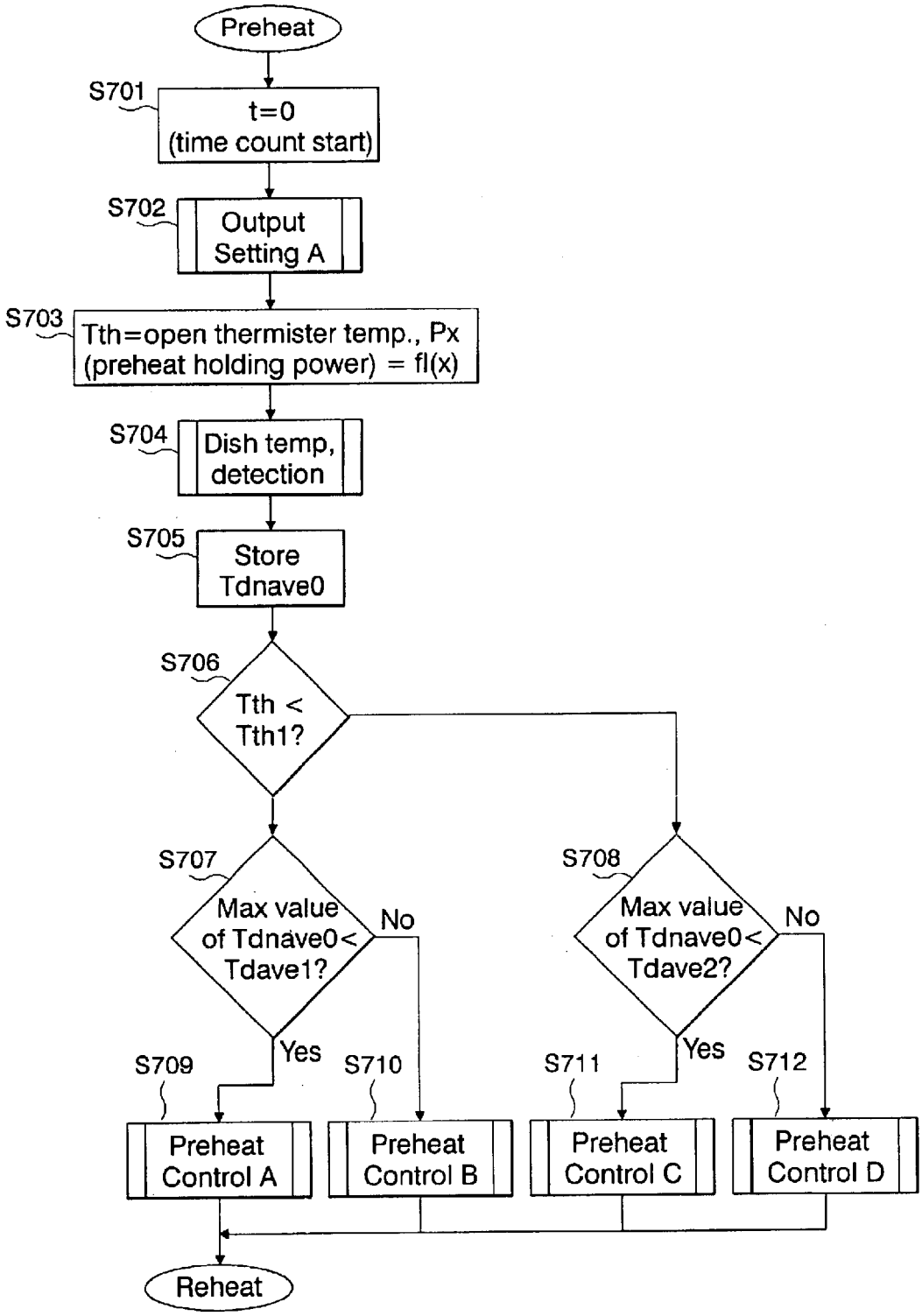
FIG. 39 is a flowchart of the preheat process subroutine of FIG. 37.

As shown in FIG. 39, after the output setting A process in step S702, the control circuit 30 causes the open thermistor 59 to detect a temperature Tth in the heating chamber 10 and calculates a preheat holding output Px. The preheat holding output Px is calculated from a predetermined function f(x) as a function of a preheat temperature x determined in step S3, for example. Since Px is the output of the magnetron 12 when the temperature of the oven broiling dish 80 is held constant, Px<<P3<P2<P1 is the relationship between the outputs of the magnetron 12.

Next, the control circuit 30 executes a dish temperature detection process in step S704. The dish temperature detection process is shown in FIG. 41.

Each infrared detection element of the infrared sensor 7 has an initial position. In the dish temperature detection process, the control circuit 30 moves each infrared detection element of the infrared sensor 7 to the initial position in step S7041. Each infrared detection element in the infrared sensor 7 has a temperature detection area.

Figure 42:
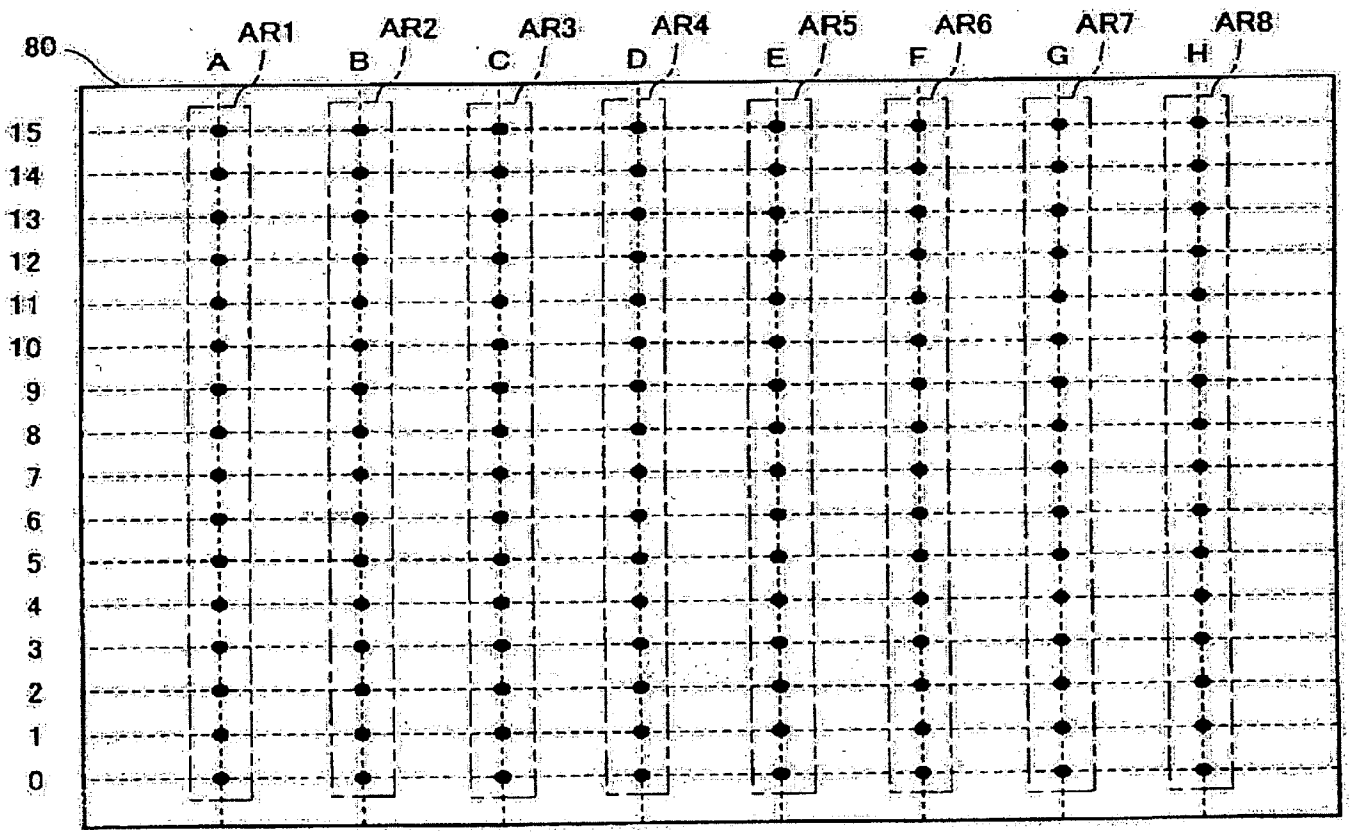
FIG. 42 is a diagram showing the temperature detection range of each infrared detection element of the infrared sensor according to the present invention.

The infrared sensor 7 according to this embodiment of the present invention is equipped with eight infrared detection elements, each designated as element n (for n=1-8). The temperature detection area ARn of infrared detection element n can be expressed as AR1–AR8 on the oven broiling dish 80 as shown in FIG. 42. FIG. 42 shows 8×16 points obtained by drawing eight lines A–H from left to right and 16 lines 0–15 in the depth direction on the oven broiling dish 80. Each temperature detection area AR1–AR8 corresponding to an infrared detection element n contains 16 points. The infrared sensor 7 scans each infrared detection element n to detect the temperatures of the 16 points sequentially as they are lined up in the depth direction on the temperature detection area AR1–AR8, respectively. In step S7041, the initial position of each infrared detection element n is the position for detecting the temperature on the points lying on the line 0 in the depth direction.

Figure 41:
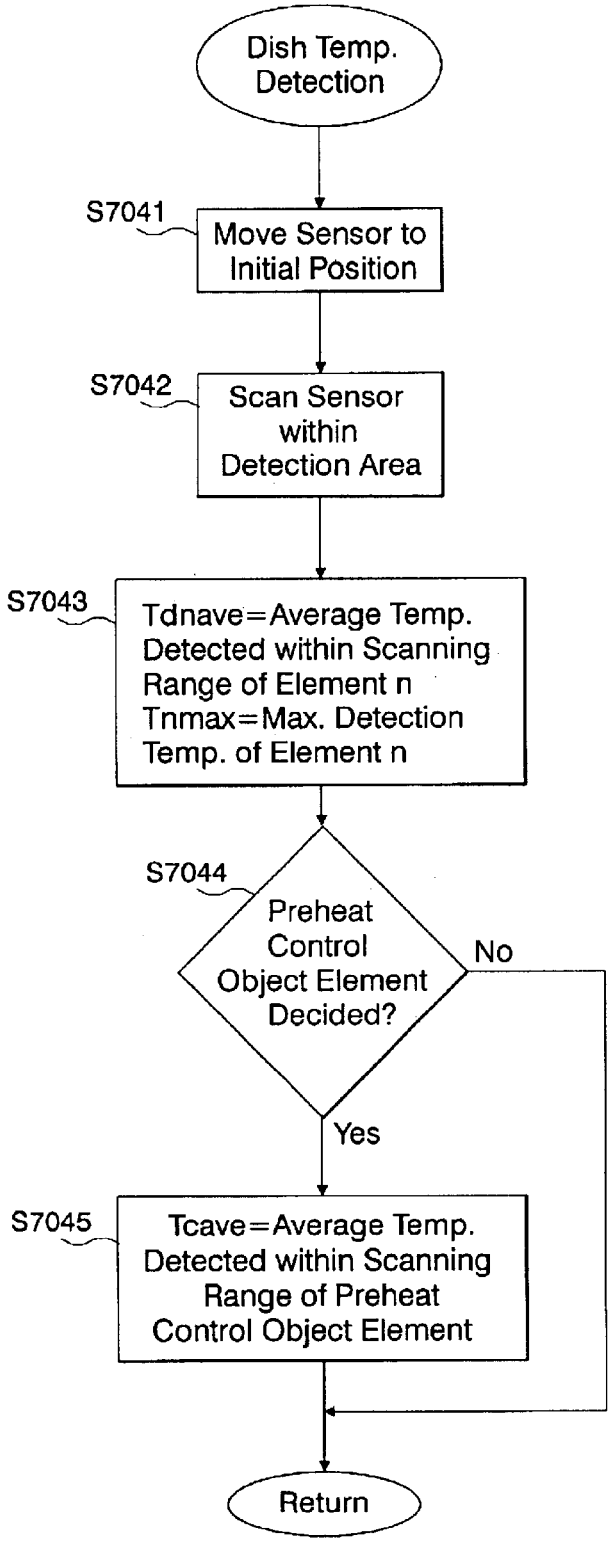
FIG. 41 is a flowchart of the temperature detection process subroutine of FIG. 39.

As shown in FIG. 41, the control circuit 30 causes the infrared sensor 7 to scan so that each infrared detection element n detects the temperatures of the 16 points in each temperature detection area AR1–AR8, respectively, in step S7042.

Next, in step S7043, the control circuit 30 calculates an average temperature Tdnave and a maximum temperature Tnmax of the temperatures of the 16 points detected by the infrared detection elements n of the infrared sensor 7 in step S7042.

In step S7044, the control circuit 30 decides whether any of the eight infrared detection elements n is to used as the object of the preheat control, i.e., the preheat control object. This decision is made at step SA7, step SA13, or step SA14 to be described later. If the control circuit 30 has selected a preheat control object, the control circuit 30 calculates in step S7045 the average value of the temperatures of the points that have been detected by the element that is the preheat control object. If the control circuit 30 has not selected a preheat control object, the control circuit 30 returns to the preheat process.

As shown in FIG. 39, after step S704 in which the control circuit 30 detects the temperature Tdnave in the dish temperature detection process, the control circuit 30 stores the temperature Tdnave in step S705 as Tdnave0 (for n=1-8 representing the infrared detection element n so that there exists Td1ave0-Td8ave0, where "0" stands for the first scanning).

Next, in step S706, the control circuit 30 decides whether Tth detected in step S703 is smaller than the specified Tth1. If Tth is smaller than Tth1, the control circuit 30 advances to step S707; if Tth is greater than Tth1, the control circuit 30 advances to step S708.

In step S707, the control circuit 30 decides whether the maximum value of Tdnave0 is smaller than the specified Tdave1. If Tdnave0 is smaller than Tdave1, the control circuit 30 advances to step S709; if Tdnave0 is greater than Tdave1, the control circuit 30 advances to step S710.

In step S708, the control circuit 30 decides whether the maximum value of Tdnave0 is smaller than the specified Tdave2. If Tdnave0 is smaller than Tdave2, the control circuit 30 advances to step S711; if Tdnave0 is greater than Tdave1, the control circuit 30 advances to step S712.

Then, in step S709, step S710, step S711, and S712, as shown in FIG. 39, the control circuit 30 executes preheat control A process, preheat control B process, preheat control C process, and preheat control D process, respectively, and then returns to the main program.

Figure 43A:
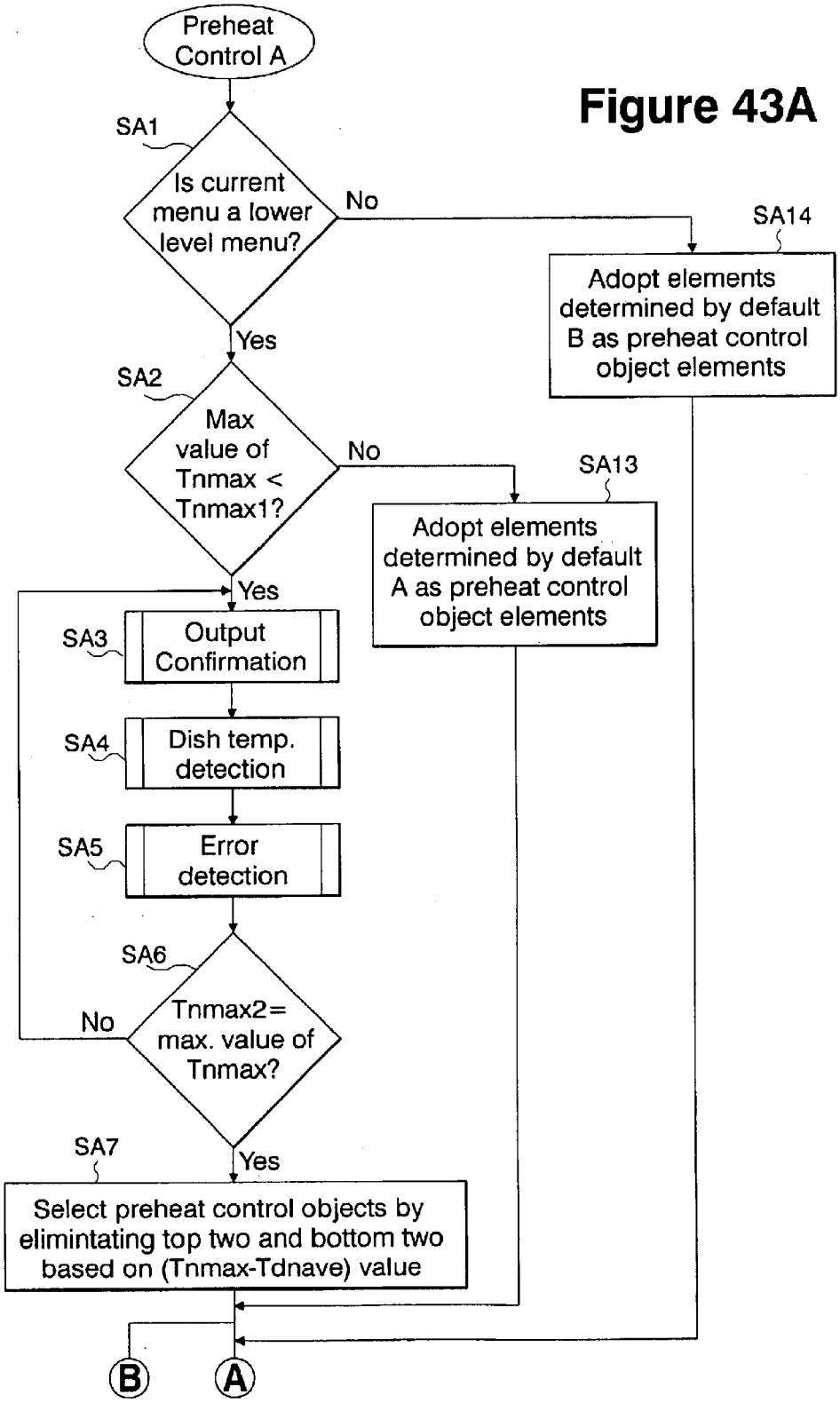
FIGS. 43A, 43B and 43C are flowcharts of the preheat control A process subroutine of FIG. 39.
Figure 43B:
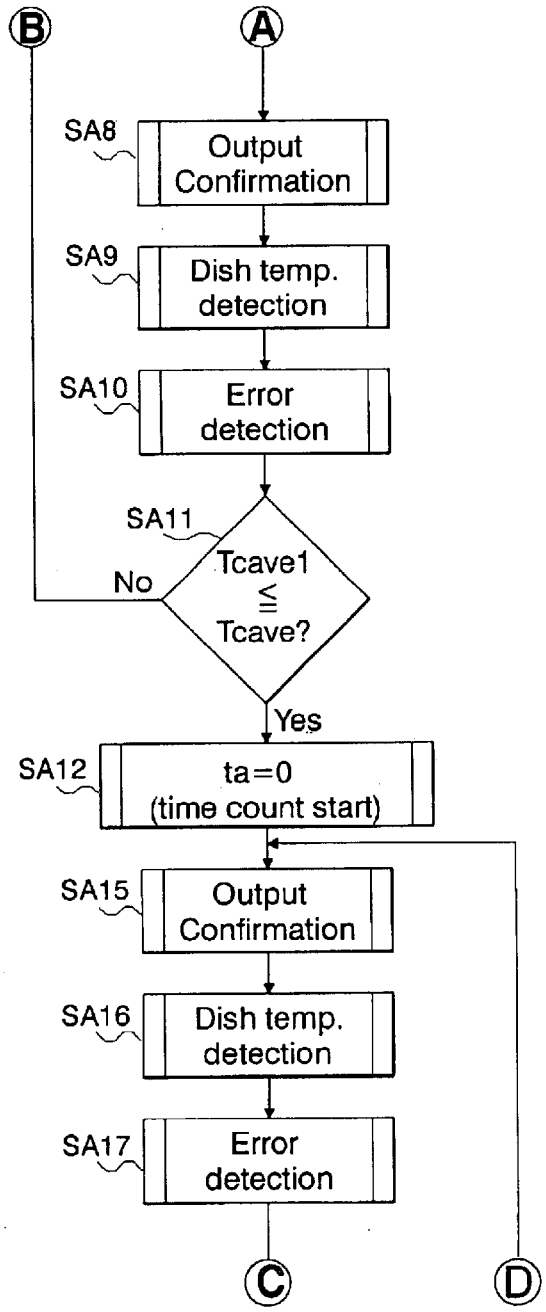
Figure 43C:
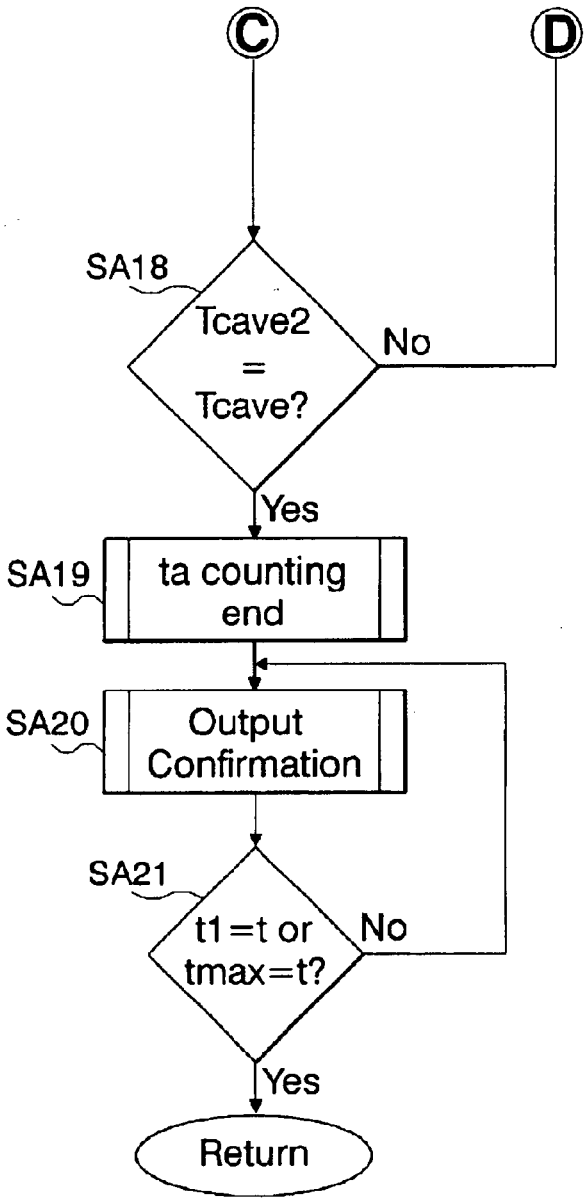

The preheat control A process is shown in FIGS. 43A-43C. In the preheat control A process, the control circuit 30 decides in step SA1 if the cooking menu that is currently being executed in the microwave oven 1 is a menu that requires the oven broiling dish 80 to be installed on the lower level of the heating chamber 10, as shown in FIG. 25. The microwave oven 1 can indicate to the user the required level on which the oven broiling dish 80 is to be installed for each menu. If the menu requires the dish to be installed on the lower level, the control circuit 30 advances to step SA2; if the menu requires the dish to be installed on the upper level, the control circuit 30 advances to step SA14.

In step SA2, the control circuit 30 decides whether the maximum value of the latest Tnmax is smaller than the specified Tnmax1. If Tnmax is smaller than Tnmax1, the control circuit 30 advances to step SA3; if Tnmax is greater than Tnmax1, the control circuit 30 advances to step SA13.

Figure 44:
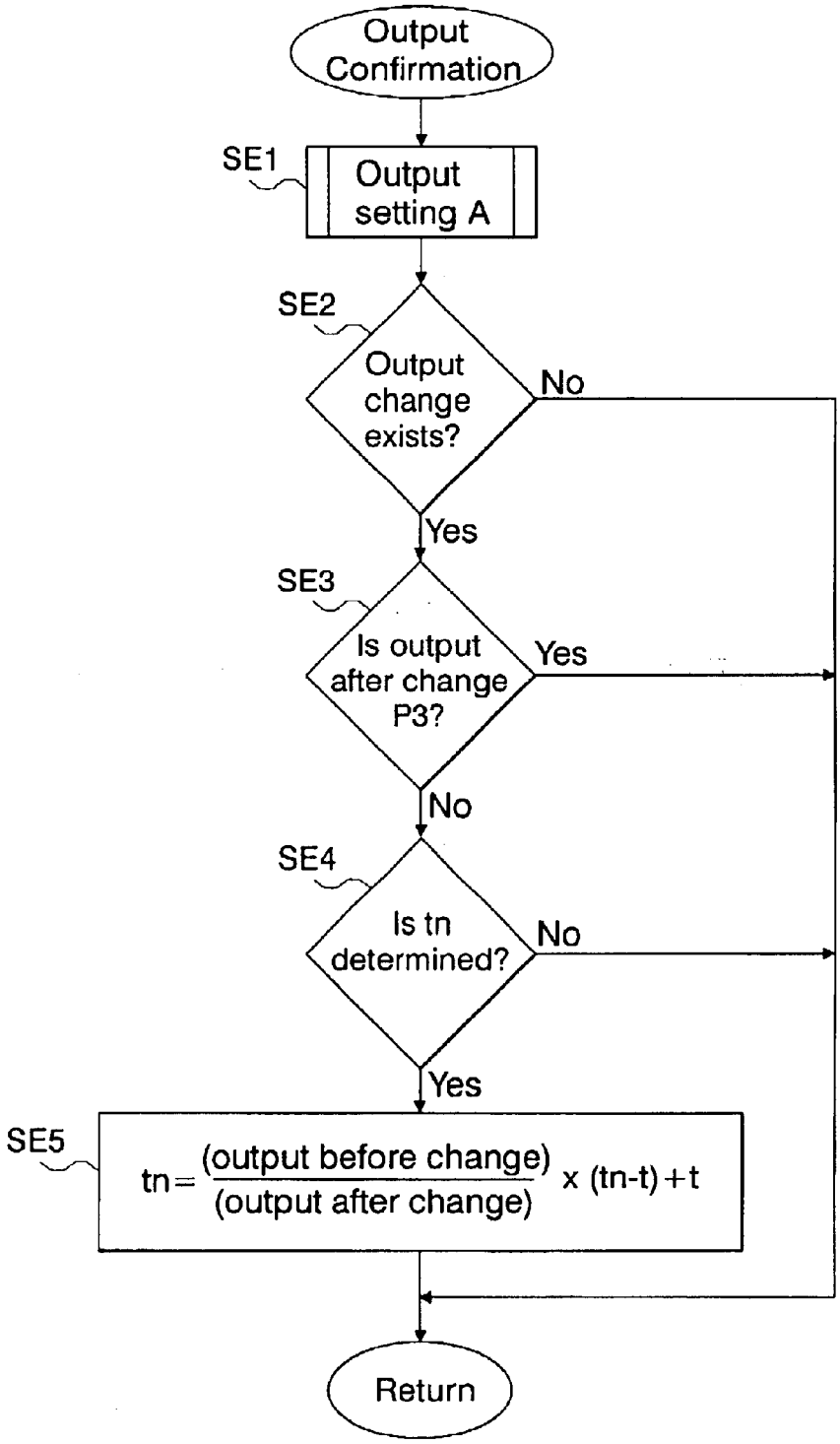
FIG. 44 is a flowchart of the output confirmation process subroutine of FIGS. 43A-43C.

In step SA3, the control circuit 30 executes the output confirmation process, which is shown in FIG. 44. In the output confirmation process, the control circuit 30 first executes the output setting A process in step SE1. The output setting A process is described above and is shown in FIG. 40.

Next, in step SE2, the control circuit 30 decides whether the output P of the magnetron 12 has changed in the output setting A process executed immediately before in step SE1. If P has not changed, the control circuit 30 returns to the preheat control A process; if P has changed, the control circuit 30 advances to step SE3.

In step SE3, the control circuit 30 decides whether the output P after the change equals P3. If the output after the change is P3, the control circuit 30 returns to the preheat control A process; if the result of the change is not P3, the control circuit 30 advances to step SE4.

In step SE4, the control circuit 30 decides whether the preheat time tn has already been determined. If tn has been determined, the control circuit 30 advances to step SE5; if tn has not been determined, the control circuit 30 returns to the preheat control A process.

In step SE5, the control circuit 30 changes the preheat time tn depending on the change of the output of the magnetron 12 and returns to the preheat control A process. The preheat time tn after the change ("tn after change") is calculated according to Formula 1 using the output of the magnetron 12 before and after the change ("output before change" and "output after change", respectively), the preheat time tn before the change ("tn before change"), and the count value t of the timer, which began counting in step S701.

Formula 1:

$$(\text{tn after change}) = \left[\frac{\text{output before change)}}{\text{(output after change)}} \times [(\text{tn before change}) - t]\right] + t$$

As shown in FIG. 43A, after the output confirmation process is completed in step SA3, the control circuit 30 executes the dish temperature detection process in step SA4. The dish temperature detection process is described above and shown in FIG. 41.

Figure 45A:
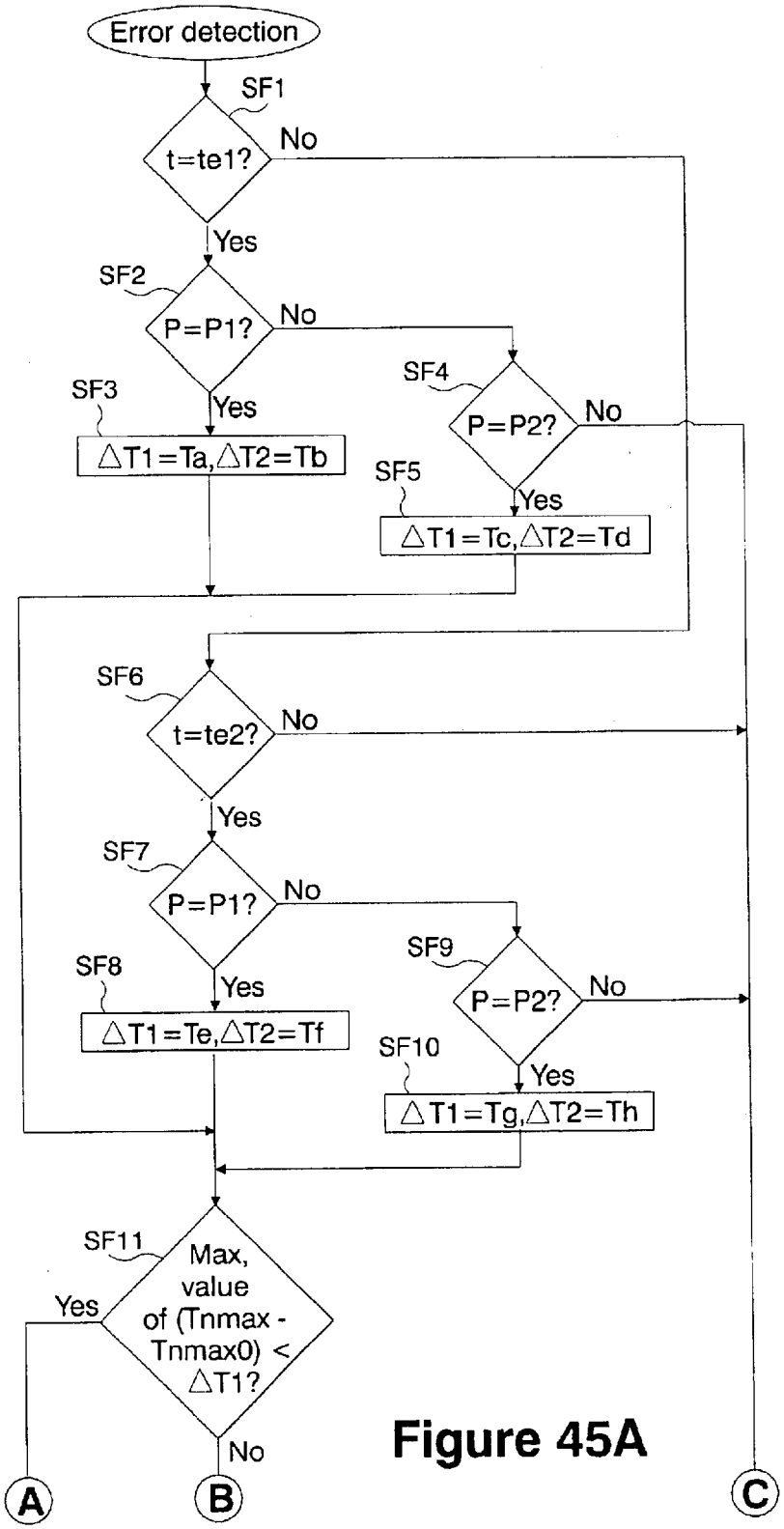
FIGS. 45A and 45B are flowcharts of the error detection process subroutine of FIGS. 43A-43C.
Figure 45B:
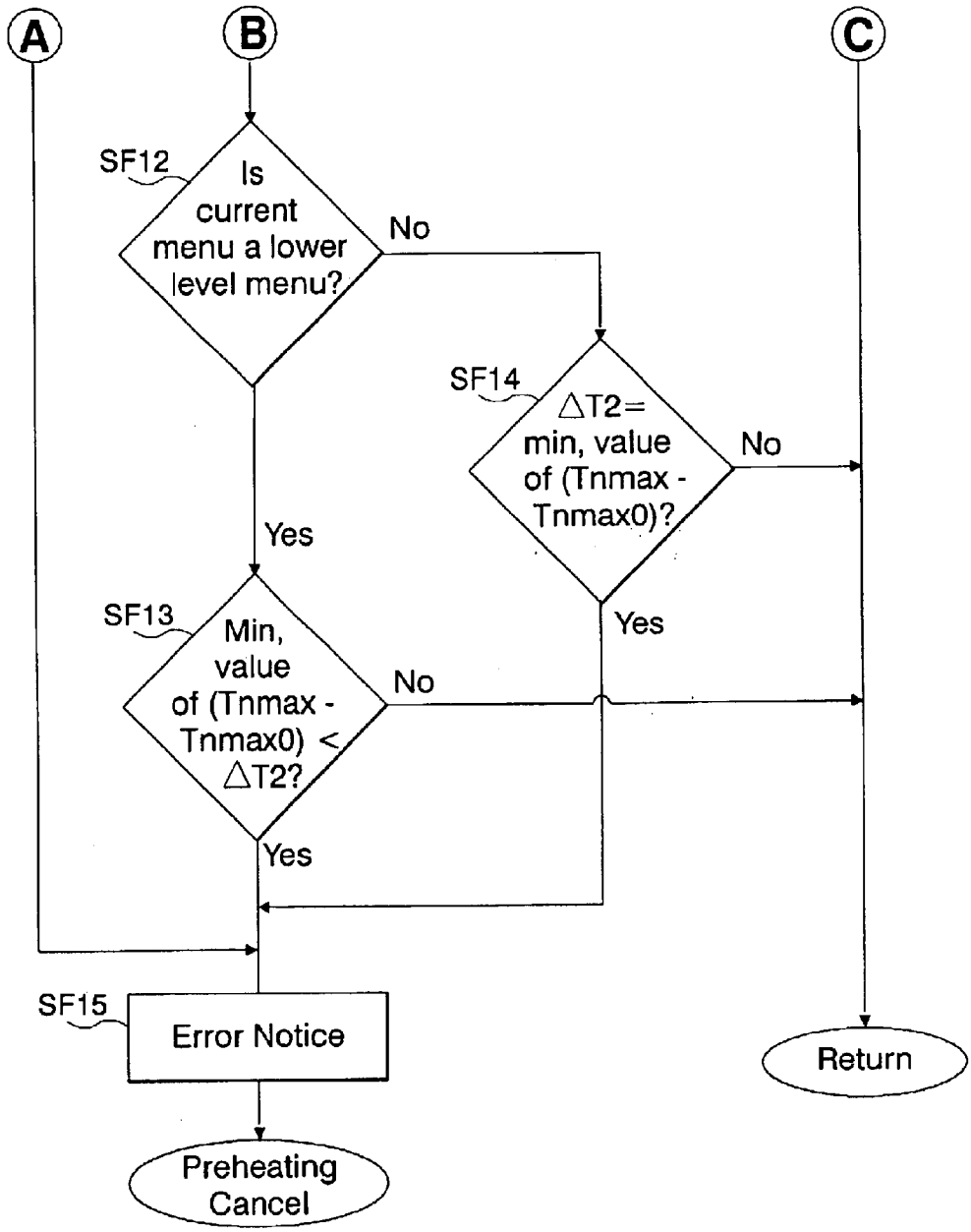

Next, in step SA5, the control circuit 30 executes the error detection process. The error detection process is shown in FIGS. 45A and 45B.

In the error detection process, the control circuit 30 decides in step SF1 whether the count value t of the timer started in step S701 is the specified value te1. If t is te1, the control circuit 30 advances to step SF2; if not, the control circuit 30 advances to step SF6.

In step SF2, the control circuit 30 decides whether the output P of magnetron 12 is P1. If P is P1, the control circuit 30 advances to step SF3; if P is not P1, the control circuit 30 advances to step SF4.

In step SF4, the control circuit 30 decides whether the output P of magnetron 12 is P2. If P is P2, the control circuit 30 advances to step SF5; if P is not P2, the control circuit 30 returns to the preheat control A process.

In step SF3, the control circuit 30 sets up threshold values Ta, Tb for deciding if there is an error in the temperature increase values ΔT1, ΔT2, respectively, of the oven broiling dish 80. Then, the control circuit 30 advances to step SF11. In step SF5, the threshold values Tc, Td are set to the temperature increase values ΔT1, ΔT2, respectively. Then, the control circuit 30 advances to step SF11. The threshold values for the temperature increase values ΔT1, ΔT2 of the oven broiling dish 80 are used as the basis of the error judgment in correspondence with the output of magnetron 12 and can be set differently.

In step SF6, the control circuit 30 decides whether the count value t of the timer is te2. If t is te2, the control circuit 30 advances to step SF7; if not, the control circuit 30 returns to the preheat control A process.

In step SF7, the control circuit 30 decides whether the output P of the magnetron 12 is P1. If P is P1, the control circuit 30 advances to step SF8; if P is not P1, the control circuit 30 advances to step SF9.

In step SF9, the control circuit 30 decides whether the output P of the magnetron 12 is P2. If P is P2, the control circuit 30 advances to step SF10; if P is not P2, the control circuit 30 returns to the preheat control A process.

In step SF8, the control circuit 30 sets up the threshold values Te, Tf as the temperature increase values of the oven broiling dish 80 ΔT1, ΔT2, respectively, to determine if there is an error. Then, the control circuit 30 advances to step SF11. In step SF10, the threshold values Tg, Th are set to the temperature increase values ΔT1, ΔT2, respectively, and the control circuit 30 advances to step SF11. In other words, the threshold values can be set differently to the temperature increase values on the oven broiling dish 80 and are used as the basis for error judgment in correspondence with the output of the magnetron 12. In comparison to steps SF3 and SF5, different threshold values can be set depending on the time the steps are executed, e.g., the values of te1 or te2.

In step SF11, the control circuit 30 decides whether the maximum value of "Tnmax−Tnmax0" is smaller than ΔT1. "Tnmax−Tnmax0 " is a value of increase of the maximum value of the temperature detected by each infrared detection element from the maximum value of the initial detection. Also, the maximum value of "Tnmax−Tnmax0 " is the maximum value among the values of increase of the eight infrared detection elements.

If the maximum value of "Tnmax−Tnmax0 " is smaller than ΔT1, the control circuit 30 alerts the user with an error notice and stops the preheat process in step SF15. As a result, if the temperature increase of the oven broiling dish 80 is smaller than an expected range, or if each infrared detection element of the infrared sensor 7 cannot detect the temperature properly, the preheat process can be stopped.

However, if the maximum value of "Tnmax−Tnmax0 " is greater than ΔT1, the control circuit 30 advances to step SF12.

In step SF12, the control circuit 30 decides whether the menu operated in the microwave oven 1 is a menu that requires the oven broiling dish 80 to be installed on the lower level of the heating chamber 10. If the menu requires the oven broiling dish 80 to be on the lower level, the control circuit 30 advances to SF13; if the menu requires the oven broiling dish 80 to be on the upper level, the control circuit 30 advances to step SF14.

In step SF13, the control circuit 30 decides whether the minimum value of "Tnmax−Tnmax0 " is greater than ΔT2. If the minimum value of "Tnmax−Tnmax0 " is greater than ΔT2, the control circuit 30 issues an error notice and cancels the preheat process in step SF15; if the minimum value of "Tnmax−Tnmax0 " is smaller than ΔT2, the control circuit 30 returns to the preheat control A process.

In step SF14, the control circuit 30 decides whether the minimum value of "Tnmax−Tnmax0 " is greater than ΔT2. If the minimum value of "Tnmax−Tnmax0 " is greater than ΔT2, the control circuit 30 alerts the user with an error notice and stops the preheat process in step SF15; if the minimum value of "Tnmax−Tnmax0 " is smaller than ΔT2, the control circuit 30 returns to the preheat control A process.

Figure 46A:
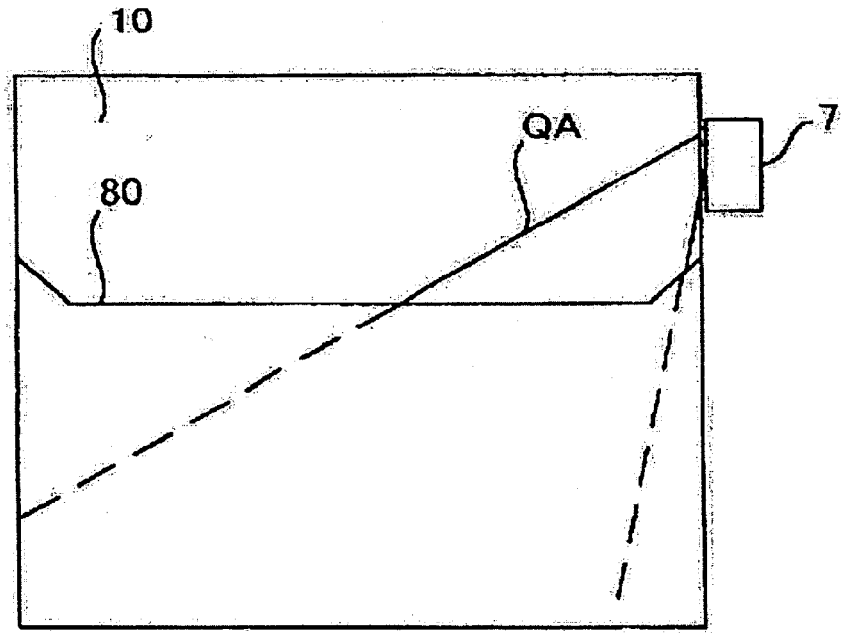
FIGS. 46A and 46B are diagrams showing the field of view of the infrared sensor over the oven broiling dish depending on the height at which the oven broiling dish is installed according to the present invention.
Figure 46B:
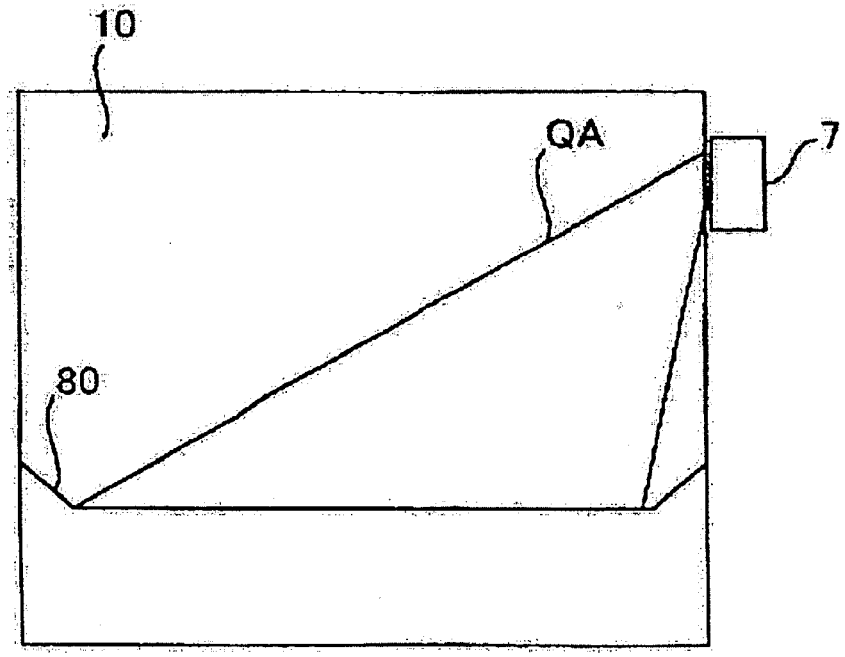

In steps SF12–SF14, the method for detecting an error varies with the height at which the oven broiling dish 80 is installed. The area included in the field of view QA of each infrared detection element of the infrared sensor 7 varies over the oven broiling dish 80 when the height at which the oven broiling dish 80 is installed varies as shown in FIGS. 46A and 46B. FIG. 46A shows the field of view QA of the infrared sensor 7 of the oven broiling dish 80 when installed on the upper level, and FIG. 46B shows the field of view of the infrared sensor 7 of the oven broiling dish 80 when installed on the lower level. If the oven broiling dish 80 is stored on the lower level as shown in FIG. 46B, almost the entire oven broiling dish 80 is included in the field of view QA, whereas if the oven broiling dish 80 is installed on the upper level as shown in FIG. 46A, a substantial area of the oven broiling dish 80 is out of the field of view QA. In step SF14, the control circuit 30 decides whether the infrared detection element can detect the temperature rise on the oven broiling dish 80 based on the decision of whether the temperature detected by the infrared detection element has risen sufficiently. If the control circuit 30 determines that the infrared sensor 7 cannot detect the temperature rise, the control circuit 30 alerts the user with an error notice and terminates the preheat process.

It is also preferable for the microwave oven 1 to change the scanning range of each infrared detection element by changing the angle of the infrared sensor 7 by other means according to the height at which the oven broiling dish 80 is installed in the heating chamber 10. When the height at which the oven broiling dish 80 is installed in microwave oven 1 is specified in the cooking menu, the scanning range must be changed based on the selected cooking menu. If the height at which the oven broiling dish 80 is installed is improper for the scanning range of the infrared detection elements in the error detection process, an error notice will be issued since the infrared element cannot detect the temperature rise on the oven broiling dish 80. In the error detection process, an error notice can be issued when the oven broiling dish 80 is not installed at the specified height for the particular cooking menu and also when detecting an error based on the height of the oven broiling dish 80 through a change of the scanning range. Since an error notice can be made in this additional case, the user must be issued an error notice to understand that there is a possibility of error in the installation position of the oven broiling dish 80.

The error detection process issues an error notice when the temperature rise is not within the specified range. The method of the temperature rise varies with the material of the oven broiling dish 80 installed in the heating chamber 10. In the error detection process, the installation position of the oven broiling dish 80 and the material of the oven broiling dish 80 must be proper. Therefore, an oven broiling dish 80 made of a different material from the material of the regular oven broiling dish 80 cannot be installed in the heating chamber 10 by mistake.

When the microwave heating element 81 is vapor-deposited only on a portion of the oven broiling dish 80, the scanning range of the infrared detection elements can be limited to the area where the microwave heating element 81 is vapor-deposited. Therefore, the infrared sensor 7 can detect temperatures efficiently since the infrared sensor 7 skips area where temperature detection is not necessary.

Additionally, the scanning ranges of the infrared detection elements can depend on the cooking menu to skip areas where temperature detection is not necessary. For example, during a simmering process, only the central area of the heating chamber 10 can be scanned or only the area where food is present can be scanned by conducting a preliminary detection of the entire heating chamber 10 at the beginning of the heating process, thereby determining the location of the food. Alternatively, the area where the food is present can be scanned by allowing the user to enter the location of the food.

As shown in FIG. 43A, if the preheat process is not cancelled in the error detection process in step SA5, the control circuit 30 decides whether the maximum value of the latest Tnmax is greater than Tnmax 2 in step SA6. If Tnmax is greater than Tnmax2, the control circuit 30 advances to step SA7; if Tnmax is smaller than Tnmax2, the control circuit 30 returns to step SA3.

In step SA7, the control circuit 30 calculates "Tnmax–Tnave0," selects four infrared detection elements by discarding the two infrared detection elements with the highest "Tnmax–Tnave0" and the two infrared detection elements with the lowest "Tnmax–Tnave0 " as the preheat control objects, and the control circuit 30 advances to step SA8.

In step SA13, the control circuit 30 selects as the preheat control objects the infrared detection elements specified as the default A infrared detection elements among the eight infrared detection elements, and the control circuit 30 advances to step SA8. Step SA13 selects predetermined infrared detection elements to be the preheat control objects if it is difficult to determine the preheat control objects, such as when the oven broiling dish 80 is already warm from the beginning of the heating process.

In step SA15, the control circuit 30 selects as the preheat control objects the infrared detection elements specified as the default A infrared detection elements among the eight infrared detection elements, and the control circuit 30 advances to step SA8. As shown in FIGS. 46A and 46B, step SA15 selects the infrared detection elements that are considered appropriate to become the preheat control objects when it is too difficult to place the entire oven broiling dish 80 within the field of view QA of the infrared detection elements.

The control circuit 30 executes the output confirmation process (as shown in FIG. 44) in step SA8, executes the dish temperature detection process (as shown in FIG. 41) in step SA9, and executes the error detection process (as shown in FIGS. 45A and 45B) in step SA10.

If the preheat process is not canceled in the error detection process in step SA10, the control circuit 30 decides whether Tcave has reached Tcave 1 in step SA11. Tcave is the average temperature detected by the preheat control objects in the scanning range, and Tcave 1 is the specified temperature. The control circuit 30 repeats steps SA8–SA10 until Tcave reaches Tcave 1, and then, the control circuit 30 advances to step SA12.

In step SA12, the control circuit 30 starts counting the count value ta on the timer, and then, the control circuit 30 advances to step SA15.

The control circuit 30 executes the output confirmation process (as shown in FIG. 44) in step SA15, executes the dish temperature detection process (as shown in FIG. 41) in step SA16, and executes the error detection process (as shown in FIGS. 45A and 45B) in step SA17.

If the preheat process is not canceled in the error detection process in step SA17, the control circuit 30 decides whether Tcave has reached the specified temperature Tcave 2 in step SA18. The control circuit 30 repeats steps SA15–SA17 until Tcave reaches Tcave 2, and then stops counting ta in step SA19. Then, the control circuit 30 determines the preheat time t1 and advances to step SA20 when Tcave reaches Tcave 1. The preheat time t1 is determined by a predetermined function f2 (x, ta) which is dependent on the preheat temperature x and the count value ta of the timer.

As the preheat time t1 is determined by the function f2 (x, ta) in this embodiment, there is no need for the infrared detection elements to detect temperatures up to such a high temperature as the preheat temperature x. Therefore, the cost of the microwave oven 1 can be reduced. The reason for being able to determine t1 based on the preheat temperature x and the count value of the timer ta will be described below with reference to FIG. 47.

Figure 47:
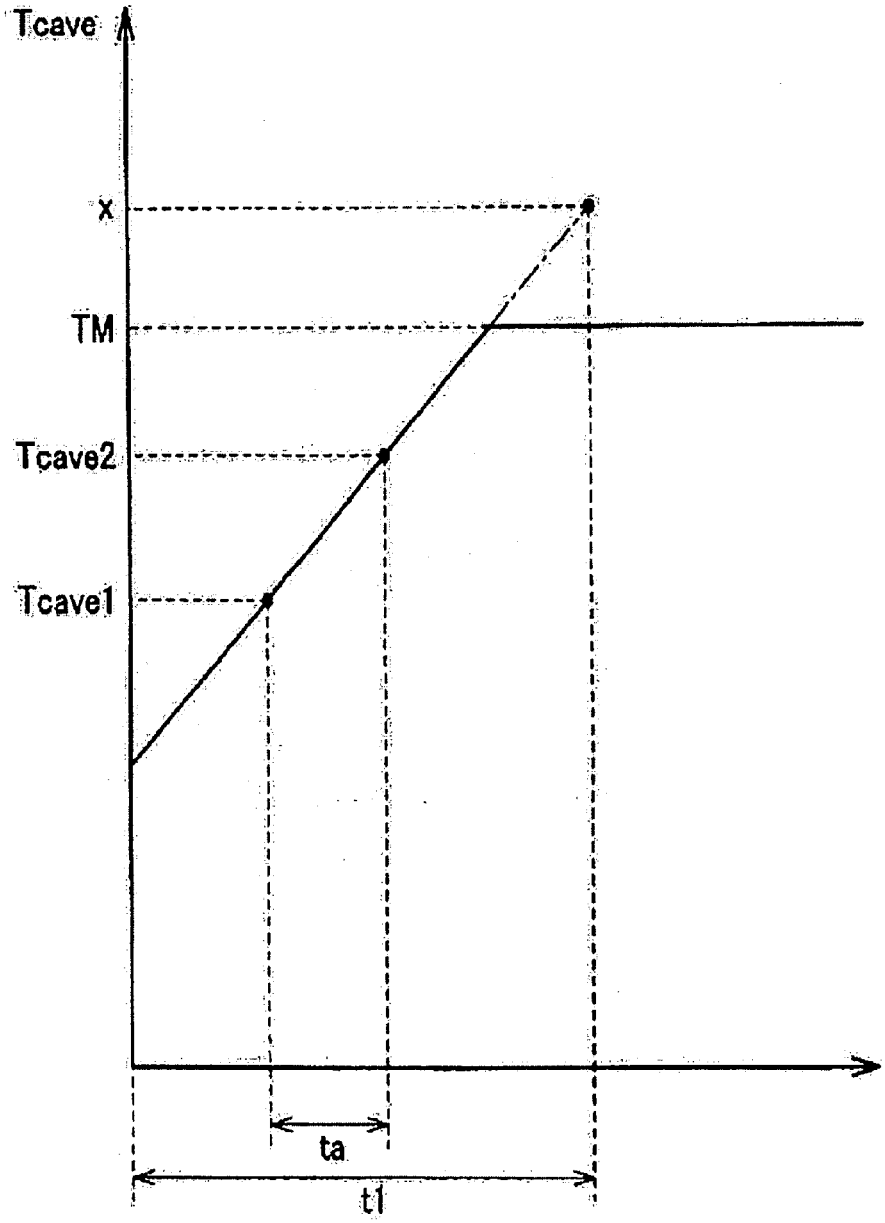
FIG. 47 is a diagram showing the chronological change of Tcave from the starting point of preheat process in a microwave oven according to the present invention.

FIG. 47 indicates the chronological change of Tcave measured from the start of the preheat process. In FIG. 47, TM is the upper limit of the temperature that can be detected by the infrared detection elements, and x is the preheat temperature. The change in Tcave is shown by a solid line.

When the preheat process starts, Tcave rises up to TM and afterwards remains constant at Tcave, even if the temperature of the oven broiling dish 80 continues to rise. The time t1 required for the oven broiling dish 80 to reach the preheat temperature x can be estimated by considering an extension line (shown as a dashed line) extending from Tcave 1 to Tcave 2. Examples of x, TM, Tcave 2, and Tcave 1 are 200° C., 140° C., 110° C., and 70° C. respect As shown in FIG. 43C, after step SA19, the control circuit 30 executes the output confirmation process (shown in FIG. 44) in step SA20, decides the count value t of the timer (which was started to count in step S701) in step S21, repeats step SA20 until the count value t reaches the preheat time t1 or the maximum preheat time tmax, and then returns to the preheat process when the count value t reaches the preheat time t1 or the maximum preheat time tmax. Next, the preheat control B process (shown in FIG. 39 as step S710) is shown in detail in FIG. 48. In the preheat control B process, the control circuit 30 sets the preheat time t2 as a function of the preheat temperature x, i.e., f3 (x), in step SB1; sets the output P of the magnetron 12 to the preheat holding output Px (which was set in step S703) in step SB2; and executes the output setting B process in step SB3. The output setting B process is shown in FIG. 49.

In the output setting B process, the control circuit 30 detects the inverter temperature Ti in step SG1 and decides whether Ti is smaller than the specified temperature Ti2 in step SG2. If Ti is smaller than Ti2, the control circuit 30 returns to the preheat control B process; if Ti is greater than Ti2, the control circuit 30 sets the output P of magnetron 12 to P3 in step SG3, sets the preheat time tn to tmax 3 in step SG4, and returns to the preheat control B process.

Figure 48:
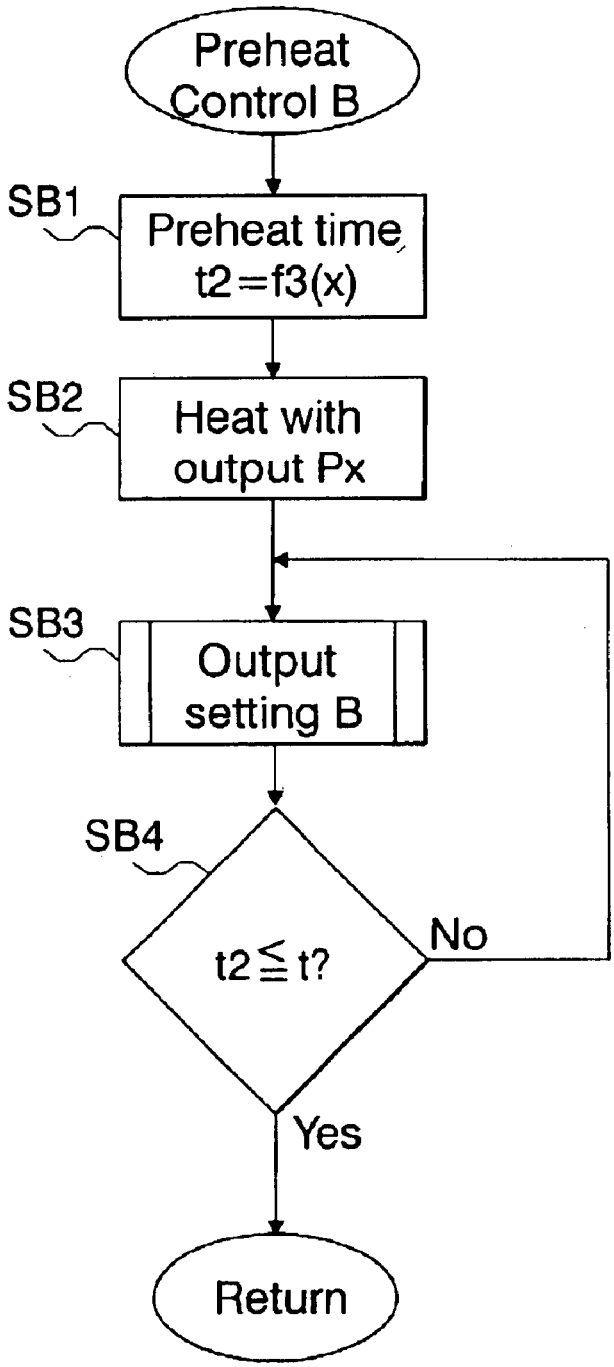
FIG. 48 is a flowchart of the preheat control B process subroutine of FIG. 39.
Figure 49:
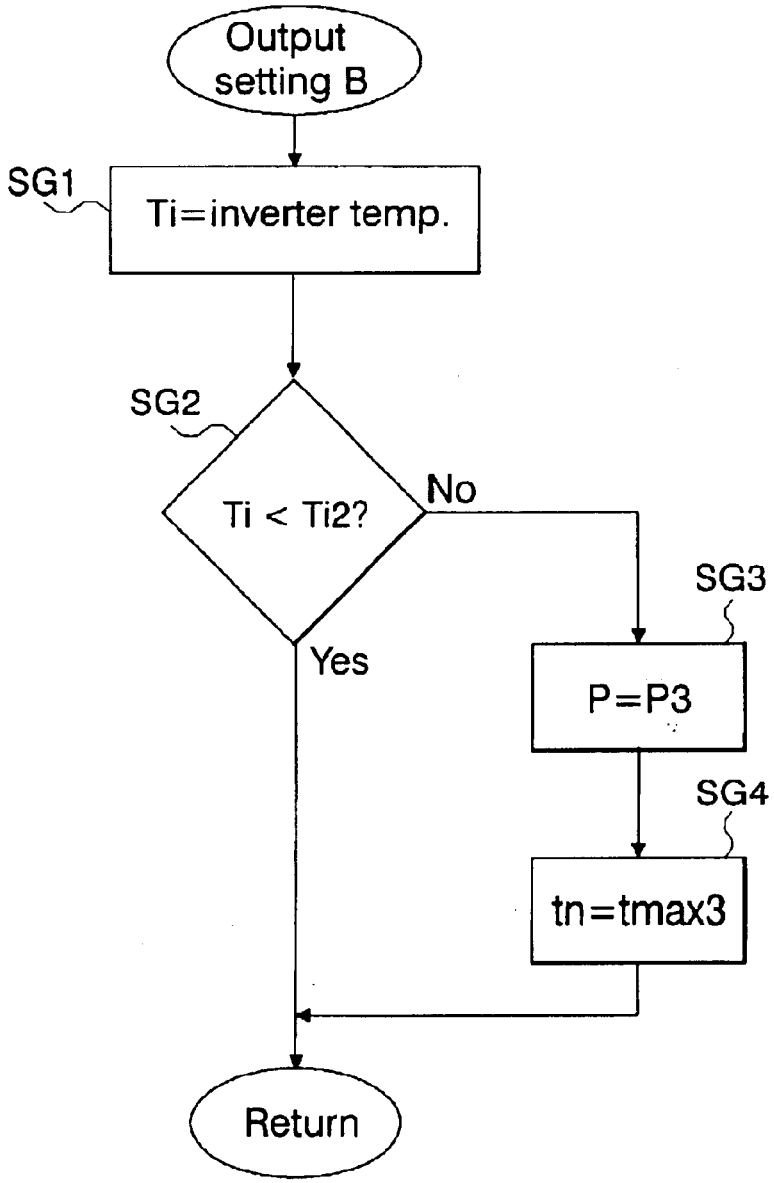
FIG. 49 is a flowchart of the output setting B process subroutine of FIG. 48.

As shown in FIG. 48, after step SB3, the control circuit 30 decides whether the count value t of the timer, which began counting in step S703, has reached the preheat time t2. The control circuit 30 repeats the output setting B process in step SB3 until the count value t of the timer reaches t2 in step SB4, and then returns to the preheat process.

As shown in FIG. 39, since the preheat control B process is executed when the temperature of the heating chamber 10 detected by the open thermistor 59 is relatively low and the temperature of the oven broiling dish 80 is relatively high, the output of the magnetron 12 lowers and the temperature of oven broiling dish 80 settles down automatically in the preheat process.

Figure 50:
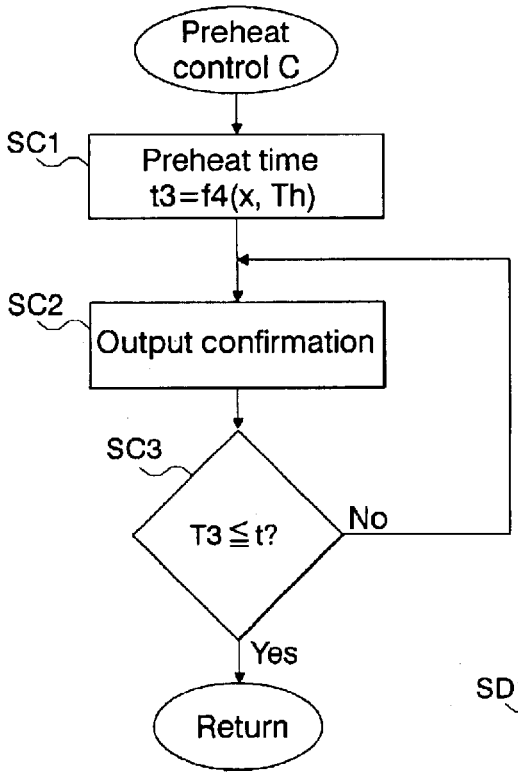
FIG. 50 is a flowchart of the preheat control C process subroutine of FIG. 39.

The preheat control C process executed in step S711 is shown in FIG. 50. The preheat control C process is executed when the temperature of the heating chamber 10 is relatively high and the temperature of the oven broiling dish 80 is relatively low as shown in FIG. 39. In the preheat control C process, the control circuit 30 sets the preheat time t3 based on a function of the preheat temperature x and the temperature of the heating chamber 10 detected by the open thermistor 59, i.e., f4 (x, Tth) in step SC1. Then, the control circuit 30 executes the output confirmation process (as shown in to FIG. 44) in step SC2 and repeats step SC2 until the count value t of the timer reaches the preheat time t3 in step SC3, and returns to the preheat process when the count value t of the timer reaches the preheat time t3.

Table 1 shows an example of the function f4 (x, Tth).

TABLE 1

| Preheat temperature x (° C.) | f4 (x, Tth) Tth (low) | Tth (high) |
|---|---|---|
| –150 | 2 min | 1 min |
| 150–200 | 3 min | 2 min |
| 200–250 | 4 min | 3 min |

The function f4 (x, Tth) defines the preheat time for each preheat temperature zone. The function f4 (x, Tth) also defines two temperature zones of Tth (low) and Tth (high) using specified threshold values from the detection temperature Tth from the open thermistor 59 and defines the preheat time for each of the temperature zones.

Figure 51:
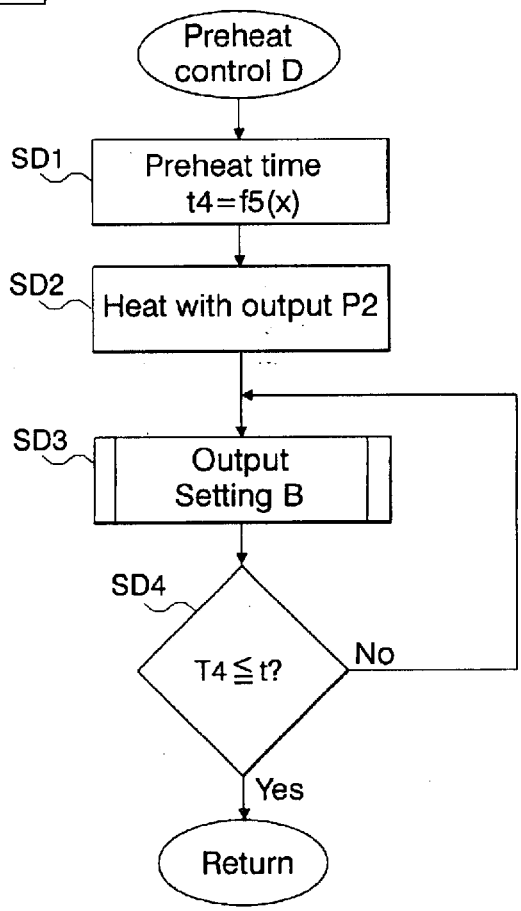
FIG. 51 is a flowchart of the preheat control D process subroutine of FIG. 39.

The preheat control D process executed in step S712 is shown in FIG. 51. In the preheat control D process, the control circuit 30 sets the preheat time t4 based on a function of the preheat temperature x, i.e., f5 (x) in step SD1; sets the output of magnetron 12 to P2; and executes the output setting B process (shown in FIG. 49) in step SD2. The control circuit 30 repeats step SD3 until the count value t of the timer reaches the preheat time t4 in step SD4 and returns to the preheat process when the count value t of the timer reaches the preheat time t4.

Since the maximum preheat time is determined in the preheat processes described above, the preheat process will be completed automatically even if problems develop in the infrared detection elements. Also, the number of infrared detection elements that are used as the preheat control objects is assumed to be four out of eight infrared elements, however the invention is not limited to this assumption.

In the preheat process of this embodiment, the magnetron 12 is driven for a predetermined time during the preheat control C process or during the preheat control C process in step S706, if the temperature Tth of the heating chamber 10 detected by the open thermistor 59 is decided by the control circuit 30 to exceed the specified temperature Th1. Also, if the control circuit 30 decides that the temperature Tth of the heating chamber 10 detected by the open thermistor 59 in step S706 exceeds the specified temperature, the control circuit 30 selects the infrared detection elements of the infrared sensor 7 in step S707. The temperature detected by the open thermistor 59 is a condition to determine the branching of the preheat control A process through the preheat control D process, and the output of the magnetron 12 is determined in each of the preheat control A process through the preheat control D process. For example, when the control circuit 30 advances to the preheat control D process, the output of the magnetron 12 is set to P2 unless the temperature of the inverter is higher than Ti2. Thus, the temperature of the heating chamber 10 is also a factor for deciding the output of the magnetron 12.

In the preheat processes of this embodiment, the maximum value of Tdnave0 (the average temperature detected by the eight infrared detection elements of the infrared sensor 7 in the scanning range for detecting temperatures in the heating chamber 10 for the first scanning after the start of the heating process by the magnetron 12) is compared to the specified value Tdave1 or Tdave2 in steps S707 and S708. Different preheat times are set in the preheat control A process through the preheat control D process in steps S709–S712. Thus, the preheat time is determined according to the temperature of the oven broiling dish 80 at a specified time after the start of microwave generation by the magnetron 12. The temperature used for comparison in step S707 or step S708 can be the temperature measured just before the magnetron 12 starts to generate microwaves instead of the maximum value of Tdnave0.

Figure 52:
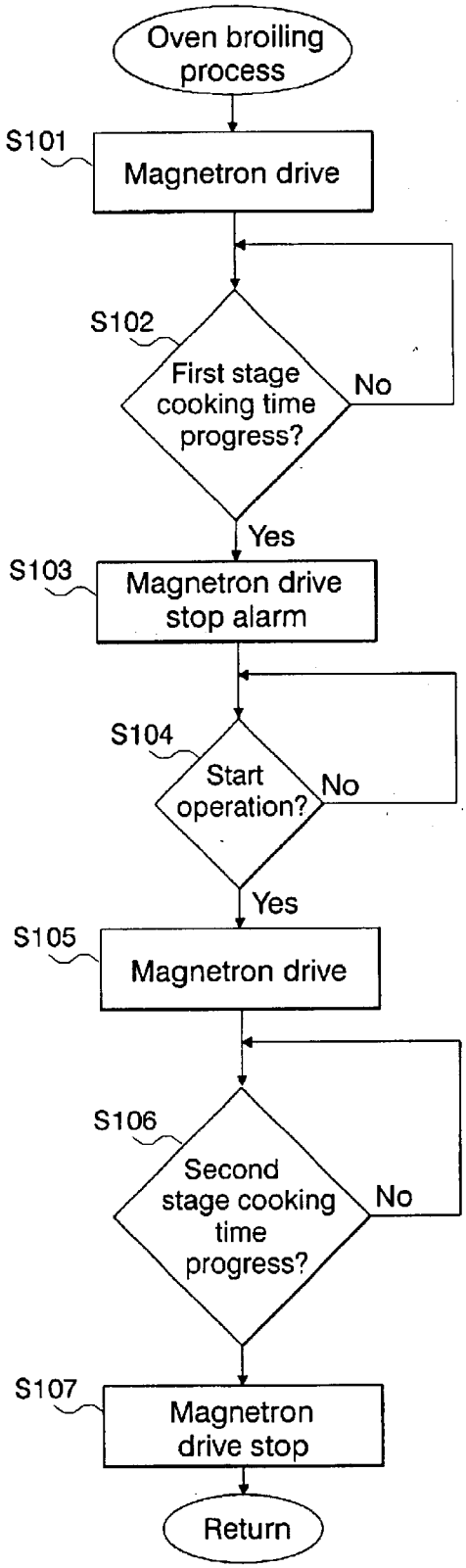
FIG. 52 is a flowchart of the oven broiling process subroutine of FIG. 37.

Next, the oven broiling process executed in step S10 in FIG. 37 is shown in FIG. 52. In the oven broiling process, the control circuit 30 starts driving the magnetron 12 in step S101 and waits for the first stage cooking time to pass in step S102. When the first stage cooking time expires, the control circuit 30 stops driving the magnetron 12 and notifies the user that the first stage is completed by a device such as an alarm in step S103. Then, an instruction is displayed using the display unit 60, for example, thereby prompting the user to turn over the food on the oven broiling dish 80.

The control circuit 30 then waits for the user to perform the heating start operation to start the heating process in step S104 and starts driving the magnetron 12 again in step S105.

The control circuit 30 then waits for the second stage cooking time to expire in step S106, stops driving the magnetron 12 in step S107, and returns to the main program.

In the oven broiling process described above, the second stage cooking time after the food is turned over can be shorter than the first stage cooking time in order to obtain better results when cooking.

After the magnetron 12 is restarted in step S105, immediately after the second stage cooking time has started, it is preferable to let the magnetron 12 temporarily deliver a higher output since the temperatures in the heating chamber 10 and the oven broiling dish 80 are assumed to drop as the magnetron 12 stops operating temporarily during steps S103 and S104. The output of the magnetron 12 can be lowered during the oven broiling and double side broiling processes as in the preheat process as certain times such as when the inverter temperature is too high. It is preferable to extend the second stage cooking time in order to cover the reduction of the output of the magnetron 12 in the first stage.

Moreover, the microwave oven 1 can reduce the output of the magnetron 12, for example, when the inverter temperature becomes too high, and can maintain steady output even if the conditions for reducing the output of the magnetron 12 are satisfied but there is little cooking time remaining.

Figure 53:
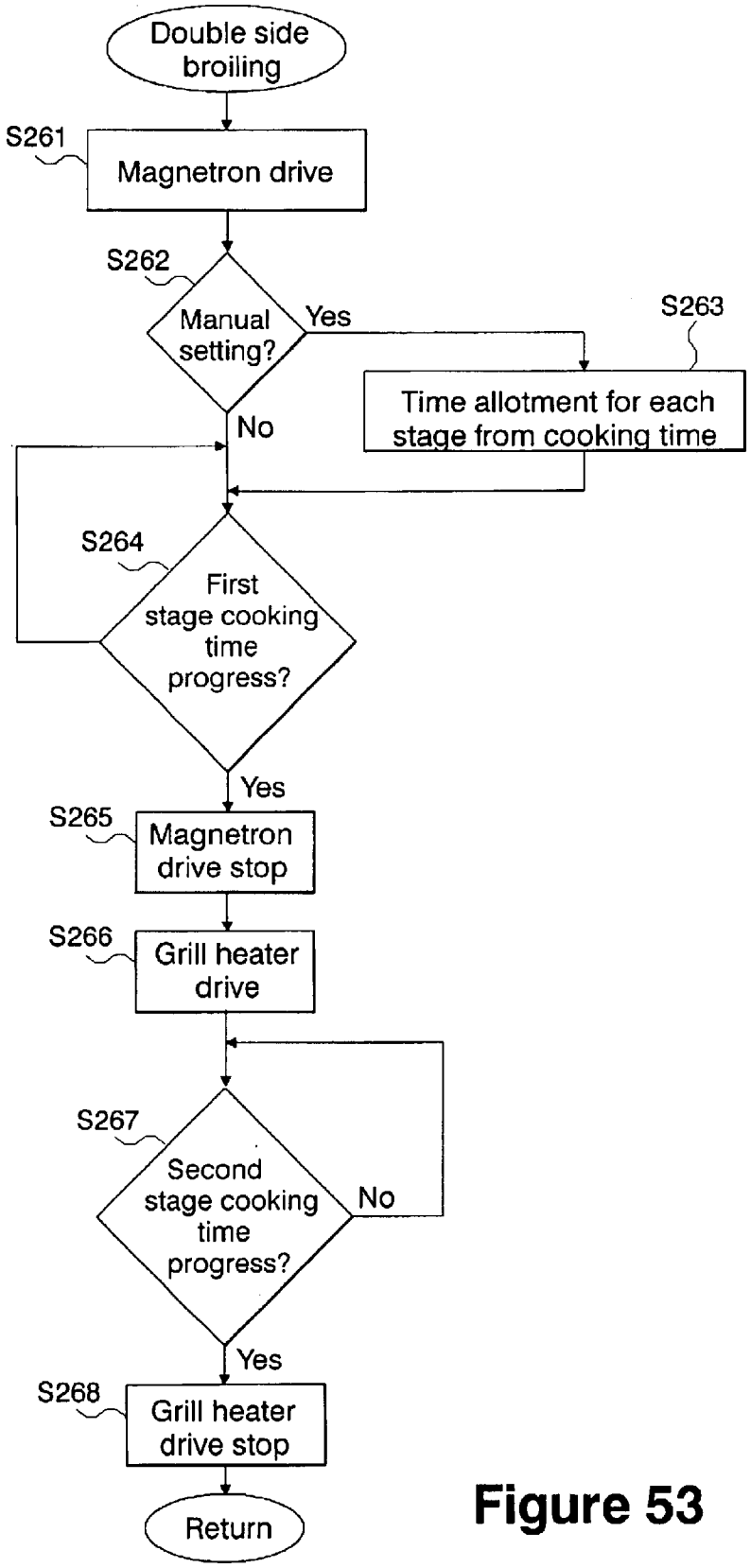
FIG. 53 is a flowchart of the double side broiling process subroutine of FIG. 38.

The double side broiling process, which is executed in step S26 in FIG. 38, is shown in FIG. 53. In the double side broiling process, the control circuit 30 starts driving the magnetron 12 in step S261 and decides whether manual double side broiling is selected in step S262. If the control circuit 30 decides that manual double side broiling has been selected, the control circuit 30 determines the first stage cooking time and the second stage cooking time based on a predetermined cooking time, which was set up in step S13. The control circuit 30 uses a predetermined method for selecting the first stage and second stage cooking times in step S263 and then advances to step S264. If the control circuit 30 decides that manual double side broiling has not been selected in step S262, the control circuit 30 advances to step S264.

Since the first stage cooking time and the second stage cooking time are automatically determined in step S263, the user can execute an appropriate double side broiling process using the microwave oven 1 by simply entering the total cooking time.

In step S264, the control circuit 30 waits for the first cooking time to expire and then, advances to step S265. In step S256, the control circuit 30 stops driving the magnetron 12 and starts driving the grill heater 51. In step S267, the control circuit 30 waits for the second stage cooking time to expire and then advances to step S268.

In step S268, the control circuit 30 stops driving the grill heater 51 and returns to the main program. In the double side broiling process, the top surface of the food on the oven broiling dish 80 is browned by grill heater 51, and the bottom surface is browned by the microwave heating element 81 of the oven broiling dish 80, and the inside of the food is cooked by microwaves, so that the entire portion of food can be cooked in a short period of time. Although it is preferable if both the magnetron 12 and the grill heater 51 are driven simultaneously, the maximum breaker capacity of normal houses, i.e., the no-fuse breaker capacity of 15–20 A, does not allow the simultaneous use of microwave ovens and heaters.

Therefore, the microwave oven and the heater are used separately as described above.

When the installation position of the oven broiling dish 80 in the heating chamber 10 of the microwave oven 1 is selected from a plurality of levels as shown in FIGS. 10, 17, etc., in a cooking process where the surface of the food is browned using the grill heater 51 such as in the double side broiling process, it is preferable to place the oven broiling dish 80 at a location closest to the grill heater 51. The control circuit 30 is capable of displaying a suggestion in the display unit 60 for prompting the user to place the oven broiling dish 80 in a location closest to the grill heater 51.

All of the embodiments disclosed herein should be construed as examples and not of a limiting nature. The scope of the invention are indicated not by the descriptions above, but by the claims shown herein, and the invention is intended to include all variations within the scope of claims and their equivalencies.

What is claimed is:

1. A microwave heating device comprising:

a heating chamber for holding an object to be heated;

a magnetron for generating microwaves;

a waveguide for supplying the microwaves generated by said magnetron through the bottom of said heating chamber;

a heating dish on which said object to be heated is placed, said heating dish having a bottom surface;

a microwave heating element for generating heat by absorbing the microwaves, said microwave heating element located on the bottom surface of said heating dish; and an access passage disposed between said microwave heating element and an outer edge of said heating dish for allowing the microwaves introduced by said waveguide to reach above said heating dish from underneath said heating dish.

2. A microwave heating device described in claim 1, wherein said heating chamber has recessed areas for providing gaps between an inner wall of said heating chamber and said heating dish, said recessed areas located adjacent to said heating dish installed within said heating chamber.

3. A microwave heating device described in claim 1, wherein said heating dish is provided with said microwave heating element except on the outer edge area of said heating dish.

4. A microwave heating device described in claim 1, further comprising: a heater located above said heating dish.

5. A microwave heating device described in claim 1, wherein a dimension of said access passage in the direction perpendicular to the propagating direction of said microwaves is greater than one quarter of the wavelength of said microwaves.

6. A microwave heating device described in claim 1, wherein the inner wall of said heating chamber has a first surface and a second surface that faces a direction different from that of the first surface; and rails are formed on said first surface and said second surface for supporting said heating dish, wherein said rails formed on said first surface or second surface comprise a plurality of members spaced from each other on a single plane.

7. A microwave, heating device described in claim 1 wherein a groove is formed on the outer edge of the surface of said heating dish that carries said object to be heated.

8. A microwave heating device described in claim 1, wherein the lowest part of said heating dish is located below said microwave heating element.

9. A microwave heating device described in claim 1, further comprising:

a rotating antenna that rotates for spreading the microwave energy in said waveguide inside the heating chamber, and a rotation control unit for controlling the rotation of said rotating antenna, wherein said rotation control unit stops said rotating antenna at a position corresponding to the height at which said heating dish is stored when said magnetron generates the microwaves.

10. A microwave heating device described in claim 1, further comprising:

a rotating antenna that rotates for spreading the microwave energy in said waveguide inside the heating chamber, wherein the area of a surface of said microwave heating element of said heating dish perpendicular to the traveling direction of said microwaves is equal to the area of said rotating antenna when the distance between said heating dish and the bottom face of said heating chamber in the traveling direction of said microwaves is ⅛ of the wavelength of said microwaves, increases in proportion to the degree said distance in said traveling direction is greater than ⅛ of the wavelength of said microwaves, and reduces in proportion to the degree said distance in said traveling direction is smaller than ⅛ of the wavelength of said microwaves.

11. A microwave heating device described in claim 1, wherein said heating dish is stored in said heating chamber at a location ⅛ of the wavelength of said microwaves apart from the bottom face of said heating chamber.

12. A microwave heating device described in claim 1, further comprising:

a rotating antenna that is provided inside the heating chamber and rotates within a specified plane for spreading the microwaves in said waveguide; and metal plates provided on the circumference of said rotating antenna, wherein said heating chamber is connected to said waveguide; further comprising:

an antenna enclosure provided in the vicinity of said connection between said waveguide for enclosing said rotating antenna; wherein in case when a placement span, which is a distance between the circumference of said rotating antenna and the surface of said antenna enclosure along a direction perpendicular to said specified plane, is not uniform, said metal plates are positioned in areas where said placement span is the longest.

13. A microwave heating device described in claim 12, wherein the tips of said metal plates are located ahead of said rotating antenna relative to the traveling direction of said microwaves.

14. A microwave heating device described in claim 13, further comprising:

a heater provided on the outer periphery of said rotating antenna, wherein said metal plates are located between said heater and said rotating antenna.

15. A microwave heating device described in claim 1, further comprising:

a door that controls an access to said heating chamber; and a first protruding part provided on the inner wall of said heating chamber, which protrudes into said heating chamber, and abuts against said heating dish when the heating dish is placed in a position undesirable for the introduction of the microwaves into the heating chamber; wherein said magnetron generates microwaves on the condition that said door is closed, and said abutting of said heating dish against said first protruding part prevents said door of said heating chamber from closing.

16. A microwave heating device described in claim 1, further comprising:

a door that controls an access to said heating chamber;

a heater for heating foods in said heating chamber; a metallic dish, which is held in said heating chamber and carries said object to be heated when it is heated by said heater; and a second protruding part that abuts with said metallic dish when said metallic dish is placed in a position undesirable for the introduction of the microwaves into the heating chamber; wherein said magnetron generates microwaves on the condition that said door is closed;

said abutting of said heating dish against said second protruding part prevents said door of said heating chamber from closing; and said heating dish is shaped in such a way that it does not abut against said second protruding part even when said heating dish is located in every position possible in said heating chamber.

17. A microwave heating device described in claim 1, wherein said microwave heating element has a thickness that equalizes the amount of microwaves absorbed by said microwave heating element with the amount of microwaves passed through.

18. A microwave heating device described in claim 1, wherein said microwaves pass through said outer edge of said heating dish.

* * * * *